US008528630B2

(12) United States Patent
Tunget

(10) Patent No.: US 8,528,630 B2
(45) Date of Patent: Sep. 10, 2013

(54) THROUGH TUBING CABLE ROTARY SYSTEM

(76) Inventor: Bruce A. Tunget, Westhill (GB)

( * ) Notice: Subject to any disclaimer, the term of this patent is extended or adjusted under 35 U.S.C. 154(b) by 326 days.

(21) Appl. No.: 12/803,775

(22) Filed: Jul. 6, 2010

(65) Prior Publication Data

US 2011/0000668 A1 Jan. 6, 2011

(30) Foreign Application Priority Data

Jul. 6, 2009 (GB) ..... 0911672.4
Nov. 19, 2009 (GB) ..... 0920214.4
Jun. 22, 2010 (GB) ..... 1010480.0

(51) Int. Cl.
*E21B 29/00* (2006.01)

(52) U.S. Cl.
USPC ..... 166/55.8; 30/103; 166/298

(58) Field of Classification Search
USPC ..... 166/55–55.8, 297, 298, 361, 285, 166/242.7
See application file for complete search history.

(56) References Cited

U.S. PATENT DOCUMENTS 2,630,866 A * 3/1953 Ragan ..... 166/121
3,085,627 A * 4/1963 Sodich ..... 166/120
4,364,432 A * 12/1982 Bass et al. ..... 166/290
4,442,908 A * 4/1984 Steenbock ..... 175/74
5,318,115 A * 6/1994 Rouse ..... 166/55.7
5,457,841 A 10/1995 Minton
6,368,418 B1 4/2002 Rowe
6,478,088 B1 * 11/2002 Hansen et al. ..... 166/285
6,651,744 B1 11/2003 Crawford
7,380,603 B2 * 6/2008 Jeffrey et al. ..... 166/285
2001/0040052 A1 11/2001 Bourgoyne et al.
2001/0047872 A1 12/2001 Roberts et al.
2004/0112640 A1 * 6/2004 Hay et al. ..... 175/26
2004/0118565 A1 6/2004 Crawford
2004/0178001 A1 9/2004 Bourgoyne et al.
2005/0283927 A1 12/2005 Kinnari et al.
2005/0284504 A1 12/2005 Kinnari et al.
2007/0017707 A1 1/2007 Fanuel et al.
2009/0266560 A1 10/2009 Ring et al.
2010/0038080 A1 2/2010 McAfee et al.
2011/0209872 A1 * 9/2011 McAfee et al. ..... 166/298

* cited by examiner

*Primary Examiner* — Kenneth L Thompson
*Assistant Examiner* — Kipp Wallace
(74) *Attorney, Agent, or Firm* — The Matthews Firm

(57) ABSTRACT

Methods and apparatus, for performing rotary, cutting and/or crushing operations in a subterranean borehole or conduit thereof, which use higher and lower pressures therein to operate a motor, actuator and/or piston, particularly for sealing operations using a downhole assembly, placeable with a cable. The downhole assembly comprises at least a motor or actuator coupled to at least one of a rotary tool, axial cutting tool and/or packer or piston. The motor or actuator piston may be operated by differential fluid pressure across ends thereof, to form a space free of debris that may be provided for placement of a settable sealing material to prevent leakage paths in the concrete seal of said subterranean borehole or conduits thereof.

42 Claims, 16 Drawing Sheets

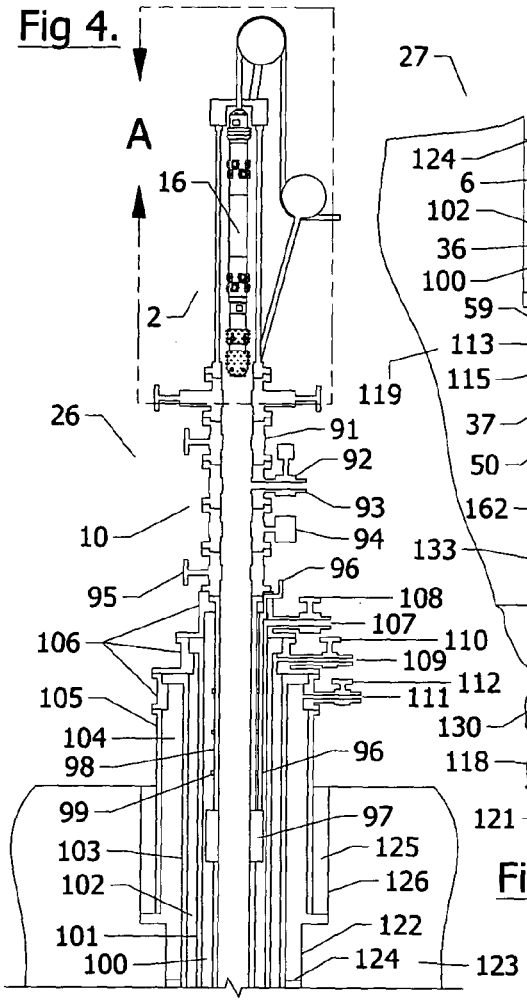
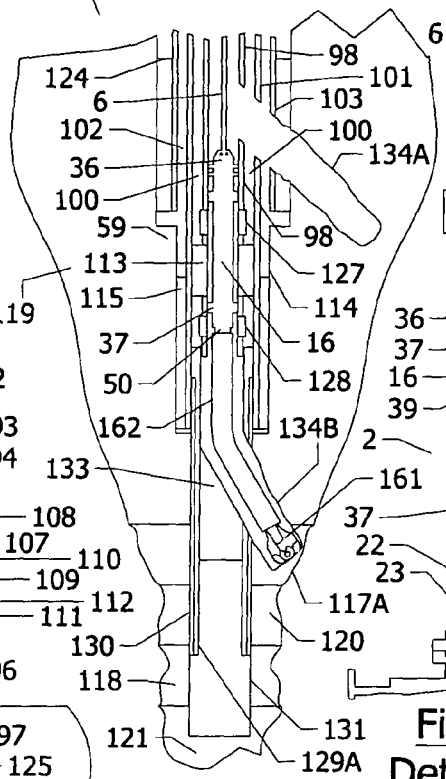
Fig. 6
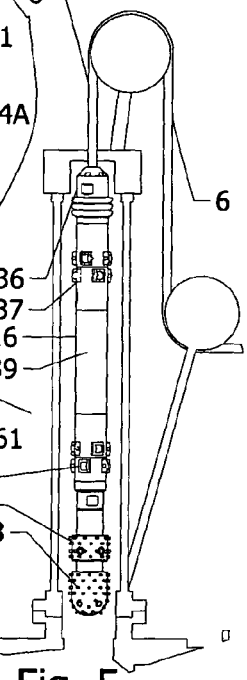
Fig. 5
Detail A
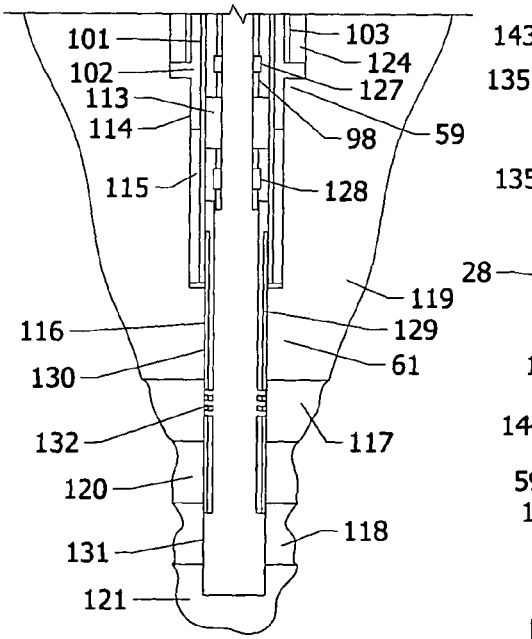
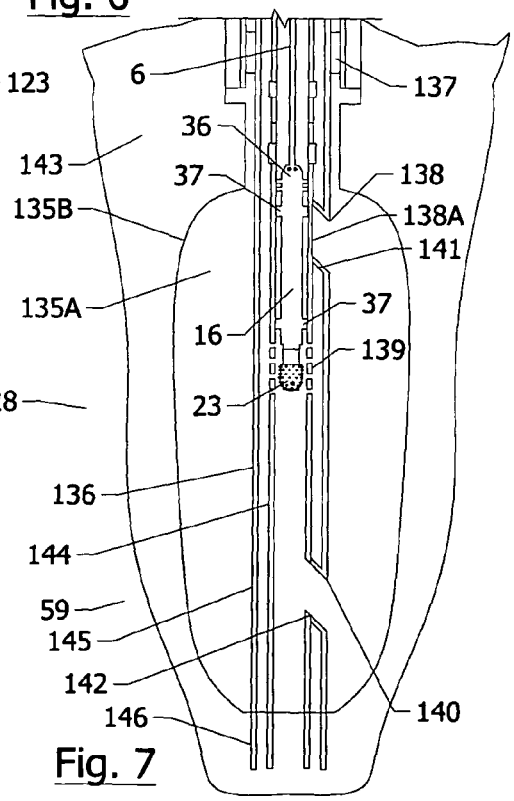
Fig. 7

50A
36
54
37
16
39
37
29
50B
22
16
17
53
60
36
54
61
62
37
16
39
37
23
37
177
50B 50A
36
54
37
39
50B 50A
51
36
147
154

50A
51
147

155
54

153
148
150
151
150
152

222
149
149A
149A
222A
149A
222
149

57
58

B
B
57

157
242
156
242
50B 56
157
156
242
50B

C
C
44

22
50
50

179

50
180

50
184
185
23
179
182
44
45
50
50
181
24

162
48
44
47
183

50

44
45
25
161

46
44
48
50
44
46
49

Detail D
163
164
D

Section C-C 6
30
59
167
168
36
54
37
20
37
170
171

6
6
31
59
36
54
37
16
167
168
39
37
50
18
168
169
170

6
36
32
59
36
54
37
16
167
168
39
37
170A
21
170B
18
169
170

36
32
59
54
37
16
39
37
59
34
59
33
167
168
19
50
18
169
170

166
19
18
169
18
164
165
170

Section F-F

Section E-E 177
6
20
30A
61
36
54
51
42
E
F
50
63
65
66
37
68
178
48
176
64
67
69
170

177
31A
61
6
36
54
37
16
39
37
18
50
18
G
G
198

196
186
50
192
187
H
189
188
194
I
191
190
198
187
18
186
192
50

Section G-G
50
186
196

192
186
189
188
187

Detail H
191
190
194
193
50
197

197
195

187
196
188
192

189

187
193
194
191
186

Detail I

Detail K

Detail L

Section N-N

Section J-J

Detail M

Section O-O

Section O-O 65
78
P
50
201
41
21
P 69
76
P 207
71
65
200
77
77
207
212
65
218A 50
40
214
21
218
65
76
207
Q
50
217
21
217
41
75A
201
75B
199
65
76
78

Section P-P
50
201
75C
199
75A 79
79
Q
72
Q
72
21
40

212

75B
65
212
78
73
69
199
76
75A
73
78

78
75A
199

212
74

69
212
78
65
206

206
76
211
50
21
40
214
201
204
147
200
72
79
78
65
72

Section Q-Q 36
54
37
33A
59
16
39
37
50B
219
220
50
167
19
168

R
R
90

50
90
19
85
221
82
89
81
80

50
19
85
90
221
84
82
84
89
81
83
80
48

Section R-R
50
90
221
85
221
80
86
87
82
50A
83A
84
48
83B
50B 82
86
88
83A
83A
50
50A
83A
83B
84
83B
50B
81
80

50
83B
81
80
84

82
83A
50
50

50A
50
84
83B
50B 50
81
80

Detail S

Detail T

Detail U

Detail W

Detail V

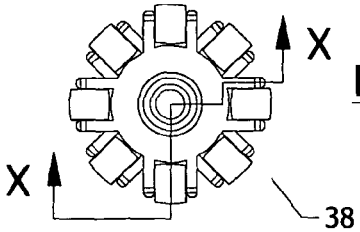
Fig.103
Fig.102
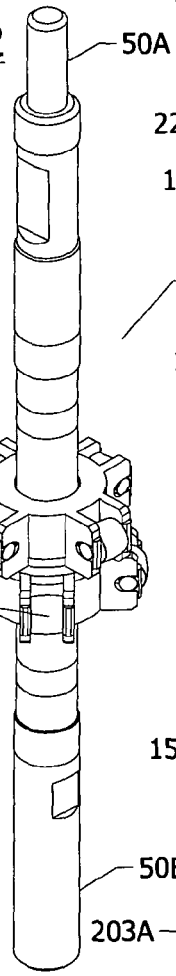
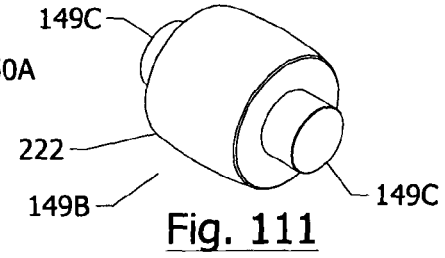
Fig. 111
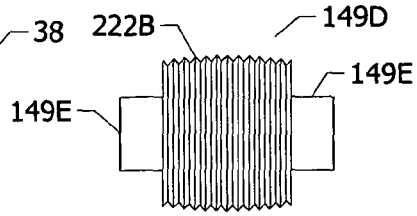
Fig. 112
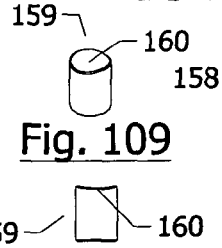
Fig. 109
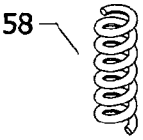
Fig. 110
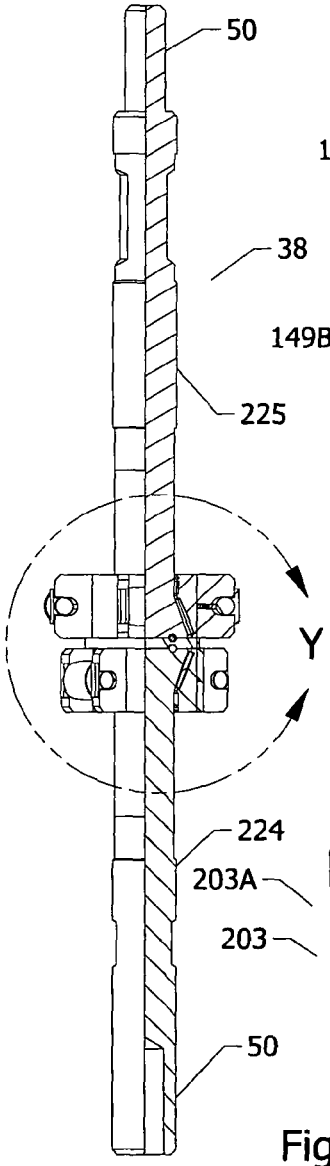
Fig. 104
Section X-X
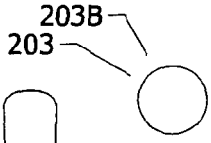
Fig. 107
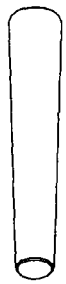
Fig. 106
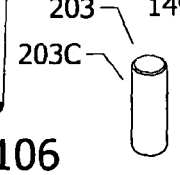
Fig. 108
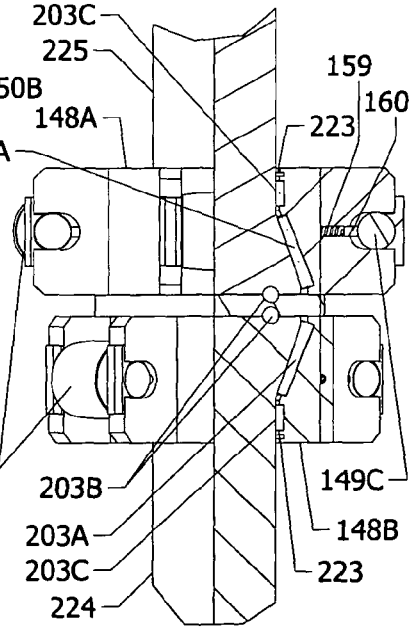
Fig. 105
Detail Y

Y
Y 175
147
54
36

172A
Z
50A
226
52
Z 50
236
126
147
36
52
203
54
238

Section Z-Z
172B
175
237
50B
227
173
AA
AA

Section Y-Y

172

235

50
227
230
173
50
234
173
232

Section AA-AA
231
50
232
233
228
227
229
234
228
50

50A
172
50B

AB
AB
AC
AC
56
57

56
57
239
240
56
174
173

Fig. 129 Detail AD

Fig. 130 Detail AE

Fig. 131 Detail AF

Fig. 132 Detail AG

Detail AH

Detail AI

Detail AJ

THROUGH TUBING CABLE ROTARY SYSTEM

CROSS-REFERENCE TO RELATED APPLICATIONS

The present application claims priority to the United Kingdom patent application having Patent Application Number 0911672.4, entitled "Through Tubing Cable Rotary System," filed Jul. 6, 2009, and the United Kingdom patent application having Patent Application Number GB 1010480.0, entitled "Apparatus And Methods For Operating One Or More Wells To Solution Mine, Dewater And Operate Subterranean Storage Spaces Through A Single Bore," filed Jun. 22, 2010, the United Kingdom patent application having Application Serial Number GB0920214.4, entitled "Apparatus and Methods for Operating a Plurality of Wells through a Single Bore," filed 19 Nov. 2009, the United States patent application having application Ser. No. 12/587,360, entitled "Systems and Method for Operating a Plurality of Wells through a Single Bore," filed Oct. 6, 2009, the United Kingdom patent application having Application Serial Number GB0921954.4, entitled "Systems and Apparatus for Using a Passageway Through Subterranean Strata," filed 16 Dec. 2009, and the United States patent application having application Ser. No. 12/653,784, entitled "Systems and Apparatus for Using a Passageway Through Subterranean Strata," filed Dec. 18, 2009, each of which are incorporated herein in their entirety by reference.

FIELD

The present invention relates, generally, to apparatuses, systems and methods usable with braided wire, slick wire or other methods of placement, to maintain and/or intervene with conduits, and apparatus associated with said conduits, with rotating devices using a fluid driven motor while hoisting and/or jarring conduits or associated apparatus in well bores, platform risers, pipelines or other large diameter conduits.

The present invention also relates, generally, to sealing a conduit using a screw set packer, securing to a conduit using a rotary hanger, axially cutting a conduit and/or circumferentially cutting a conduit using low torque wheel cutters driven by any shaft, including shafts driven by positive displacement fluid motors, combustion engines, pneumatic motors and electric motors.

BACKGROUND

Conventional practice for use of rotary down-hole equipment within a well generally involves use of a large hoisting capacity rig with torque or pumping capacity, coiled tubing operations and/or electric line operations.

Use of high torque rotary equipment within well bores generally requires the use of large drilling rigs to hoist jointed tubular conduits to and from a well, with rotating equipment used to turn the jointed conduits, or a fluid motor at the end of the jointed conduits being used to pump fluid to rotate downhole equipment. These types of conventional operations generally provide the highest lifting and torque capability for downhole equipment rotation.

Alternatively, coiled tubing operations can be performed, which involve use of large reels of flexible tubing, that require large hoisting equipment to support an injector head used to reel the flexible tubing in and out of a well, while pumps are used to circulate fluids through a fluid motor and rotate equipment downhole. Conventional coiled tubing operations generally provide less torque and lifting capacity than use of drilling rigs.

Finally, conventional practice may also involve the use of an electric line unit to place an electric motor downhole for relatively low torque rotary equipment operations, such as cutting tubing with sharp knives. Electric line operations are generally not suitable for hoisting or jarring heavy equipment in or out of a well, as the connection to downhole equipment or electrical wires within their braided wire arrangement may fail.

The conventional use of non-electrical braided wire and slick wire applications do not generally support rotation of downhole equipment, as wires may fail if twisted and are intended primarily for hoisting equipment in or out of a well and/or jarring equipment axially upward or downward as required.

Additionally, while grease heads may not offer sufficient sealing capacity against braided wires, slick wire applications are generally capable of working in higher pressure wells than braided wire applications.

While drilling rigs provide the highest resource level for lifting capacity and torque, they are the most expensive and time consuming of the conventional options, with coiled tubing operations being generally less expensive than a drilling rig but more expensive and operationally complex than electric line operations when rotating down-hole equipment within a well.

Conventional methods and apparatus for separating or joining tubulars in a wellbore, such as the teachings of U.S. Pat. No. 6,478,088B1, US20110209872A1, WO02/38343A2 and/or WO2010/120455A1, include tools that can be suspended from a cable or operated with on-board power to perform a downhole function, including the cutting of wellbore tubulars. However, these conventional methods and apparatus do not address the need for a cable-conveyable downhole assembly (16, 17, 25, 30-34, 31A-33A, 32B, 35, 43, 59, 180), which may include a tool subassembly with: a downhole motor or actuator (19, 36, 39, 44, 64) and one or more of an axially and transversely movable wheeled anti-rotation tool (37, 38, 175, 198), a wall securable hanger tool (18), a packer sealing tool (19, 49, 54, 89, 180), a rotary cutting tool (22, 23, 24, 161), a circumferential rotary conduit cutting tool (21, 24, 40, 41, 43, 65), an axial conduit cutting tool (20, 43), or combinations thereof, which can be usable for operating upon a portion of the deployment, peripheral and/or surrounding wall(s) of the subterranean borehole or conduit thereof, to form a space that can be usable for further operating upon the same or other wall(s). In addition, the conventional methods and apparatus do not address the need for displacing fluid against a subterranean disposed wall or placing a settable sealing material against a subterranean wall, using the formed space, as described in the embodiments of the present invention. As described herein, the present invention provides significant and distinct advantages and improvements over the existing teachings, as set forth above and which, as set forth below, are limited to the separation of milling of a downhole conduit(s), as taught in U.S. Pat. No. 6,478,088B1, US20110209872A1, WO02/38343A2 and WO2010/120455A1, because such applications do not purposely use higher and lower pressure ends of the borehole, or conduits thereof, to create and enlarge a usable space within a subterranean bore or conduit for other downhole operations, including fluid displacement and/or placement of a settable sealing material.

Additionally, other conventional teachings, including WO2007110/444, WO 2004/016901 A1 and GB2275282 A, address the boring or perforating of a hole in a conduit, wherein a sealant may be injected behind the conduit, but similarly do not address the forming or creation of a usable space, while suspended from a cable. Anti-rotation devices, such as those disclosed in US 20040112640 A1, are not axially and radially movable to rotationally hold and/or cut a subterranean borehole or conduit thereof, as described by Applicant. Hence, the existing art does not teach the methods and apparatus of the present invention, which include axially and/or radially and circumferentially cutting a conduit for the purposes of separating, weakening and/or cleaning a conduit, when forming or using the sealable spaces of the subterranean well. Accordingly, the present invention provides distinctive methods and apparatus for using and/or sealing a subterranean borehole and/or conduit thereof, which provide significant advantages over the existing art.

For example, as non-electrical braided wire and slick wire operations are comparable in cost and operational complexity to electrical wire line operations and have the ability to hoist heavy loads into and out of a well and/or to jar stuck equipment loose, if necessary. They also provide an opportunity to perform heavy work and to rotate downhole equipment using a positive displacement fluid motor for tasks in which torque requirements are less than those requiring a drilling rig.

Embodiments of the present invention provide the ability to rotate down-hole equipment within a well for applications such as cleaning well conduits and down-hole apparatuses, cutting well conduits and apparatuses, side-tracking wells, performing well abandonments, and maintaining and/or intervening in storage wells, casing drilling operations or any well operation where braided or slickline intervention is currently used or possible.

Specifically, embodiments of the present invention are placeable with braided and slick cable in subterranean wells, such as through use of remote operated vehicles in ocean pipelines, or by other methods, in large diameter conduits where fluid flow can be used to operate axially fixed and axially variable positive displacement fluid motors to drive rotary apparatuses, axial conduit cutting apparatuses and/or circumferential conduit cutting apparatuses to perform maintenance and/or intervention on one or more concentric conduits of well bores, platform risers, pipelines or other large bore conduits.

As drilling rig and coiled tubing operations are expensive and complex for maintenance of wells, chemical cleaners (e.g. for removing scale or debris) are often used when mechanical cleanup, using rotary brushes and other rotating devices including jetting equipment, would be more effective. Embodiments of the present invention enable alternatives for mechanical rotation to perform chemical cleaning of well conduits and down-hole apparatus.

Additionally, where axially movable brushes may be used with braided wire and slick wire applications to clean inoperable down-hole devices (e.g. subsurface safety valves, engagement nipples with debris in their recessed profiles and tarnished or corroded polished bore receptacles) a rotating brush, rotating polish mill and/or rotating jet washer may be better suited for cleaning and polishing such devices.

When producing zones deplete within a well, it is common practice to side-track the wells to other producible zones, if it is profitable to do so. The high cost of drilling rigs and the need to kill the well, so that tubular conduits can be removed and the well can be side-tracked, often prevent the side-tracks from occurring despite the presence of further producible zones, and the undeveloped zones are often left unrealized.

Embodiments of the present invention are also usable to reduce the cost of side-tracking a well, which can make previously marginal producible zones economical, given the lower cost of braided wire and slick wire applications.

Once economic production zones have been depleted at the end of a well's life, when it is least economic to invest money, the use of a high cost drilling rig is commonly necessary to remove heavy tubular conduits to enable placement of permanent cement plugs.

Embodiments of the present invention are further usable to reduce the cost of well abandonment, which can reduce the burden of abandonment and any related delays in abandonment of a particular well until sufficient work is available to perform an abandonment campaign, thus saving both time and expense.

In non-well applications, such as platform risers, pipelines or other large diameter conduits, few options exist for maintaining and/or intervening with conduits.

In instances where pigging of a conduit occurs within a riser or pipeline, embodiments of the present invention can be used in pigging operations to clean conduits or generally to intervene and/or maintain the conduits with rotary tools.

Alternatively, embodiments of the present invention can be pumped into deviated or horizontal wells, pipelines, risers or other large diameter conduits to perform rotary functions, then retrieved with an engaged wire line or by pumping a wire line engagement device to engage and retrieve the embodiments after performing the rotary function.

In pipelines, platform risers, well drilling operations, construction operations, intervention operations, maintenance operations and abandonment, where large diameter conduits are present, it is often critical to cut conduits down hole. Many different conventional apparatuses and methods exist for cutting conduits, including explosives, grit cutters, mechanical cutters and chemical cutters.

With the exception of grit cutters or various milling tools, conventional conduit cutters are not capable of cutting concentric and parallel conduits about the conduit in which they are disposed.

Additionally, while grit cutters or various milling tools are capable of cutting through multiple conduits, it is generally difficult to control the extent of a cut formed by a grit cutter or mill to confine the cut to a specific diameter with great accuracy.

Embodiments of the present invention, usable to cut conduits, can include low torque cutting apparatuses that cut concentric and parallel conduits to a selected diameter, while leaving surrounding conduits outside that diameter untouched so as to enable continued performance of the designed function of the conduits.

Within large conduit applications, such as those associated with wells and pipelines, inflatable sealing bridge plugs or packers are generally not capable of sealing across distances over twice the diameter through which they are placed, or are of insufficient sturdiness to withstand the sharp edges associated with milled and cut conduits.

Embodiments of the present invention can include a sealing rotating packer capable of sealing across distances over twice the placement diameter, and withstanding the sharp edges of milled and cut metals within a conduit surrounding the conduit through which the rotating packer was placed.

Electric line does not allow sufficient hoisting loads or jarring, and no conventional non-electrical braided wire or slick wire rotary cable tools exist. Thus, anchoring during conduit cutting and anchoring a rotating packer during use of non-electrical braided wire or slick wire is presently not possible. Embodiments of the present invention enable use of a rotary hanger that allows placement with any rotating shaft and removal with non-electrical braided wire or slick wire cables for supporting cutting apparatuses and rotating packer apparatuses.

Rotating hanger, rotating packer and conduit cutting embodiments can be driven using any shaft including, for example, shafts engaged to a fluid motor, combustion engine, pneumatic motor and/or electric motor.

A need exists for apparatuses and methods that remove the need for drilling rig and coiled tubing operations when performing routine conduit intervention and/or maintenance operations with rotating devices within well bores, platform risers, pipelines or other large bore conduits, thereby lowering the cost and reducing the complexity of such operations.

A need exists for apparatuses and methods that increase the hoisting capacity and jarring ability of braided and slick line operations and are usable to deploy rotary devices used during interventions and/or maintenance of well bores, platform risers, pipelines or other large bore conduits.

A need exists for apparatuses and methods for deploying wire line or cable tools in high pressure situations where grease heads do not offer sufficient sealing capacity against braided wires.

A need exists for apparatuses and methods that enable side-tracking of wells with casing drilling techniques in through tubing situations, with wire line operations capable of working within a pressured environment, removing the need to kill the well prior to side tracking, thereby reducing the cost and complexity of using coiled tubing for such side-tracks, thus increasing the life of a well where such lower cost apparatus and methods are capable of reaching trapped reserves.

A need exists for lower cost wire line rotating brushes, jetting and other associated conduit and equipment cleaning methods where conventional axially deployed brushes and chemical cleaning methods are incapable of effectively cleaning conduits and associated equipment.

A need exists for methods and apparatuses that provide improved cleaning of pipelines and risers that are not available through use of conventional pigging apparatuses and methods.

A need exists for apparatuses and methods that reduce the cost of well and pipeline abandonment.

A need exists for apparatuses and methods that enable pumping of rotating devices into deviated or horizontal wells, pipelines, risers or other large diameter conduits to perform rotary functions, and retrieval of the rotating devices with an engaged wire line or a wire line engagement device pumped into the conduit.

A need exists for apparatuses and methods usable to cut concentric and parallel conduits within a prescribed diameter within well bores, pipe lines, platform risers and other such large bore conduits.

A need exists for sealing bride plugs or packers that can expand to diameters over twice the inside diameter into which they are placed and withstand sharp metal edges associated with conduit milling and cutting operations.

A need exists for a hanger capable of setting, supporting rotation, supporting other apparatuses, and/or being jarred loose after it has served its function.

A need exists for rotating down-hole equipment to maintain and/or intervene in storage wells, casing drilling operations or any well operation where braided or slickline intervention is currently used or possible.

An object of the present invention is to overcome or alleviate at least some of the problems in the prior art or to address at least some of the above needs.

SUMMARY

In one aspect, the invention provides a method of sealing a subterranean borehole (114, 116, 122, 131, 134A, 134B) or conduit thereof, comprising a deployment conduit (61, 97, 98, 113, 127, 128, 129, 144, 167, 177), peripheral conduit (96) or a surrounding conduit (59, 99, 101, 103, 105, 145, 168), within or about which a cutting assembly (20, 21, 43) driven by a downhole motor or actuator (16, 17, 25, 30-34, 31A-33A, 32B, 35, 39, 43, 59, 64, 180) is lowered into the subterranean borehole or conduits thereof. One or more cuts (170, 170A, 170B, 170C) are made with the cutting assembly in one or more of said conduits thereof within a downhole cutting zone in said subterranean borehole to remove at least a portion of said conduit thereof from the downhole cutting zone to leave a space for sealing material, to weaken at least a portion of said conduits thereof, or combinations thereof, wherein higher and lower pressure ends of said subterranean borehole or conduits thereof are usable to form said actuator and space for the sealing material.

If necessary to form the space for the sealing material, a weakened portion of the conduit can be removed from the cutting zone via further cutting or an actuator formed by a packer sealed within the subterranean borehole of conduits thereof and moved therein from said higher to said lower pressure end to displace said weakened portion.

Subsequently, a settable sealing material can be deposited in said space through said subterranean borehole or conduits thereof and/or through an actuator engaged thereto and allowed to set.

In a related aspect, the invention provides a method of sealing a subterranean borehole in which a crushing assembly (18, 19) driven by a downhole motor or actuator (39, 64) is lowered into the borehole. Force applied from the crushing assembly (19) to a severed end of one or more conduits (98, 101, 103, 144, 145, 167, 168, 177) in the borehole is usable to axially displace the end to form a space for settable sealing material. Settable material can then be deposited in the space and allowed to set.

These methods enable an unobstructed space to be formed so that when sealing material, such as cement, is deposited in the space, no debris extends through the sealing material, which could form leakage paths.

In another aspect, the invention provides apparatus for performing sealing, displacing and/or cutting operations in a subterranean borehole or conduit thereof. The apparatus can include a cable engagable downhole assembly placeable and suspendable within, and retrievable from, the subterranean borehole or conduit thereof using the cable. The downhole assembly (16, 17, 24-25, 30-34, 31A-33A, 32B, 35, 43, 59, 180) can include at least one of: a rotary tool (18, 19, 22, 23, 180) coupled to one or more fluid motors (16, 17, 39), a rotary cutting tool (21, 24-25, 65, 161) coupled to a motor, or an axial cutting tool (20) coupled to a piston. The fluid motor, piston and/or actuator can have a fluid inlet (36, 42, 48, 147) and a fluid outlet (85, 179, 201, 202, 242) that communicate with high pressure and low pressure regions, respectively, using one or more associated seals (54, 68, 89, 182) against said at least one wall of the subterranean borehole or conduit thereof, such that the fluid motor, piston and/or actuator can be operated by differential fluid pressure within said borehole or conduit thereof.

Such apparatus is useful for carrying out methods in accordance with various embodiments, and has the advantage of providing substantial power downhole using lightweight apparatus. In particular a fluid motor and/or packer piston have the advantages that substantial power can be transmitted downhole by fluid injected into the subterranean borehole or conduits thereof from the surface.

In another aspect, the invention provides a method of using a subterranean borehole or conduit thereof in which a downhole assembly having at least one of: a rotary tool (18, 19, 21) coupled to a motor, a rotary tool (22, 23, 24, 161, 180) coupled to a fluid motor (39), or an axial cutting tool (20) coupled to a piston (64), is placed, suspended, or retrieved to, within, or from a subterranean borehole or conduit thereof using a cable. The tool is then actuated to perform a maintenance or intervention function within the subterranean borehole or conduit thereof.

The present invention relates, generally, to apparatuses, systems and methods usable in any single conduit (61 of FIGS. 4, 6, 8, 36, 44 and 54) or dual conduit (59 of FIGS. 4-7, 31-35, 55-59, 86 and 128) arrangement, particularly where circulation or injection of a fluid is possible, such as subterranean wells, platforms, pipelines, sewer conduits or other large diameter conduits.

Preferred embodiments of the present invention, generally, use braided and/or slick cable to place axially fixed and axially variable positive displacement fluid motors to drive rotary apparatuses, and/or conduit cutting apparatuses and/or circumferential conduit cutting apparatuses to perform maintenance and/or intervention on one or more concentric conduits of well bores, platform risers, pipelines or other large bore conduits.

Axially fixed motor assemblies (16 of FIGS. 4-5, 8-9, 32-34, 44, 54-59, 86, 96-100 and 128-135) or axially variable motor assemblies (43 of FIGS. 96 and 128) are usable to perform: large diameter conduit maintenance, large diameter conduit intervention, subterranean well maintenance, subterranean well side-tracks, storage well maintenance, axially deviated conduit maintenance, axial cutting of well conduits, engagement with well conduits using a rotary hanger, circumferential cutting of well conduits, milling of a well conduit and/or creating a conduit piston within a well to crush a conduits axially below.

The embodiments that include axially fixed and axially variable positive displacement fluid motors generally use a single motor assembly (16 of FIGS. 4-5, 8-9, 32-34, 44, 54-59, 86, 96-100 and 128-135) or multi-motor assembly (17 of FIG. 8) placed with a braided or slick wire cable within a conduit conveying fluid through the motor assembly to drive a positive displacement fluid motor or actuator (39 of FIGS. 4-5, 8-9, 32-34, 44, 54-59, 86, 96, 99-100 and 133-134).

Fluid flow is provided between a rotor and stator, with the higher and lower regions at the distal ends of said rotor and stator thus forming an actuator, with the stator being restrained from moving downward by a cable, and from rotating and/or moving axially through engagement with the conduit wall. The fluid urges nodal surfaces of the rotor causing it to rotate and subsequently providing torque to a rotary apparatus engaged to its end.

Embodiments of the axially fixed and axially variable motor assemblies can use an engagable flow diverter (36 of FIGS. 4, 8-11, 31-34, 36-39, 44, 54-57, 86, 96, 99, 115-116 and 133) thus forming an actuator with higher and lower pressure regions separated by its packer seals (54), which can include wire anchored flow diverter housings (51 of FIGS. 10-11) and kelly pass-through flow diverter housings (52 of FIGS. 115-116 and 133), with annular packer seals (54 of FIGS. 8-9, 12, 32-34, 44, 54-57, 86, 96, 99, 115-116, 128 and 133) to divert fluid flow within the bore of the conduit in which the motor assembly is disposed through the internal portion of the motor. The actuator motor is driven by pressured flow between a rotor (56 of FIGS. 18, 57-58, 126-127, and 133-134) and stator (57 of FIGS. 16, 57-58, 125, and 133-134), generally within a housing (58 of FIGS. 15, 57-58 and 133-134).

The housing and/or stator are, generally, engaged to the conduit within which they are disposed with motor anti-rotation devices (37 of FIGS. 4-5, 8-9, 31-34, 36-39, 44, 54-58, 86, 99-100 and 133-134) to provide a relatively fixed engagement against which pressurized fluid flowing between the stator and rotor can urge the rotor to rotate, thereby applying torque to devices engaged to its lower end.

Stators are generally restrained from rotation within a conduit by said motor anti-rotation devices, which allow axial movement along a conduit but prevent rotation around an axis.

In embodiments where cable is used to deploy motor assemblies, cable anti-rotation devices (38 of FIGS. 97, 102-104 and 130) can be used as a precaution to prevent twisting of the cable due to any intermittent rotational slippage of a motor assembly housing and/or stator.

Various apparatuses can be engaged to the lower end of the rotor, such as a universal rotating connection (53 of FIG. 8) engaged to a motor swivel (60 of FIG. 8), that is engaged to a subsequent motor assembly in a multi-motor assembly (17 of FIG. 8). A rotating connection can be used to rotate: conduit circumferential brushes (22 of FIGS. 4-5, 8 and 19), conduit brushes (23 of FIGS. 4-5, 8 and 20), conduit mills (24 of FIGS. 21, 96, 101, 128 and 135), casing drilling assemblies (25 of FIG. 22), rotary hangers (18 of FIGS. 32-35, 44-46, 54 and 86), screw packers (19 of FIGS. 34-35, 86, 87 and 95), rotary expandable casing placement devices (180 of FIG. 23), and conduit wheel cutters (21 of FIGS. 33, 54-59, 62-64, 74-75, 83 and 84-85), which include conduit geared wheel cutters (40 of FIGS. 56, 58-59, 62-64 and 83-84) and/or conduit cam wheel cutters (41 of FIGS. 74-75).

Use of braided or slick cable to place embodiments of apparatuses rotatable by circulating or injecting fluids through one or more positive displacement fluid motors allows embodiments of the present invention to be used to intervene and/or maintain conduits and apparatuses associated with well bores, platform risers, pipelines or other large diameter conduits.

Alternatively, geared wheel conduit cutters (40 of FIGS. 56, 58-59, 62-64 and 83-84) and cam wheel conduit cutters (41 of FIGS. 74-75 and 84-85) can be driven by any shaft, including combustion motor and electric motor driven shafts.

Embodiments incorporating use of conduit cutters are also usable with coiled tubing and electric wire line motors, that are prevalent in subterranean well operations.

Within subterranean wells using embodiments of the present invention, fluids may be circulated down a bore and returned through an annulus, or vice versa, to drive an actuator or positive displacement fluid motor, that is restrained and/or secured using cable to maintain and/or intervene with the apparatus within the subterranean wells.

Alternatively, if fluid is pumped through a single conduit by, for example, injecting into a permeable reservoir or fractured subterranean strata, the cable placeable actuator or positive displacement fluid motor embodiments of the present invention can be used to maintain and/or intervene within a well conduit.

Embodiments of the present invention can be usable for maintenance and/or intervention operations of a subterranean well (26) that include, without limitation: cleaning well conduits or apparatus with brushes, well side tracks (27 of FIG. 6), storage well maintenance (28 of FIG. 7), axially deviated well apparatus and conduit cleaning (29 of FIG. 8), cutting well conduits axially (30 of FIGS. 31 and 30A of FIG. 36), engagement of apparatus(es) with well conduits using a rotary hanger (18 of FIGS. 32 and 44), cutting of well conduits circumferentially (32 of FIGS. 33 and 54-59), milling of a well conduits (35 of FIG. 128), and creating a conduit piston using an embodiment for placement of a packer (33 of FIGS. 34 and 86) within a well to crush well conduits (34 of FIG. 35) axially below.

Embodiments usable for casing drilling can include snap-fitting connections, such as the snap-connected extending conduits (47 of FIG. 22) shown in the following description, to perform well side-tracks (27 of FIG. 6), and positive displacement fluid motors can be deployed using braided or slick cable to drill side-tracks, with cementing of the drilling assembly in place afterwards. The snap-fitting connections can be deployed through a lubricator in sections during placement of a casing drilling assembly, or during drilling, if the top of the assembly is retrieved and hung below the blow out preventers, while additional conduits are added through the lubricator.

Once drilling is complete, a rotary hanger (18 of FIG. 44) can be used to suspend the casing drilling assembly during cementing, after which the casing drilling assembly can be perforated to initiate production from, or to inject into, the side-tracked portion of the well.

If the casing drilling assembly becomes stuck or otherwise requires cutting during or after a side-track, embodiments of the present invention usable to cut conduits axially (30A of FIG. 36), cut conduits circumferentially (32A of FIGS. 54-59) or mill conduits (35 of FIG. 135) used.

To circumferentially cut a conduit, conduit wheel cutters can be used, such as conduit geared wheel cutters (40 of FIGS. 56, 58-59, 62-64 and 83-84) and conduit cam wheel cutters (41 of FIGS. 74-75 and 84-85).

The conduit wheel cutters (21 of FIGS. 32, 54-59, 62-64, 74-75, 83 and 84-85) can be driven by any shaft including combustion motor and electric motor driven shafts, or driven by axially fixed motor assemblies (16 of FIGS. 4-5, 8-9, 32-34, 44, 54-59, 86, 96-100 and 128-135) or axially variable motor assemblies (43 of FIGS. 96 and 128), usable with one or more embodiments of the present invention.

Geared wheel cutters can include geared wheel cutter assemblies (70 of FIG. 71), while cam wheel cutters can include cam wheel cutter assemblies (73 of FIGS. 80 and 74 of FIG. 81), that can be comprised of cuttings wheels with integral axles (65 of FIG. 42) or cutting wheels (65 of FIG. 72) with independent axles (69 of FIG. 73). The wheel cutter assemblies can be urged against the inside diameter of a conduit, in which they are disposed, by rotation of an associated housing either geared arrangements (77 of FIGS. 62-70, 82-83 and 84-85) or cam arrangements (75A, 75B, 75C of FIGS. 74-79).

Geared wheel cutters (40 of FIGS. 56, 58-59, 62-64 and 83-84) and cam wheel cutters (41 of FIGS. 74-75 and 84-85) can be used in combination with axial well cutters to shred conduits within a well bore to create space within the well bore for placement of apparatus or cement.

As the arm (78 of FIG. 71, FIGS. 80-81) length of various cutting wheel embodiments (70 of FIG. 71, 73 of FIGS. 80 and 74 of FIG. 81) can be varied to allow cutting of conduits and apparatus(es) within a diameter limit, inner concentric conduits and apparatus(es) within a plurality of conduits can be selectively cut by varying the length of the arms. Additionally, cutting surfaces (79 of FIGS. 84-85) placed on the arms (78 of FIG. 71) are usable to cut control lines, cables within conduits, and annular spaces surrounding conduits or debris caused from shredding conduits using both circumferential and axial cutters.

Axial conduit cutters (20 of FIGS. 31 and 36-39) can be used to axially cut a conduit (30 of FIG. 31) for circulation or to aid crushing a conduit to provide space for other apparatuses, or cement in the case of well abandonment.

In embodiments that include an axial conduit cutter (20 of FIGS. 31 and 36-39) suspended from a cable (6 of FIGS. 31 and 36), or engaged to the lower end of a hanger and packer, wherein upward force can be applied by fluid pumped through a conduit passing through a flow diverting housing (36 of FIGS. 37-39) to apply pressure limited by a pressure relief valve (48 of FIGS. 36-39) operating a piston (64 of FIGS. 39 and 43) with cams (67 of FIGS. 39 and 43) disposed within a housing (63 of FIGS. 38-41). Pressure applied through the flow diverter actuates the piston and associated cam to push axial wheel cutters (65 of FIG. 42) with an integral axle (69 of FIG. 42) or alternatively, wheel cutters with independent axles disposed with radial slots (66 of FIG. 41), to axially cut the conduit in which the cutter(s) are disposed by moving the cutter(s) upward via the cable and downward using pressure exerted on the diverter.

When embodiments of the present invention are used to perform operations in a particular sequence (30, 31, 32, 33 and 34 of FIGS. 31 to 35), such as incorporating use of axial conduit cutters (20 of FIGS. 31 and 36-39), rotary hangers (18 of FIGS. 32-35, 44-46, 54 and 86), conduit wheel cutters (21 of FIGS. 33, 54-59, 62-64, 74-75, 83 and 84-85) and screw packers (19 of FIGS. 34-35, 86, 87 and 95), the creation of space for placement of cement to permanently abandon a well can occur, removing the need to remove such conduits with a large hoisting capacity rig.

Embodiments usable for cement placement for abandoning a well or sealing a bore can include axially extendable conduits (44 of FIGS. 22-29), telescopically extending conduits (45 of FIGS. 24-26) and/or flexible wall extending conduits (46 of FIGS. 28-29) to place cement. Thereafter, differential pressure, between the inside of the extending conduits and the annulus within which the extending conduits are disposed, forming an actuator with higher and lower pressure regions caused by the mass difference between the cement and a displacement fluid, can be used against a one-way valve (48 of FIGS. 24-27) to retract the extending conduits from within the cemented conduit, creating a continuous cement plug within the inside diameter of the conduit to better meet abandonment regulations and/or industry practice for sealing cement placement.

In embodiments where conduits are cut and crushed by an actuator (30, 31, 32, 33 and 34 of FIGS. 31 to 35), cut axially (30A of FIG. 36) and/or cut circumferentially (32A of FIGS. 54-59) and allowed to fall and/or to be milled (35 of FIG. 135), a cement umbrella arrangement (49 of FIG. 30) can be placed through tubing axially above to support cement placement within the space created by cutting and crushing, allowing cut portions to fall and/or allowing milling of the conduit.

In other embodiments, a screw packer (19 of FIGS. 34-35, 86, 87 and 94) can be used to expand across a diameter, larger than the diameter through which it was placed, using gradated particles within a flexible membrane or fabric, such as Kevlar, to create a differential pressure seal across the inside diameter of the conduit within which it is disposed, thereby providing a barrier against which, for example, cement can be placed to permanently seal the bore of the conduit or the bore through subterranean strata.

Embodiments incorporating use of screw packers can include a shaft (90 of FIGS. 87-89 and 95) with a screw arrangement or other movable engagement (80 of FIGS. 87-90, 93 and 94-95) between the shaft and a lower screw collar or yoke (81 of FIGS. 87, 90, 93 and 94). Rotation of the shaft by any methods, including use of fluid motors, combustion motors, electric motors or pneumatic motors, causes an umbrella like expansion of a flexible membrane or fabric (89 of FIGS. 87 and 95) filled with gradated particles capable of forming a differential pressure seal, using a spider framework (86 of FIGS. 87, 90 and 94-95) from a collapsed arrangement (87 of FIGS. 87 and 90) to an expanded arrangement (88 of FIGS. 94-95).

Embodiments of a screw packer (19 of FIGS. 34-35, 86, 87 and 95) can include a one-way valve (48 of FIG. 89) to allow fluid and/or pressure from the high pressure regions below the screw packer to escape to the lower pressure region above, thus forming an actuator, to allow downward movement of the packer with applied pressure above when, for example, tubing below is being crushed (34 of FIG. 35).

While application of one or more embodiments described herein can have many uses within a subterranean well, usage of such embodiments, within any large diameter conduit where rotation of tools is desirable, can also be undertaken.

Within axially straight or axially deviated conduits of jackets or risers of an offshore platform, embodiments of the present invention can be used to clean (62 of FIG. 8), cut or rotate other tools within the conduits.

Within pipelines, sewer conduits or larger diameter plumbing, where the axial deviation of the conduit allows entry, embodiments of the present invention can be used to maintain or intervene in said conduits.

Axially deviated conduit cleaning (29 of FIG. 8), cutting and other maintenance and/or intervention operations involving rotating apparatus are also possible within large diameter conduits, such as pipelines and sewer pipes.

Within large diameter conduits, fluid flow, to drive the actuator or positive displacement fluid motors usable within embodiments of the present invention, generally occurs by pumping fluid into one end of the conduit and discharging the fluid from the other.

It is therefore possible within some large diameter conduit applications, such as pipelines and sewer conduits, to place a motor assembly, by using a cable or other methods, for allowing the flow of fluid from one end of the conduit to be used to, both, drive the positive displacement fluid motor and to push the motor assembly through the larger diameter conduit. Pushing apparatus(es) through the bore of a long conduit is often referred to as "pigging."

In cases where cleaning is desired, such as when wax has accumulated within a pipeline or growth has occurred within a sewer conduit, embodiments of the present invention can include using one or more motors in a pigging operation to clean such build-up, within the inside diameter of a large conduit. As rotating the rotor of a positive displacement fluid motor requires both rotational and axial restraint of the stator, embodiments of the present invention can form a pig placed within the large conduit, where axial movement, or pigging through the pipeline can progress to a point where a reduced internal diameter constrains the stator, causing the rotor to function, thereby turning cleaning apparatus(es) engaged to the end of the rotor until the constrained internal diameter is expanded to allow passage of the cleaning assembly. Progression from the insertion point to the extraction point can clean the large conduit between the insertion and extraction points, thereby intervening in and/or maintaining the pipeline by removing restrictions in its internal diameter.

Retrieval of a pigging motor assembly released at one end of a conduit or pipeline can be accomplished by the pumping of a wet connection to the motor assembly caught in a pig catcher, while a downhole connection is provided at the appropriate end of the motor assembly. When a motor assembly is released within a horizontal portion of a subterranean well, a wet connection can also be pumped downhole to establish a cable connection with the motor assembly.

Embodiments of the present invention can use any manner of connector (50, 50A and/or 50B of FIGS. 8-11, 17-24, 30, 32-35, 37-39, 45-47, 49, 56, 62-65, 74-76, 83, 84-95, 97-98, 102-104, 113-114, 119-121, 123-124, 126, 129, 131-132 and 135), between component parts or subassemblies, such as screwed connections, snap-together connections, pin connections, keyed connections, friction connections, welded connections, swivel connections and/or knuckle joint connections.

Any braided wire or slick wire apparatus normally used in such deployments, such as weight bars, stem, knuckle joints, jars, swivels and/or rope sockets can be used with embodiments of the present invention.

BRIEF DESCRIPTION OF THE DRAWINGS

Preferred embodiments of the invention are described below by way of example only, with reference to the accompanying drawings, in which:

FIGS. 4 to 8 depict embodiments of the present invention in which a fluid motor is used within conduits.

FIG. 9 depicts a fluid driven motor usable with embodiments of the present invention.

FIGS. 10 to 18 illustrate component parts of the fluid driven motor of FIG. 9.

FIGS. 102 to 104 illustrate a cable anti-rotation apparatus usable with the motor assembly of FIG. 96.

FIGS. 105 to 110 depict component parts of the cable anti-rotation apparatus of FIGS. 102 to 104.

FIGS. 111 and 112 illustrate anti-rotation wheel component parts usable with anti-rotational apparatus.

FIGS. 129 to 135 are details views of the motor assembly of FIG. 128.

Embodiments of the present invention are described below with reference to the listed Figures.

DETAILED DESCRIPTION OF THE EMBODIMENTS

Before explaining selected embodiments of the present invention in detail, it is to be understood that the present invention is not limited to the particular embodiments described herein and that the present invention can be practiced or carried out in various ways.

Figure 1:
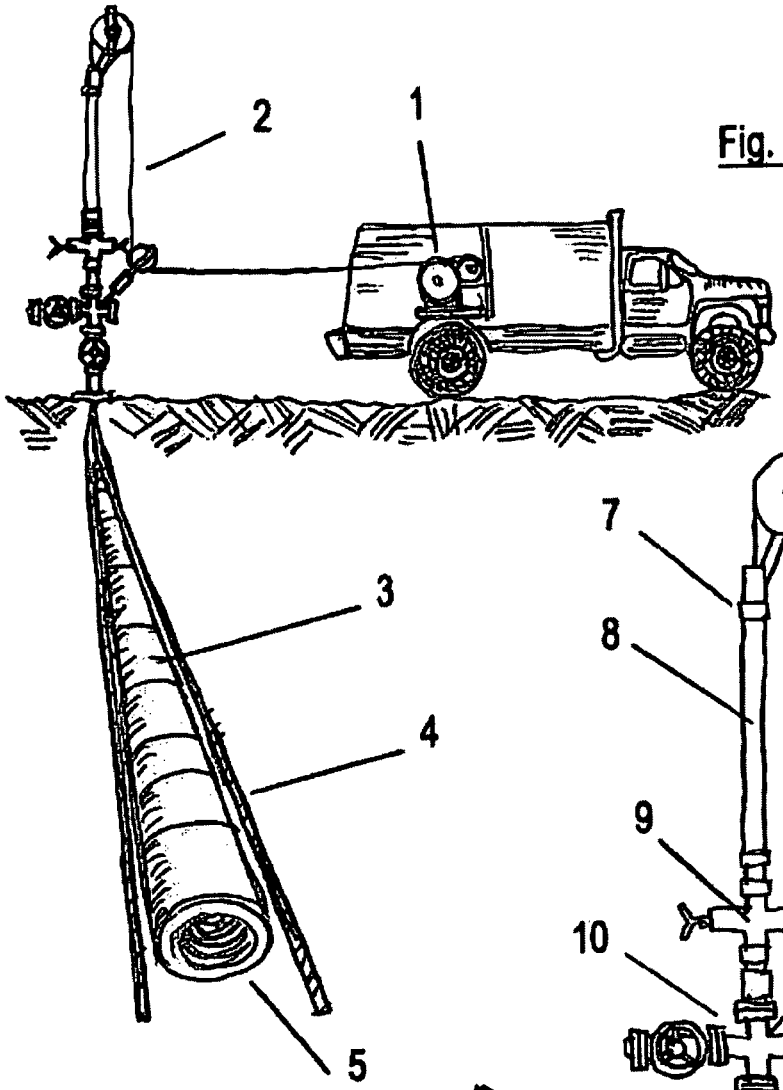
Fig. 1 Prior Art
FIGS. 1 and 2 depict prior art wire line and slick line arrangements.

Referring now to FIG. 1, an onshore application is depicted, in which a prior art truck is shown carrying a cable or wire line winch unit (1), with the cable or wire line passing through sheaves and apparatus of a lubricator arrangement (2) secured to a tool string (3) within a conduit (4) representing a subterranean well or pipeline. Downhole apparatus described herein, may be engaged with any wire line connection (5), including without limitation the type of wire line connection shown in FIG. 1.

Figure 3:
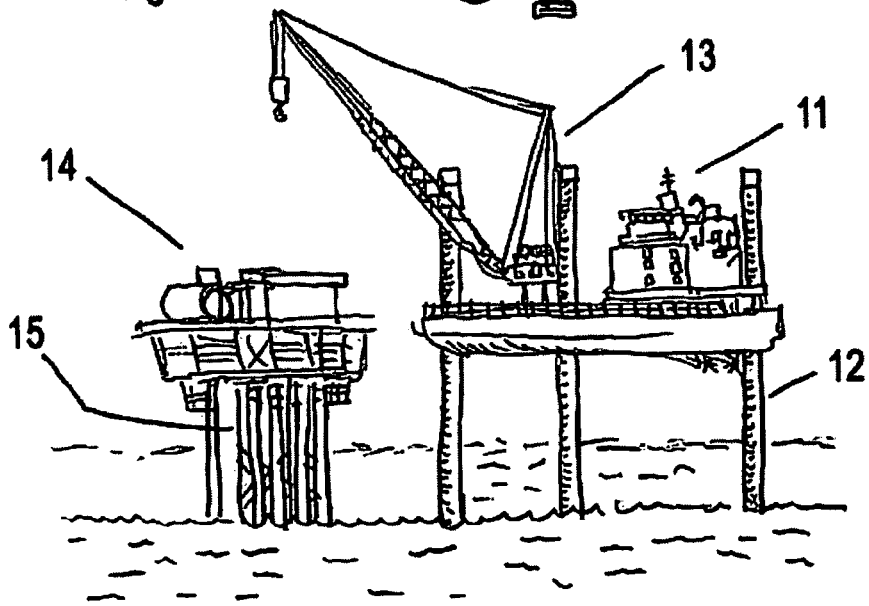
Fig. 3 Prior Art
FIG. 3 illustrates a prior art offshore jack-up rig and offshore platform.

Apparatus and methods disclosed herein, can be used in onshore applications, such as that shown in FIG. 1, or offshore applications such as that shown in FIG. 3.

Figure 2:
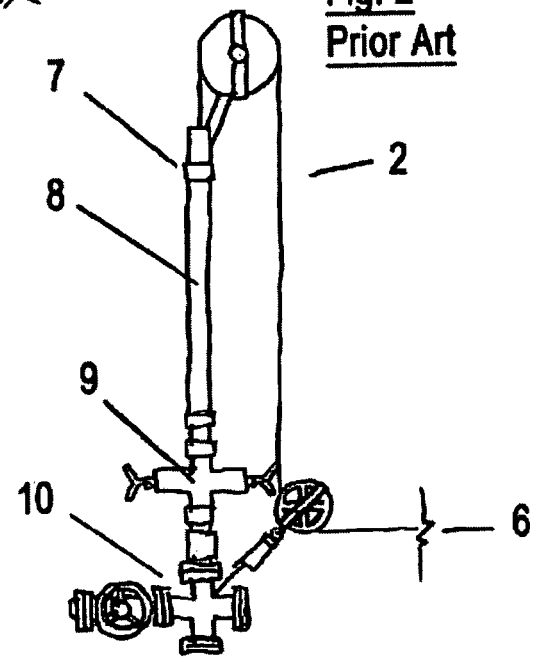
Fig. 2 Prior Art

FIG. 2 depicts an elevation view illustrating a known lubricator arrangement with a wire (6) engaged to a small hoisting unit (not shown), which can be similar to the previously described winch (1 of FIG. 1). The wire is shown passing through sheaves until it reaches a stuffing box connection (7) at the upper end of a lubricator tube (8), where it is secured to the upper end of a blow out preventer unit (9) and to the upper end of a valve tree (10), engaged with a wellhead.

This small hoisting capacity rig arrangement allows disconnection of the lubricator (8) with light conventional wireline tools and/or downhole assemblies disclosed herein placed within the lubricator, while the blow out preventers (9) and valve tree (10) isolate the well, after which the lubricator can be reconnected and the preventers and valve tree can be opened to allow passage of the tools to and from the well in a pressure controlled manner. The stuffing box (7) prevents leakage around the wire (6) or cable passing through a lubricator arrangement (2), which can be used for hoisting tools within conduits of the well with a light hoisting capacity unit (1). Thereafter, the tools can be retracted into the lubricator, closing the preventers and valve tree to control the well, while disengaging the tools from the wire and removing them from the lubricator.

A small hoisting capacity rig arrangement, such as that shown in FIG. 2, can be used to deploy rotary devices with preferred embodiments of axially fixed motor assemblies (16 of FIGS. 4-5, 8-9, 32-34, 44, 54-59, 86, 96-100 and 128-135) or axially variable motor assemblies (43 of FIGS. 96 and 128), usable to intervene and maintain conduits and associated equipment of well, pipelines, risers and other large bore conduits.

FIG. 3, depicts an elevation view showing a prior art jack-up boat (11) supported by legs (12) that extend from the boat's hull to the sea floor. The jack up boat includes a crane (13) for placing apparatuses usable to operate offshore wire line equipment on offshore facilities (14), supported by a jacket (15) that extends from the top-side facilities to the sea floor.

Due to limited space on offshore facilities (14) and required resources in an offshore environment, a drilling rig or the depicted jack-up boat is required for coiled tubing operations, whereas wireline operations can be carried out from a boat if lifting and personnel transfer systems are available on the offshore facilities.

Using apparatus and methods disclosed herein, both onshore and offshore rotary cable tool operations can be conducted without the need for a drilling rig or coiled tubing arrangement.

Referring now to FIGS. 4 to 7, diagrammatic axial cross sectional views of a subterranean hydrocarbon production wells (26, 27, 28) are shown. FIG. 5 depicts a detail view associated with line A of FIG. 4, showing a lubricator arrangement (2) at the upper end of the well. FIGS. 6 and 7 depict alternative down hole environments involving side-tracks (27 of FIG. 6) and a salt cavern with a flow diverting string installed (28 of FIG. 7), placeable below the break line in FIG. 4 to represent alternative well arrangements. FIGS. 4 and 6 depict a dual conduit arrangement (59) above the production packer (113) where the sliding side door (127) may be opened or the inner conduit (98) perforated to provide access to the surrounding annulus (100) for circulation to drive a fluid motor and single conduit arrangements (61) below said production packer, where circulation within the annuli is not possible and injection into the production perforations (132) or reservoir (131) is used to drive a fluid motor.

FIG. 4 depicts a diagrammatic axial cross sectional view, showing a lubricator arrangement (2) on a valve tree (10) with: a swab valve (91), a hydraulic wing valve (92) leading to a production flow line (93) with a hydraulic master valve (94), and manual master valve (95) with a control line (96) communicating with a down hole safety valve (97).

The control line (96) connected to the down hole safety valve (DHSV) (97) can be secured to the production tubing (98) with control line clamps (99).

Below the valve tree, an annular space (100) is shown between the production tubing (98) and the production casing (101) referred to as the A-annulus. An annular space (102) can also exist between the production casing (101) and the intermediate casing (103), called the B-annulus. A further annular space (104) can exist between the intermediate casing and the conductor casing (105), called the C-annulus.

The A-annulus (100) can be accessed through the tubing hanger wellhead spool passageway (107), controlled by a valve (108) of the wellhead arrangement (106), and can be sealed at its lower end by a production packer (113). Many subterranean wells use sliding side doors (127) during completion operations to circulate fluids through the production tubing (98) after setting the production packer (113).

To operate positive fluid motors and/or positive displacement fluid motors (39 of FIGS. 4-5, 8-9, 32-34, 44, 54-59, 86, 96, 99-100 and 133-134) an injection or circulation path can be established. Generally, a circulation path can be established within a well by: injecting down the tubing (98) into a permeable strata layer; opening a sliding side door (127) or perforating the tubing (98); and circulating down the tubing crossing over at the sliding side door or perforation and up the A-annulus (100) through a passageway (107) in the wellhead (106).

As shown, a fluid motor (16) can be placed in a controlled pressure manner and through the lubricator arrangement (2) to, for example, clean scale from the inside of the production tubing (98) using rotary brushes (22 and 23 of FIG. 5). The fluid motor can be placed within the tubing with a cable or wire (6 of FIG. 5), opening a sliding side door (127) at the lower end of the production tubing and circulating a fluid axially down the tubing and up the A-annular space (100), and taking return flow through a valve (108) and passageway (107) of the wellhead (106) to drive the fluid motor (39 of FIG. 5), thereby rotating the brushes to clean scale from the inside diameter of said tubing.

To dissolve scale and to prevent deposition in the A-annuls or choking of the sliding side door (127), the circulated fluid used to operate the fluid motor (39 of FIG. 5) would generally contain chemicals to dissolve scale, and could be disposed through a nearby injection well or an injection well stemming from a junction of wells.

To prevent scale and other debris from entering the reservoirs (117 and 118) a plug can be placed in a nipple (128), generally placed below the production packer (113).

To allow embodiments of the present invention to pass through reduced diameters within a conduit, such as a conduit having a nipple (128) with an internal diameter smaller than the internal diameter of the production tubing (98), anti-rotation devices (37 of FIG. 5) can be of retractable and expandable construction as later illustrated in FIGS. 13-14 and FIGS. 102-111.

In many wells, a liner casing (129) can be cemented (130) below the production packer (113) across lower subterranean strata (119, 120 and 121) and the reservoirs (117 and 118), such that production can occur through open hole (131) or perforations (132) in the liner and liner cement.

Alternatively, if injection into the permeable reservoirs (117 and/or 118) is acceptable, fluid needed to drive the fluid motor could be pumped down the tubing (98) and injected into the permeable reservoir. For abandonment operations, such as when production from the reservoir is no longer economically viable, injection can be preferred to prevent handling contaminated fluids at the surface.

For abandonment operations, pathways can be opened between the tubing bore and annuli to facilitate circulation to drive a fluid motor and to create space using rotary tools, to ultimately isolate the A, B and C annuli with cement from permeable subterranean layers, such as the water table and surface, without requiring removal of conduits from the well, as later illustrated in FIG. 30, FIGS. 31-35, FIGS. 54-59 and FIG. 128.

The B-annulus (102) can be accessed through a production casing spool passageway (109) controlled by a valve (110) of the wellhead arrangement (106), and open to a bore (114) through the intermediate subterranean strata (119) at is lower end, with the bore (114) isolated from a second bore (116) through producing zones (117 and 118) by cement (115) between the production casing (101) and the second bore (116).

The C-annulus (104) can be accessed through an intermediate casing spool passageway (111) controlled by a valve (112) of the wellhead arrangement (106), and open to the bore (122) through upper subterranean strata (123) at its lower end, with the bore (122) isolated from the bore (114) through intermediate subterranean strata (119) by cement (124). The C-Annulus's lower end is isolated from surface by cement (125) placed between the conductor (105) and the initial bore (126) through upper strata (123).

The subsurface or down hole safety valve or DHSV (97) is shown contained within the A-annulus (100) and controlled by the DHSV control line (96) passing through the valve tree (10), and can be engaged to the production tubing (98) with control line clamps (99).

For abandonment operations, the control line (96), which is shown secured with clamps (99) to the production tubing (98), is a serious concern because the passageway of the control line represents a potential leak path unless removed prior to placing a cement plug within the A-annulus.

At the end of the useful life of a subterranean well, it is common practice to remove apparatus and restore the subterranean barriers pierced by constructing the well.

The primary methods for forming subterranean barriers include use of a drilling rig to remove tubular apparatus and place cement plugs within the well bore to replace strata removed during boring. Casings are generally left in place, with a plurality of cement barriers having a length exceeding 30 meters (100 feet) placed within the bores and casings.

While lower specification and less expensive abandonment units could be built, abandonment is generally too infrequent to justify full utilization of such a rig onshore, and in an offshore environment, the structure required to support the hoisting equipment represents the majority of the cost of such a vessel.

Expensive, high specification drilling units therefore continue to be used for abandonment, especially in an offshore environment.

Where possible, conventional rig-less abandonment methods are used; however, such conventional methods leave tubular well components below the subterranean surface, and use the tubular components to place cement, thus leaving the components and tubing within the final cement plugs. This incurs additional risk of leakage since it is very difficult to clean the cemented annulus behind tubing that is left in place.

Conventional rig-less abandonments, generally, do not include a method of removing the potential leak paths caused by the control line (96), secured to the down hole safety valve (97) and production tubing (98) with control line clamps (99).

Cement placed around these down-hole well components has a much higher probability of leaking than cement placed when the components are removed. Generally, if these components must be removed from the subterranean well to effectively isolate the well from the environment, an expensive drilling rig is needed for its hoisting and rotational abilities.

Apparatus and methods disclosed herein, are capable of cutting and crushing or milling the production tubing (98) and control line (96) between couplings and control line clamps (99), allowing the couplings and clamps to be pushed or to fall downward to create an unobstructed space with the production casing (101), enabling placement of cement plugs and effectively restoring the subterranean strata barrier where competent cement (115) surrounds the production casing.

Where no competent cement (115) exists between the production casing (101) and the bore (114) through the intermediate subterranean strata (119) or between the production casing (101) and the intermediate casing (103), cutting apparatus usable with embodiments of the present invention can cut through both the production tubing (98) and the production casing (101) to reach the B-annulus for placement of a cement plug.

Embodiments of the present invention, such as those described in FIG. 30, FIGS. 31-35, FIGS. 54-59 and FIG. 128, can be used to cut, cut and crush or mill tubing and casing, thereby forcing and/or allowing debris to fall into the lower annuli of a well until sufficient space is created for placing unobstructed cement abandonment barriers. A rig-less abandonment method is thereby provided that removes the need for expensive and complex drilling rig or coiled tubing operations to achieve the same level of differential pressure integrity obtained through conventional abandonment method while providing a cost savings.

FIG. 6 depicts a diagrammatic axial cross sectional view of an alternate embodiment that can replace the lower portion (59) of FIG. 4 below the break line. Specifically an embodiment of the invention used with well side-tracking (27) is shown.

An upper well side track (134A) exits the production tubing (98), production casing (101) and intermediate casing (103), and extends through the intermediate strata (119). The upper side track (135) is usable, for example, to create an injection disposal well by fracturing said strata and injecting slurry.

Return fluid circulation from the lower end of fluid motor assembly sidetrack (134A) or well abandonment (31-34 of FIGS. 31-35 respectively) embodiments can travel upward through the production annulus (100) between the production tubing (98) and production casing (101) and exiting the outlet (107 of FIG. 4) through a valve (108 of FIG. 4) of the wellhead (106 of FIG. 4). Return fluid can also be flowed through the annulus between said production casing and the intermediate casing (101) and exit the outlet (109 of FIG. 4) through valve (110 of FIG. 4) of the wellhead, and/or through the annulus between the intermediate casing and the conductor (103), exiting the outlet (111 of FIG. 4) through valve (112 of FIG. 4) of the wellhead.

Alternatively, a lower well side-track (134B) is shown exiting an un-perforated liner casing (129A) using a whipstock (133), through the liner cement (130A) and the strata (123) to a reservoir (117A) that is trapped behind the cemented liner.

A motor assembly (16) can be lowered on a cable (6 of FIGS. 2 and 5) within the production tubing (98) where the flow diverter (36) seals (54 of FIG. 12) against the production tubing to divert flow through the fluid motor of the motor assembly. The motor assembly can be anchored to the production tubing with anti-rotation (37) devices, such that fluid flow drives the motor and associated rotary connection (50) to drive a lower end drilling assembly with a bit (161), deflected by a whipstock (133), to bore through the liner (129), cement (130) and overburden (119) to the trapped reservoir (117A). After actuating of the lower end drilling assembly, the drilling assembly can be cemented in place as a casing drilling assembly and perforated, or the assembly can removed and a different casing can be placed between the reservoir and bore. Alternatively, the bore can be left open for production. Embodiments of the present invention may thus be used to perform through tubing drilling operations.

Return flow of fluid once it has exited the lower end bit of the motor assembly, forming a slurry, can be taken through the sliding side door (127), perforations or other passageway through the production tubing (98) and upward through the production annulus (100) between the production tubing and production casing (101). If the whipstock (133) has an internal passageway communicating with lower strata (118, 120, 121), the strata can be fractured, and the drilling fluid slurry associated with drilling can be injected into the strata rather than flowed axially upward through one of the annuli of the well.

FIG. 7 depicts a diagrammatic axial cross sectional view showing an alternative variant that can replace the lower portion (59) of FIG. 4 below the break line. Specifically, FIG. 7 depicts a storage cavern well (28).

A cavern space (135A) within cavern walls (135B) is formed in a salt deposit (143) by a flow diverting string (136), in which an upper lateral opening (138) in an upper chamber junction (141) closed by an isolation conduit (138A) and a lower lateral opening (140) in a lower chamber junction (142) provide a passageway between the inner bore of the flow diverting string and the cavern space.

A concentric conduit flow crossover (139) provides access between the inner bore of the flow diverting string (136) and the annular passageway between the inner (144) and outer (145) conduit strings, anchored (146) to the lower end of the cavern space (135).

Various embodiments of the present invention can be used within a storage well to, for example, clean a fouled flow crossover (139) with a rotary jetting brush (23) engaged to the lower end of a motor assembly (16), with motor anti-rotation devices engaged to the inner conduit string (144), and a flow diverter (36) diverting fluid pumped down the inner conduit to actuate a fluid motor and rotate the jetting brush. To aid cleaning, return flow from the fluid motor is taken through the flow crossover (139) and outer annular passageway between the inner leaching string (144) and outer leaching string (145) of the flow diverting string (136).

Embodiments of the present invention can also use anti-rotational devices (37) of a retractable and expandable construction to allow passage of the motor assembly through a reduced internal diameter of the inner conduit string (144) to, for example, reach the lower end of (146) of a flow diverting string (136) that has become choked with insoluble material from leaching of a salt cavern (135A). A cleaning or boring assembly is usable to remove insoluble material from the inner conduits passageway, with fluid flow passing through a perforated joint at the lower end (146) or through the lateral opening (140), with low pressures of fluid compression within the large volume of the cavern allowing repeated flow into the cavern space (135A). Repeated bleed-off of trapped cavern pressure can be performed until rotary boring and cleaning are complete.

Other exemplary uses of various embodiments of the present invention within a storage cavern include, without limitation: the creation of additional lateral openings within the flow diverting string (136) by boring through the inner conduit string (144) and outer conduit string (145), placing expandable casing across perforations through the inner conduit string (144) and/or outer conduit string (145), and milling of the internal conduit (144) and placement of a packer across the internal diameter of the outer conduit (145).

Figures 8, 9, 10, 11, 12, 13, 14, 15, 16, 17, 18:
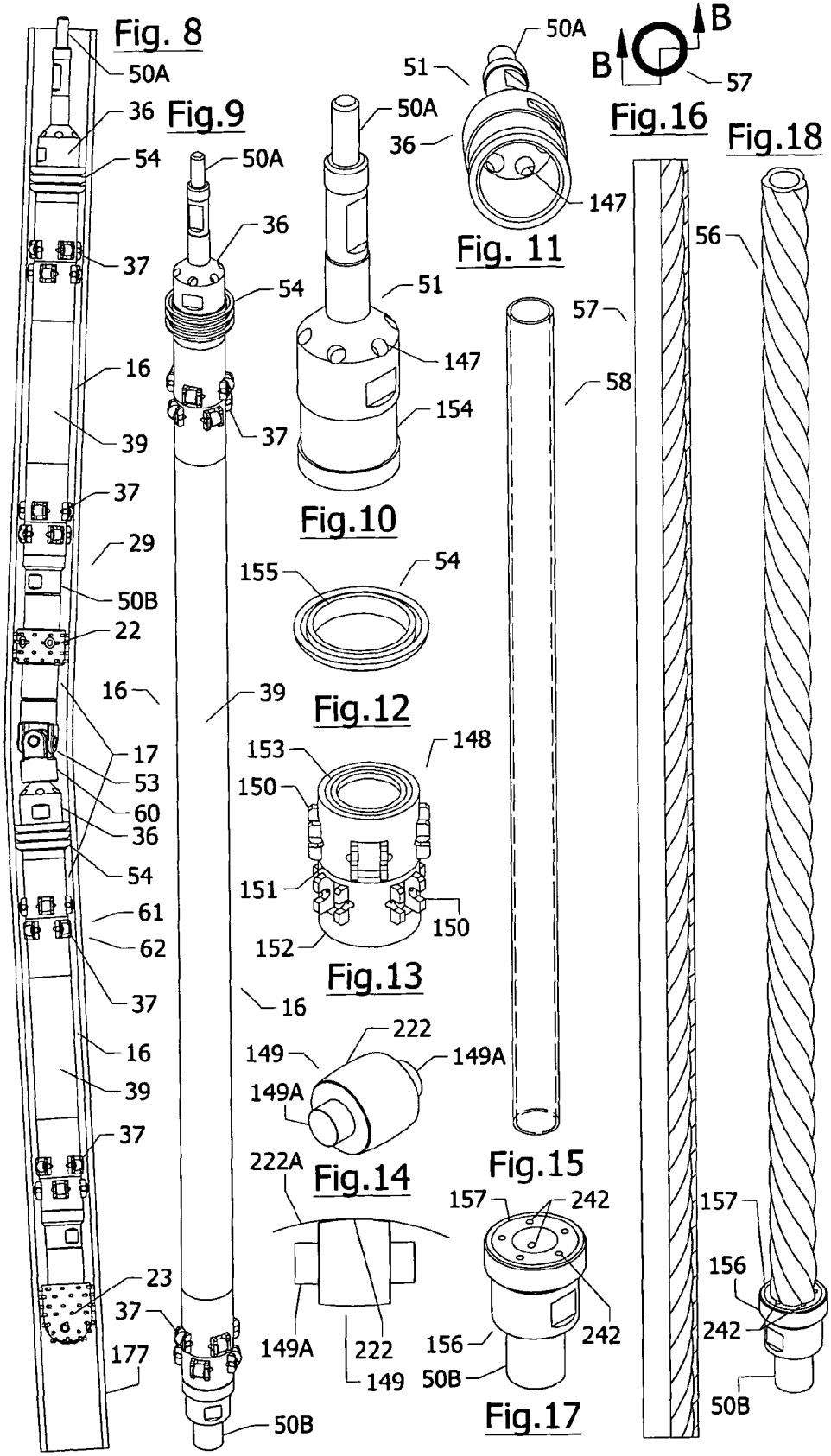

Referring now to FIGS. 8 and 9, motor assemblies (16) having an upper connector (50A), and a flow diverter (36) housing with seals (54) for preventing flow between the motor assemblies and the conduit in which they are disposed, are shown engaged above motor anti-rotation apparatus (37) at upper and lower ends of a positive displacement fluid motor (39), which drives a lower connection (50B) for engagement with a rotating device, which FIG. 8 depicts as conduit brushes (22 and 23).

FIG. 8 shows an elevation view of a deviated conduit (29), in which a fluid driven multi-motor is shown cleaning the conduit (177).

Wireline can be engaged with a connector (50A) at the upper end of the depicted multi-motor assembly (17), which includes an upper motor assembly (16) engaged via a connector, shown as a universal joint (53), to a lower motor (16). A circumferential brush (22) is driven by the upper motor assembly, and a conduit cleaning brush (23) is driven by the lower motor assembly to clean the inside of the conduit.

FIG. 9 depicts an isometric view of a fluid motor assembly (16) associated with the upper motor assembly of FIG. 8, the component parts of the fluid motor assembly (16) being shown in FIGS. 10-18. The fluid motor assembly is shown as a fixed axis motor in which axial movement of the entire assembly can axially move rotating devices engaged to the lower end connector (50B). This axial movement is not necessary for embodiments including axially variable motor assemblies (43 of FIGS. 96 and 128), described below.

Referring now to FIGS. 10 and 11, isometric views of a flow diverter housing (51), are shown, the flow diverter hosing being part of the fixed motor assembly (16) of FIG. 9. The flow diverter housing can be combined with a seal (54 of FIG. 12) to form a flow diverter (36 of FIG. 9).

Orifices (147) in the wall of the housing (51) divert circulated fluid to the internal passageway and to the lower end of the housing.

FIG. 12 depicts an isometric view of a seal (54) for a flow diverter housing (51 of FIGS. 10-11), which can be combined with the housing to form a flow diverter (36 of FIG. 9). A securing surface (155) engages with an associated surface (154 of FIG. 10) to anchor the seals to the housing.

FIG. 13 depicts an isometric view of a motor anti-rotation wheel housing (148) for a positive displacement fluid motor (39 of FIG. 9), which can be combined with rollers (149 of FIG. 14) to form a motor anti-rotation apparatus (37 of FIG. 9). The diagram of FIG. 13 depicts the upper motor anti-rotation apparatus of FIG. 9, which could also function inverted as a lower motor anti-rotation apparatus. A lower motor anti-rotation apparatus can also include a securing connection (152) at is upper end and a bearing race (153) at is lower end.

The anti-rotation wheel housing (148) can have multiple engaged (151) aligned or circumferentially offset parts with engagements (150) for rollers (149 of FIG. 14), in which an end engagement (152) can be secured to a stator housing (58 of FIG. 15) or stator (57 of FIG. 16).

The engagements (151) can be of a securing nature or can include bearings and races, allowing independent slippage due to friction and weight applied against the housing. For example, when bearings are disposed between a bearing race (153) on the housing and a race (157 of FIG. 17) on the rotary connection (156 of FIG. 17) secured to the bottom of the rotor (56 and 156 of FIG. 18), the bearings increase the ability to restrain the stator (57 of FIG. 16) by further separating it from friction of a rotating rotor When the anti-rotation housing (148) is used at the upper end of the motor housing (58 of FIG. 15), the engagement at the top of the motor anti-rotation apparatus can also have bearings and races (153) to prevent cable rotation if the anti-rotation apparatus intermittently slips during operation or moves axially while torque is applied by an operating fluid motor assembly.

Passage of anti-rotation devices through the reduced internal diameters of apparatus within conduits, such as a nipple (128 of FIG. 4) within a subterranean well, may be required to perform work below the internal diameter reductions. Anti-rotation devices can therefore be of a retractable and expandable nature. For example, such anti-rotation devices can include a recess for a spring (159 of FIG. 105) with a push rod (160 of FIG. 105) placed within the anti-rotation housing (148) to allow axles (149A of FIG. 14) to retract inward as rollers (149 of FIG. 14) are urged inward as they pass through a reduced internal diameter when moved along an axis of a conduit axis. The anti-rotation devices can then expand once past the internal diameter restriction to provide resistance to rotation around the axis of the conduit.

FIG. 14 depicts an upper isometric view and lower elevation view of an anti-rotation roller (149) associated with FIGS. 9 and 13, usable with a motor anti-rotation apparatus (148 of FIG. 13), which can be combined with a housing to form a motor anti-rotation device (37 of FIG. 9). The curvature (222) of the rolling surface of the roller can be selected to match the curvature of the circumference (222A) of the conduit within which it is disposed when engaged to the associated housing (148 of FIG. 13). In this manner, the roller will axially rotate when the housing is moved axially, but will resist sliding along the circumference (222A) of the conduit in which it is disposed. A plurality of rollers can be engaged to the anti-rotation housing (148 of FIG. 13) in such a manner to resist rotation of the housing about its axis. A plurality of rollers (149) along the axis of the anti-rotation housing (148 of FIG. 13) provides slippage of the portion of the housing adjacent to other rotating devices, facilitated by bearings and a race (153 of FIG. 13).

To facilitate axial passage through reduced internal diameters of a conduit, rollers (149) can also be pushed outward by springs (158 of FIG. 110) to urge a shaft (159 of FIG. 109) having a curvature (160) associated with the axle (149A) of the roller (149) in a manner similar to that shown in FIG. 105. The spring and shaft can be disposed in the anti-rotation housing (148 of FIG. 13), and can urge the axle (149A) and associated roller (149) outward to engage the curvature (222) of the roller toward the circumference (222A) of the conduit in which it is disposed to further resist slippage of the roller along the circumference of the conduit.

FIG. 15 depicts an isometric view, with dashed lines showing hidden surfaces, of a stator housing (58) for a stator (57 of FIG. 16) that can be combined with a rotor (56 of FIG. 18) to form a positive displacement fluid motor (16 of FIG. 9).

FIG. 16 shows an upper plan view and lower cross sectional elevation view along line B-B depicting a stator (57) for placement within a stator housing (58 of FIG. 15). When combined with a rotor (56 of FIG. 18), the rotor and stator form a positive displacement fluid motor (16 of FIG. 9).

The stator (57) and stator housing (58 of FIG. 15) are secured to the non-rotating end (152 of FIG. 13) of a motor anti-rotation housing (148 of FIG. 13), which inhibits the stator and associated stator housing from rotating around their axis.

The inside helically curved surfaces of the stator (57) can be associated with helically curved surfaces of the rotor (56 of FIG. 18), such that when fluid is pumped between the stator and the rotor, the rotor tends to rotate through positive displacement of the fluid, provided the stator is anchored against axial rotation.

FIG. 17 depicts an isometric view of a rotating rotor connection (156), which is shown secured to the rotor in FIG. 18 to form a positive displacement fluid motor (39 of FIG. 9) with a connection (50B) for a rotating device at it's lower end and a bearing race (157) for engagement to bearings and the lower end of a stator housing (58 of FIG. 15) and/or stator (57 of FIG. 16).

Flow orifices (242) at the ends of passageways from the upper end to the circumference of the internal passageway, allow flow from between the stator (57 of FIG. 16) and rotor (56 of FIG. 18) to enter the internal passageway of the rotating rotor connection (156) engaged to the lower end of the rotor (56 of FIG. 18).

FIG. 18 depicts an isometric view of a rotor (56) for insertion and rotation within a stator (57 of FIG. 16), that is shown with a rotor connection (156) for engagement with a rotating device at its lower end.

The orifices (147 of FIGS. 10-11) of the fluid inlet of the flow diverter (36 of FIGS. 9-11) transmit high pressure into the space between the rotor (56 of FIG. 18) and stator (57 of FIG. 16) to exit the space at a lower pressure, thus forming an actuator, due to the pressure loss associated with rotating the rotor entering passageways (242) within the rotating rotor connection (156) to commingle with the internal bore of the rotating rotor connection. The lower pressure can exit the lower end of the rotor to actuate a rotary tool, such as a brush with jets (22 and 23 of FIGS. 19 and 20 respectively) or drill bit (161 of FIG. 22).

Figures 19, 20, 21, 22, 23, 24, 25, 26, 27, 28, 29, 30:
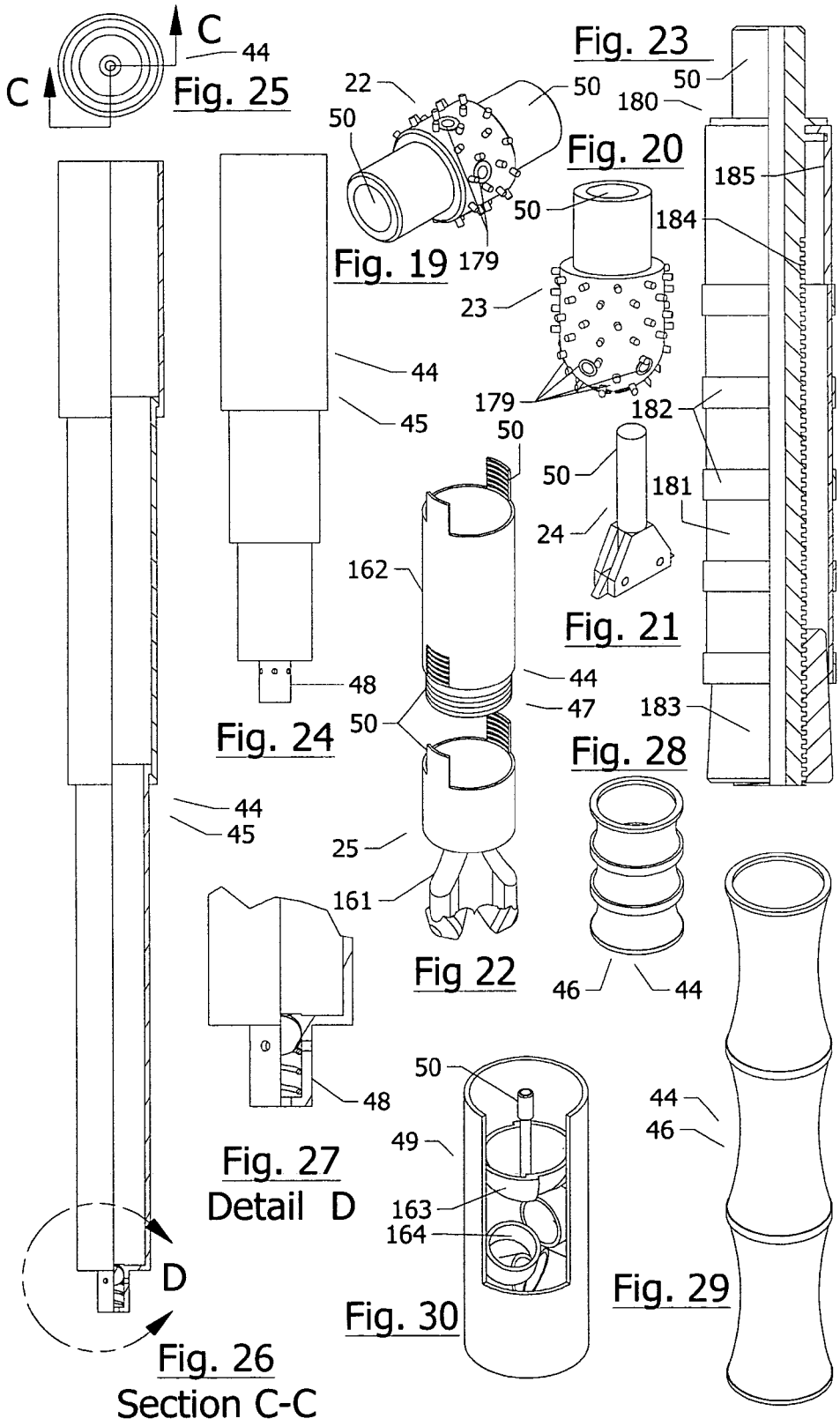
FIGS. 19 to 22 illustrate various apparatuses that can be connected to a fluid driven motor usable with embodiments of the present invention.
FIG. 23 depicts a rotary expandable casing engagable with motor assemblies of one or more embodiments of the present invention.
FIGS. 24 to 30 illustrate various conduit apparatuses that can be used with embodiments of the present invention to enable circulation within a subterranean well.

FIG. 19 depicts an isometric view of a rotatable brush (22), having rotary connectors (50) for connection of associated apparatus at its upper and lower ends, such as a motor assembly (16 of FIG. 8) and a rotary connection of a universal joint (53 of FIG. 8).

The rotatable brush (22) is shown having optional jets (179) to direct fluid from a motor assembly to facilitate cleaning with rotating lateral fluid jetting. Alternatively, the bristles shown can be omitted, and the rotatable brush can simply provide a rotating fluid jet for cleaning or other purposes.

FIG. 20 depicts an isometric view of a rotating brush (23) with a rotary connector (50) for engagement, for example, to a motor assembly (16 of FIG. 8).

FIG. 21 depicts an isometric view of a rotary milling (24) or cutting device with a rotary connector (50) at its upper end that can be connected, for example, to an axially variable motor assembly (43 of FIGS. 96-101 and 128-135).

FIG. 22 depicts an isometric view of an extendable conduit assembly (44) with snap together (47) rotary connectors (50), usable with a casing drilling assembly (25). A drilling bit (161) is shown engaged to the lower end of the lower jointed conduit, and having a snap together rotary connection at its upper end. The upper conduit is shown having associated snap connections at both ends. Individual conduits joints can be placed through a lubricator arrangement, such as that shown in FIG. 5, during drilling of a side track (134 or 135 of FIG. 6).

FIG. 23 depicts an elevation view with a quarter cross section removed to show the internal components of a rotary expandable casing (180), having a rotary connection (50) engagable with motor assemblies usable with embodiments of the present invention. A motor assembly can be used to turn a shaft (184), shown having threads, which moves an expansion cone (183) through casing (181). The casing expands in diameter, and is depicted having an associated expanding sealing apparatus (182), shown as elastomeric rings, the casing expanding toward an upper end holding conduit (185) inside of another conduit.

Perforations (171 of FIGS. 31 and 32) can be placed to operate fluid motor assemblies. In an embodiment, the perforations must be repaired after use of the motor assemblies, and a rotary expandable casing (180) can be placed across the perforations to create a differential pressure seal.

The method for installing a rotary expandable casing (180) across perforations being used by a fluid motor for circulation includes first expanding the casing (181) and associated seals (182) below the perforations until differentially pressure sealed and secured, at which time the fluid motor would no longer operate. Tension can then be applied to the top of the motor assembly engaged to the upper end rotary connection (50) to expand the remainder of the expandable casing and associated seals by pulling the expansion cone (183) upward against the portion of the expanded casing, secured to the conduit by the motor assembly prior to losing circulation. Tension can be applied until the expansion cone exits the upper end of the expanded casing and the motor assembly is removed, having differentially pressure sealed the perforations.

Referring now to FIGS. 24 to 27 an extendable conduit assembly (44) is shown, having a telescoping conduit (45) with a one-way valve (48) at its lower end in a contracted and extended position, useable for rotating applications or the placement of substances, such as cement, within a well bore.

FIG. 24 is an elevation view, and FIG. 25 depicts a plan view having section line C-C. FIG. 26 depicts a cross sectional elevation view along line C-C of FIG. 25, and FIG. 27 depicts a magnified view along detail line D of FIG. 26. The Figures show the telescoping conduit (45) in a retracted position, in FIG. 24, and an extended position, in FIGS. 25 to 27.

Extendable conduits (44) can be used for placement of cement after well abandonment methods, such as those illustrated in FIGS. 32 to 35 and FIG. 128. After sufficient cementing space has been created below tubing or casing by removing tubing or casing from the internal diameter of a well bore, a rotary packer (19 of FIG. 35), a cement umbrella (163 of FIG. 30), lost circulation material, viscous fluids, and/or other apparatus or material can be placed above debris (164) created during abandonment.

The upper end of the extendable conduit assembly (44) can be engaged to the bottom (166 of FIG. 35) of tubing or casing within a well bore, after which cement of a greater density than the fluid within the well bore can be pumped within the inner passageway of the conduit to which the extendable conduit is engaged. A telescoping (45) and/or membrane (46) type conduit is thereby extended with pressure applied against a one way valve (48).

Cement is then placed through the one-way valve (48), typically referred to as a float shoe, and displaced from the inner passageway of the conduit in which the extending conduit (44) is engaged, as well as the inner passage of the extending conduit itself, with a fluid lighter than the placed cement.

Once the cement within the inner passageway of the extended conduit is displaced, pumping can be stopped, and the pressure can be removed from the inner passageway, allowing the one-way valve to close and "floating" the extendable conduit upward with the buoyancy of the lighter displacement fluid within the heavier cement. This causes the conduit to retract and remove itself from the cement, leaving a cement plug without contained conduits, as is preferred when abandoning wells to reduce the probability of leakage.

Referring now to FIGS. 28 and 29, isometric views of an extending conduit (44) of a flexible membrane type (46) are shown. FIG. 28 depicts the conduit in a contracted position, and FIG. 29 depicts the conduit in an extended position.

If a one-way valve is placed at the lower end of this flexible membrane extending conduit (46) it will function in the same manner as a telescoping conduit (45 of FIGS. 24-27) for cement placement during an abandonment operation.

FIG. 30 depicts an isometric view with a removed casing section to show a cement umbrella cementing arrangement (49), in which a cement umbrella (163) is placed above debris (164) created during a well abandonment operation, to support cement.

The umbrella is generally placed in a closed position with a wireline, which is disconnected from the umbrella connector (50) after placement, when the umbrella is in an open position, to ensure cement remains above the umbrella and does not fall through the debris until such a time as the cement hardens.

Referring now to FIGS. 31 to 35, diagrammatic axial cross sectional views are shown, depicting an embodiment (59) usable for creation of space, generally applicable to well abandonment operations, in which a conduit axial cutting apparatus (20) is disposed within an inner conduit (167) contained within an outer conduit (168), and the axial cutter is engaged with a cable (6).

The inner (167) and outer (168) conduit arrangement, shown in FIGS. 31 to 35, can be any dual conduit arrangement, such as the production tubing (98 of FIG. 4) within the production casing (101 of FIG. 4), the production casing (101 of FIG. 4) within the intermediate casing (103 of FIG. 4), the intermediate casing (103 of FIG. 4) within the conductor casing (105 of FIG. 4), an inner conduit within outer conduit pipeline, a conduit within a platform riser, any other arrangement of a first conduit within a second, or combinations thereof.

Axial cutting of conduits can also be applicable to single conduit applications (61 of FIG. 8), since circulation is not required and the axial cutter operates like a piston. For example, the cable (6) is similar to a shaft engaged to a piston, which is similar to the conduit axial cutter (20) for repeated upward and downward or forward and backward movement to cut axial slots in a conduit.

In this embodiment (30), as shown in FIG. 30, fluid pressure applied axially above the conduit axial cutter (20) actuates an internal piston (64 of FIG. 43) within a housing (63 of FIG. 41) of the cutter to extend axial cutters (65 of FIG. 42) with a cam arrangement (67 of FIG. 43) for creating axial cuts (170) of the inner conduit (167).

Figures 31, 32, 33, 34, 35:
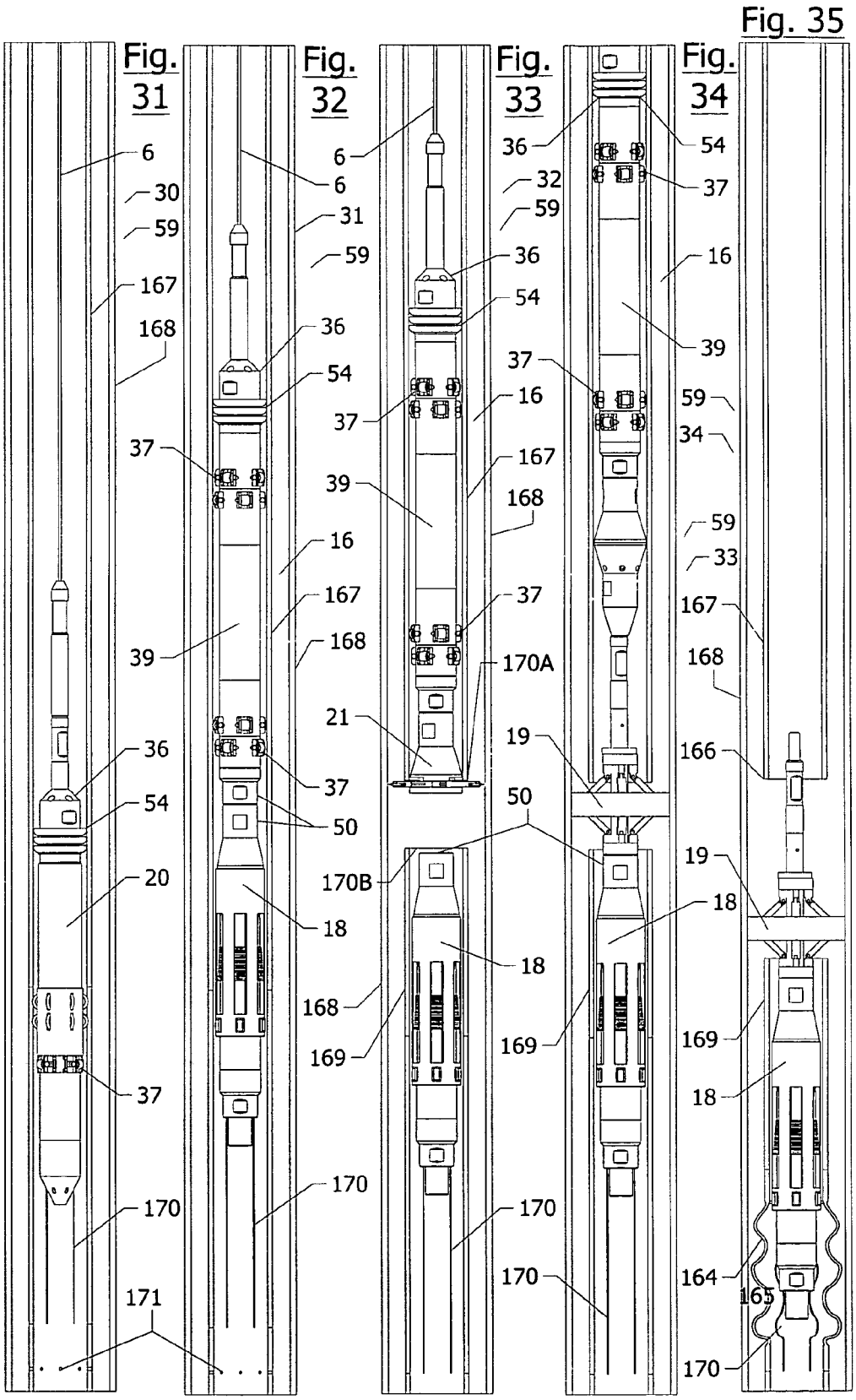
FIGS. 31 to 35 depict various embodiments of the present invention usable downhole, showing sequential steps to perform a rig-less abandonment operation.

Once axial cuts are made, as shown in FIG. 32, the axial cutter can be retrieved and an embodiment (31) incorporating use of a rotary hanger (18) can be performed, in which a motor assembly (16) using a positive displacement fluid motor (39) can engage the rotary hanger to the inner conduit (167) above the axial cuts (170), after which the motor assembly can be disengaged from the rotary hanger and removed from the well, thereby leaving the rotary hanger secured to the inner conduit.

Circulation to operate the positive displacement motor (39) of the motor assembly (16) can be accomplished by perforating (171) the inner conduit and circulating down the inner conduit, and upward in the annular space between the inner (167) and outer (168) conduits.

Alternatively, in operations utilizing either single or dual conduits, if it is possible to either pump or inject through the conduit, return circulation and perforations (171) are not needed.

Once removed, as shown in FIG. 33, an embodiment (32) of a motor assembly (16) can be again placed within the inner conduit (167) using a cable (6), thereby moving the motor into the dual conduit arrangement to cut (170A, 170B) the inner conduit (167) with a conduit circumferential cutter (21), creating an a separate lower inner conduit (169).

Cutting (170A) the lower end of the inner conduit (167) releases tension between the inner conduit (167) and the newly created separate lower conduit (169) thereby creating a gap between said inner conduit (167) lower end cut (170A) and the separated lower conduit (169) upper end cut (170B).

As shown in FIG. 34, if this gap created by the release of tension and slumping of the lower separate conduit (169) is insufficient to place a rotary packer (19), or if placing of a rotary packer is not desirable, a piston can be placed within the inner conduit (167) and engaged to the rotary hanger to push the lower separate conduit axially downward to create a space between the inner conduit and the lower separate conduit for placement of a rotary packer or cement, usable for well abandonment or conduit isolation.

Cutting can be followed by use of an embodiment (33) for placement of a rotary packer (19), in which a motor assembly (16) carrying the rotary packer (19) can be used to place the rotary packer in a space between the inner conduit (167) and the lower separate conduit (169) across the entire diameter of the space, optionally engaging the rotary packer to the rotary hanger illustrated in FIG. 33.

The motor assembly (16) can be used to rotate and engage the rotary packer (19) against the inside diameter of the outer conduit (168), forming a piston with a lower shaft through the engagement with the rotary hanger (18) and associated lower separate inner conduit (169), after which the motor assembly can be removed.

The crushing piston embodiment (34) of FIG. 35 shows the space above the rotary packer (19) being pressured to cause the piston formed by the rotary packer, rotary hanger (18) and lower separate inner conduit (169) to move downward, thereby crushing (165) the lower separate inner conduit, resulting in the creation of a space above the debris (164) within the outer conduit (168).

The application of pressure across the larger area of the inside diameter of the outer conduit (168) can provide more compaction force than a piston within the inner conduit (167), as described earlier.

Also the inclusion of axial cutting (30) causes the compaction of the lower separate conduit to be more efficient, potentially creating additional space free of an inner conduit within the outer conduit (168).

Figures 36, 37, 38, 39, 40, 41, 42, 43:
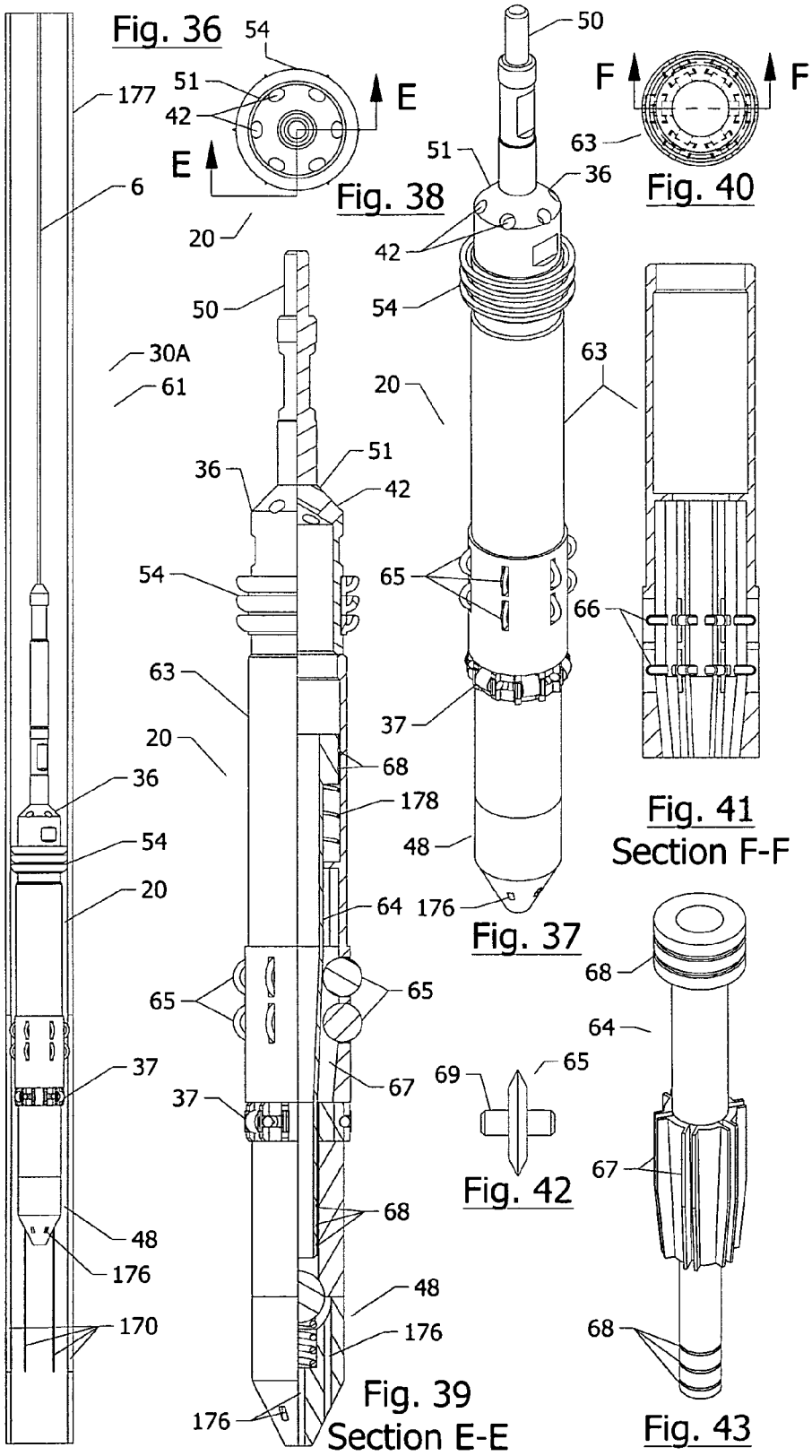
FIG. 36 depicts an embodiment usable to axially cut a conduit with an axial cutting assembly.
FIGS. 37 to 39 illustrate a conduit axial cutting assembly usable with embodiments of the present invention.
FIGS. 40 to 43 illustrate component parts of the axial conduit cutting assembly of FIGS. 37 to 39.

Referring now to FIG. 36, a diagrammatic axial cross sectional view depicting an embodiment of a conduit cutting assembly (30A) disposed over an axial length with an axial cutter (20). The axial conduit cutter (20) is held by a cable (6) within a vertical, inclined or horizontal conduit (177). Fluid can be pumped through the conduit (177) and diverted through a fluid diverter (36) by seals (54) on the fluid diverter to operate a piston (64 of FIGS. 39 and 43), which urges wheel cutters (65 of FIGS. 39 and 42) against the inside circumference of the conduit (177), such that when moved axially, the axial cutter makes axial cuts (170) in the conduit.

Referring now to FIGS. 37 to 43, an embodiment of a conduit axial cutter (20) and its component parts are depicted.

FIG. 37 shows an isometric view of a conduit axial cutter (20), depicting a wireline engagable flow diverter housing (51) having a connector (50) at is upper end, seals (54) around its circumference, and diverting orifices (42) that, in combination form a flow diverter (36), are shown engaged to the top of a piston housing (63).

The piston housing (63) has wheel cutters (65) protruding from its outer diameter that are urged against the inside diameter of a conduit by a piston and cam (67 of FIG. 43) arrangement within the housing. Flow of fluid through the diverting orifices (42) acts against the piston and ultimately exits through exit passageways (176).

An optional wheeled anti-rotation apparatus (37), similar in construction to a motor anti-rotation apparatus, described and illustrated above in FIG. 8, prevents rotation until the wheel cutters create a groove, which further prevents rotation. Repeated cuts caused by movement of the axial conduit cutter (20) along the axis of a conduit ultimately cuts through the conduit's wall. Pressurized fluid injected into the conduit urges an internal piston and associated cam (67 of FIG. 43) downward to force the cutting wheels outward.

FIGS. 38 and 39 depict a plan view and an associated elevation cross section view along line E-E of FIG. 38, respectively. The figures show the conduit axial cutter (20) with seals (54) diverting pumped fluid flow through diverting orifices (42) within a wireline engagable flow diverter housing (51).

The housing (51) and seals (54) form a flow diverter (36) engaged to the top of the axial cutter housing (63), with a piston (64) supported by a return device, shown as a spring (178), against which fluid flow pressure acts, up to a pressure defined by a spring of the pressure relief one-way valve (48) at the lower end of axial cutter assembly (20).

The piston (64) has an internal passageway extending axially to a mandrel and seals (68) at its lower end and engages a receptacle to facilitate sealed upward and downward movement, while a cam (67) arrangement acts against the axles (69 of FIG. 42) associated with the wheel cutter (65). These axles are engaged within recesses (66 of FIG. 41) defining their travel when acted upon by the cam arrangement. The piston is controlled by both fluid pressure exerted on its upper surface within the borehole and cable tension engagement at its upper connector (50).

Referring now to FIGS. 40 and 41, a plan view and an associated elevation cross sectional view taken along line F-F of FIG. 39, respectively, are shown. The figures depict a conduit axial cutter housing (63), in which recesses (66) define the radial travel of axles (69 of FIG. 42) urged through the receptacles by a cam (67 of FIG. 43).

FIG. 42 is an elevation view associated with FIGS. 37-39, showing a wheel cutter (65) having an axle (69) engagable within a housing (63 of FIG. 41), cam (67 of FIG. 43) and conduit to form a vertical cut when rolled axially along the inside surface of the conduit.

FIG. 43 is an isometric view of a piston (64) associated with FIG. 39, showing seals (68) at upper and lower ends with an internal passageway between the upper and lower ends, and an associated cam (67). Pressure applied against the upper piston head urges the piston assembly downward, and the cam (67) urges the wheel cutters (65) radially outward against the interior conduit.

The dual cam (67) arrangement acts against axles (69 of FIG. 42) on both sides of a circular cutting surface, which is partially disposed within a recess of the piston between the dual cams. Pressure applied against the upper piston head can be regulated by a one-way relief valve (48 of FIG. 39).

Figures 44, 45, 46, 47, 48, 49, 50, 51, 52, 53:
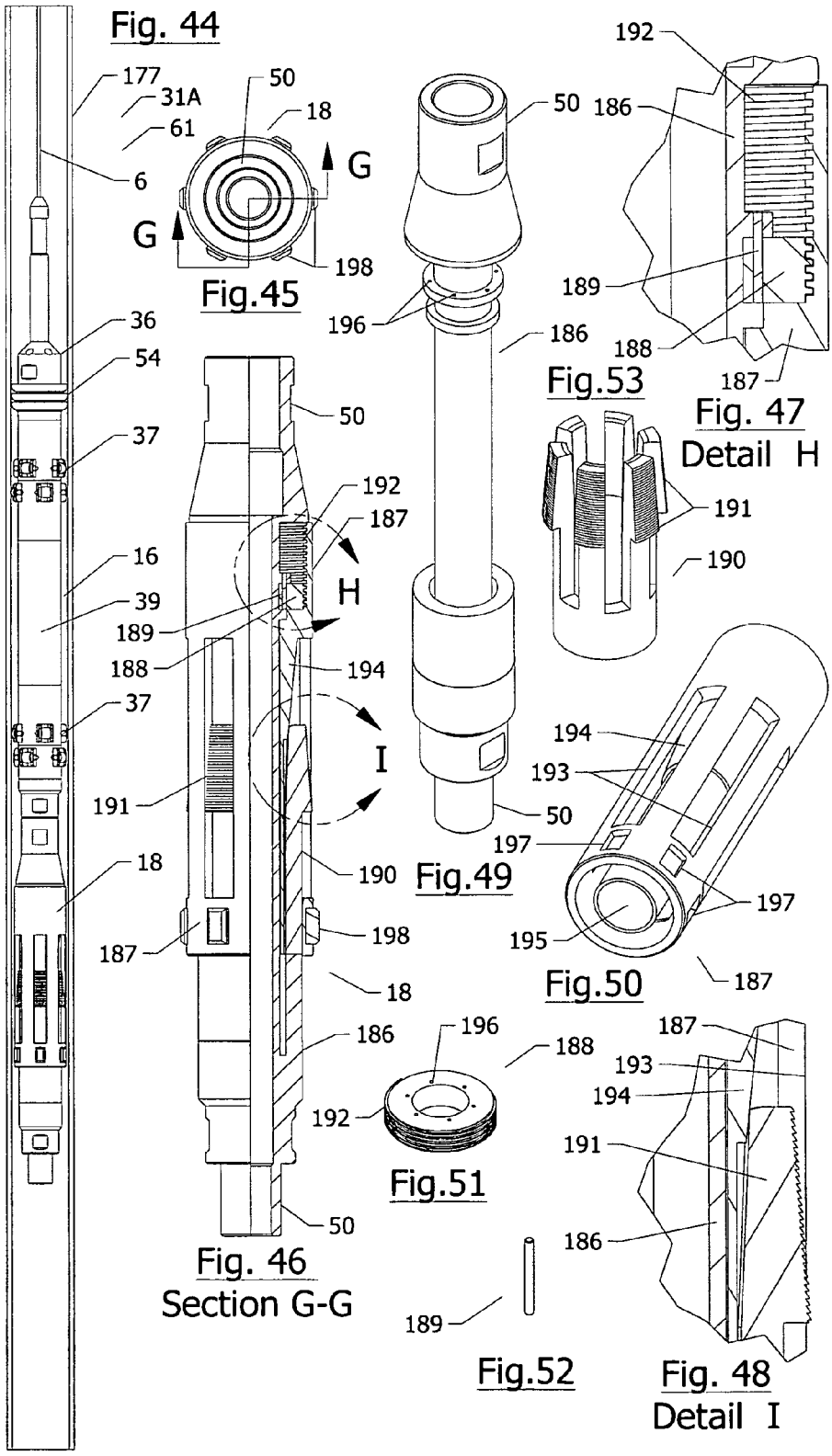
FIG. 44 depicts a rotary hanger assembly usable with embodiments of the present invention engaged with a conduit.
FIGS. 45 and 46 show a rotary hanger assembly usable with the embodiment of FIG. 44.
FIGS. 47 to 48 are detail views of the rotary hanger assembly of FIG. 46.
FIGS. 49 to 53 are member parts of the rotary hanging assembly of FIGS. 45 and 46.

Referring now to FIG. 44, a diagrammatic axial cross sectional view depicting a rotary hanger placement (31A) embodiment with a cable (6) engaged within a vertical, deviated or horizontal single conduit (177) is shown. The rotary hanger (18) is engageable with a motor assembly (16), which is shown having a positive displacement fluid motor (39) with anti-rotation apparatus (37) and a flow diverter (36) with seals (54).

A rotary hanger (18) can be placed using any wireline motor, such as an electric motor suspended from electric line or a coiled tubing motor suspended from coiled tubing.

Referring now to FIGS. 45 and 46, a plan view and associated cross sectional elevation view taken along line G-G of FIG. 45, respectively, are shown. FIGS. 47 and 48, respectively, depict detail views along detail lines of H and I of FIG. 46, showing a rotary hanger (18). The rotary hanger (18) is placed within a conduit with a downhole removable replaceable rotary connection (50) at an upper end and an optional rotary connection (50) at a lower end. Drag blocks (198) can be used to allow axial placement while resisting rotation about the axis of the rotary hanger.

Engagement of the upper end rotary connector (50) to the lower end of a motor assembly (16) suspended on a cable (6 of FIG. 44), or alternatively an electrical motor suspended on electric wire line, rotates the shaft (186) engaged to the rotary expander plate (188) with shear pins (189). A moving engagement (192), shown as threads, on the periphery of the rotary expander plate and inside diameter of the upper end of an expander housing (187) causes the expander housing to move axially downward in relation to the expander plate engagement to the rotating shaft. The periphery of the threaded portion (192) of the rotary expander plate (188) threaded portion (192) engages a complementary threaded portion on the interior of an expander housing (187) and causes the expander housing to move axially downward. A conical surface (194) of the expander housing is thereby driven downwardly into the mouth of a conduit engagement gripper (190) and forces gripper engagement surfaces (191) on leg portions thereof radially outward to grip the conduit in which they are disposed. Reaching the expansion limit shears the pins (189), allowing the shaft (186) to continue rotating while being supported by the rotary hanger (18), which is thereby secured to the conduit (177). During deployment, the housing is prevented from coincidental rotation about the axis of the rotary hanger (18) by drag blocks (198) to expand conduit engagement grips (190) radially outward, causing a conical surface (194) to engage the rotary hanger to the conduit in which it is disposed. When the conduit engagement grips reach an expansion limit this shears the pins (189) allowing the shaft (186) to continue rotating while supported by the rotary hanger.

The rotary hanger (18) engagement resists downward movement of the hanger within the conduit, such that apparatus and loads can be suspended from the lower end connector (50) or supported on the upper end connector (50), for example, when crushing conduits with a rotary packer (19 of FIGS. 34 and 35).

A rotary hanger (18) can be removed by forcing the shaft (186) axially upward, thereby moving the expander housing (187) and its conical surface (194) upward through the moving engagement (192) between the shaft and expander plate (188). The housing allows associated gripper (190) engagement surfaces (191 of FIG. 53) to disengage from the conduit diameter with which they are engaged through further upward urging of the shaft. Axial upward movement of the shaft (186) of the rotary hanger (18) can be provided using any method, including engaging the upper connector (50) and jarring it upward with a cable (6 of FIG. 5), and/or applying pressure through the bore to the lower end if a seal is attached to the bottom of the rotary hanger or lower end connection (50).

FIG. 47 depicts an elevation magnified view on line H of FIG. 46, showing the moving engagement (192) between the expander plate (188) and the expander housing (187). The expander plate is shown engaged to the rotatable shaft (186) with shear pins (189). Rotation of the shaft rotates the expander plate, moving the expander housing axially downward, such that a conical surface (194 of FIG. 50) moves gripping surfaces (191 of FIG. 53) radially outward to engage the rotary hanger (18 of FIGS. 45-46) to the conduit in which it is disposed (177 of FIG. 44).

FIG. 48 depicts an elevation magnified view on line I of FIG. 46, showing a conical surface (194) engagement with a gripper (190), in which the gripper extends through an orifice (193) in the expander housing (187) disposed about the rotating shaft (186).

FIG. 49 depicts an isometric view of a rotary shaft (186) device associated with FIGS. 45-48, showing the rotary hanger (18 of FIGS. 45-46) shaft having rotary connectors (50) at upper and lower ends with orifices (196) for shear pins (189 of FIG. 52) to engage an expander plate (188 of FIG. 51). After shearing the shear pins, the shaft can axially rotate while supported by the expander plate engagement with gripping surfaces (191 of FIG. 53) engaged to a conduit (177 of FIG. 44).

FIG. 50 depicts an isometric view of the lower end of a expander housing (187) device associated with FIGS. 45-48, showing a conical surface (194) for engagement with grippers (190 of FIG. 53) that protrude through orifices (193) in a rotary hanger (18 of FIGS. 45-46) with receptacles (197) for drag blocks (198 of FIGS. 45-46) and with an internal passageway (195) for a rotating shaft (186 of FIG. 49) driving an expander plate (188 of FIG. 51) against the upper end of the expander housing to force the conical surface between the shaft and grippers, causing the grippers to protrude from the orifices to engage the conduit in which the rotary hanger is disposed.

FIG. 51 depicts an isometric view of a rotary expander plate (188) device associated with FIGS. 45-48, showing shear pin orifices (196) for a shear pin (189 of FIG. 52) engagement with a rotating shaft (186 of FIG. 49) of a rotary hanger (18 of FIGS. 45-46). A moving engagement (192), shown as threads, can engage an expander housing (187 of FIG. 50) with a conical surface (194 of FIG. 50) usable to expand grippers (190 of FIG. 53) for engagement of the rotary hanger to the inside diameter of a conduit (177 of FIG. 44). After engagement of the rotary hanger to the conduit, the pins can be sheared allowing further rotation of the shaft within the expander plate.

FIG. 52 depicts an isometric view of a shear pin (189) device associated with FIGS. 45-48, in which the pin is usable between an expander plate (188 of FIG. 51) and a rotating shaft (186 of FIG. 49) of a rotary hanger (18 of FIGS. 45-48) to provide sufficient torque resistance to engage gripper surfaces (191 of FIG. 53) to the inside of a conduit (177 of FIG. 44). An associated expander housing (187 of FIG. 50) is shown having a conical surface (194 of FIG. 50) for engagement to the grippers. The shear pins are sheared when the expander plate can no longer expand the grippers, thereby allowing the shaft to rotate within said expander plate.

FIG. 53 depicts an isometric view of a conduit engagement gripper (190) device associated with FIGS. 45-48, showing gripping surfaces (191) for engagement to the insider diameter of a conduit (177 of FIG. 44), when the gripper is expanded with a conical surface (194 of FIG. 50) of an expander housing (187) of a rotary hanger (18 of FIGS. 45-46).

Figures 54, 55, 56, 57, 58, 59, 60, 61:
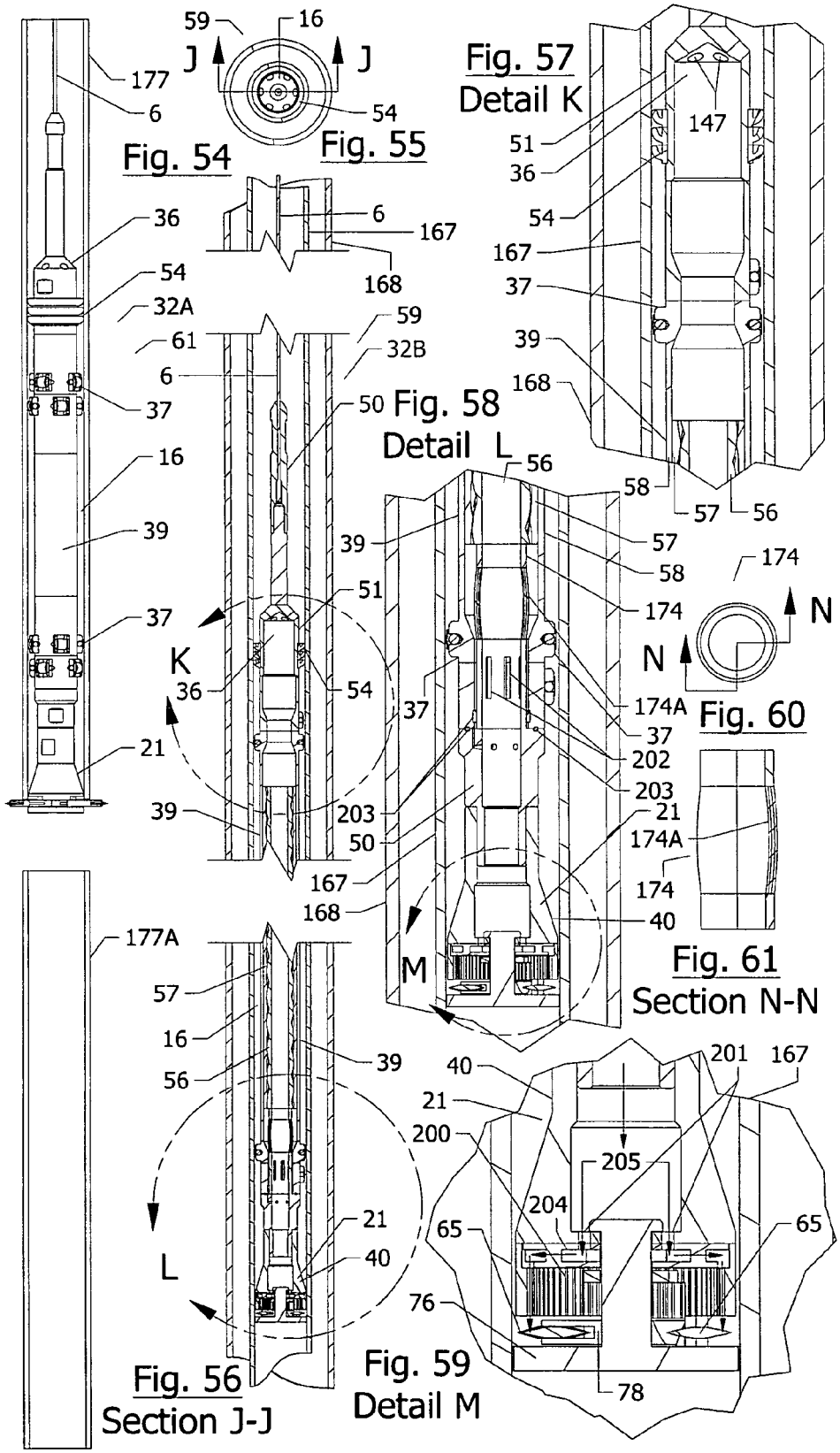
FIG. 54 illustrates a conduit being cut above a rotary hanger assembly using a wheel conduit cutter.
FIGS. 55 to 59 depict an embodiment of a wheel conduit cutting assembly placed within a subterranean well prior to severing the conduit.
FIGS. 60 and 61 illustrate a flexible rotary coupling for use as a component part of the fluid motor and wheel cutter embodiments of FIGS. 55 to 59.

Referring now to FIGS. 54 and 55, embodiments of single (61) and dual (59) conduits, respectively, are depicted, showing various embodiments of fluid motor assemblies to cut a conduit with a conduit wheel cutter (21).

FIG. 54 depicts a diagrammatic axial cross sectional view of an embodiment (32A) of a conduit wheel cutter (21), with a cable (6) engaged within a vertical, deviated or horizontal single conduit (177), and a positive displacement fluid motor (39) within a motor assembly (16) having motor anti-rotation devices (37) at distal ends of the fluid motor. A fluid diverter (36) is shown, having seals (54) diverting circulated fluid between a stator and rotor of the fluid motor. The lower end of the rotor is engaged to the upper end of a conduit wheel cutter (21).

If the conduit (177) being cut is in tension, the lower end (177A) will separate, as shown in FIG. 54. Otherwise, only the axial distance of the cutter will separate the conduit (177) and lower end (177A).

The extension of the cutters of a wheel cutter (21) is a function of the length of the cutter arm and can be varied dependent upon the application for which the wheel cutter is to be used. For example, the extension shown in FIG. 54 may be necessary to cut insulation about a pipeline, but generally such an extension need only extend to the outside diameter of the conduit (177).

Referring now to FIGS. 55 and 56, a plan view and an associated cross sectional elevation view taken along line J-J of FIG. 55, respectively, are shown, depicting of a dual conduit (59) cutting embodiment (32B). FIGS. 57 and 58, respectively, show views taken along detail lines K and L of FIG. 56, and depict a motor assembly (16) with a fluid motor (39) having a rotor (56) within a stator (57) suspended from a rope socket (50) engagement to a cable (6) within the dual conduit arrangement.

A cable engagable flow diverter housing (51) with seals (54) is shown, which forms a flow diverter (36) that diverts fluid pumped down the inner conduit (167) within an outer conduit (168) to drive a fluid motor (39) and associated rotor (56) with a gear deployed (40) wheel cutter (21). The fluid to drive the motor can be either circulated between the inner (167) and outer (168) conduits or injected to an exit at the end opposite the motor assembly (16).

FIG. 57 depicts a magnified elevation view taken on line K of FIG. 56, showing orifices (147) within a cable deployable diverter housing (51) receiving flow from fluid pumped down the inner conduit (167) through the rotor (56) and between the rotor and stator (57) within a stator housing (58). The size of the flow passageway through the center of the rotor determines the pressure at which fluid enters between the rotor and stator. Motor anti-rotation apparatus (37) are shown engaged to the upper end of the stator and stator housing (58) to allow the positive displacement of fluid between the rotor and stator to rotate the rotor.

The orifice (147) of the fluid diverter (36) communicates high pressure to the space between the rotor (56) and stator (57) and inner bore of the rotor to commingling slots (202 of FIG. 58) of the lower end drive coupling (174 of FIG. 58), forming a lower pressure region due to the pressure loss associated with rotating the rotor. The outlet is shown having orifices (201 of FIG. 59) in the conduit wheel cutter (21 of FIG. 59), extending through the conduit cutter to the borehole or conduit in which it is disposed and operating the motor assembly with the differential fluid pressure between the inlet and outlet.

FIG. 58 depicts a magnified elevation view taken on line L of FIG. 56, while FIG. 59 depicts a view taken along detail line M of FIG. 58. The figures show a drive coupling (174) with a torque dampener (174A), depicted as a reinforced elastomeric device, which in an embodiment, can be formed from a rubber material similar to that of an automobile tire. The torque dampener is shown engaged to the rotor (56), with rotary bearings (203) disposed between an anti-rotation device (37) at the lower end of the drive coupling and upper end of the rotary connector (50). Orifices (202) in the upper end of the rotary connector allow flow from between the rotor (56) and stator (57), within the stator housing (58), into the internal bore of the wheel cutter (21), with an upper end engaged to the lower end of the rotary connector, disposed within the inner conduit (167) and outer conduit (168). Motor anti-rotation devices (37) are engaged between the stator housing (58) and rotary connection (50) with intermediate bearings (203) to allow the stator housing to anchor the stator (57) and force the rotor (56) to rotate with positive displacement of fluid between, thus turning the rotary connector (50), and subsequently, the geared (40) wheel cutter (21) engaged at its lower end.

FIG. 59 depicts a magnified elevation view taken on line M of FIG. 58, showing a geared (40) wheel cutter (21) having a planetary gearing arrangement (200) to drive an arm (78) with a cutter wheel (65) engaged to a drag plate (76). Fluid pumped through the inner bore of the motor assembly (16 of FIGS. 45-46) passes through orifices (201) to lubricate and clean the geared wheel cutting assembly, and an optional centrifugal flow impellor (204) aids lubrication and cleaning with an accelerated flow (205).

Referring now to FIGS. 60 and 61, a plan view and an associated cross sectional elevation view taken along line N-N of FIG. 60, respectively, are shown. The figures depict a drive coupling (174) having a torque change inhibitor, shown as a flexible reinforced elastomeric membrane, to prevent sudden changes in torque associated with sticking and subsequent slipping to reduce forces on a rotor and stator fluid motor.

Figures 62, 63, 64, 65, 66, 67, 68, 69, 70, 71, 72, 73:
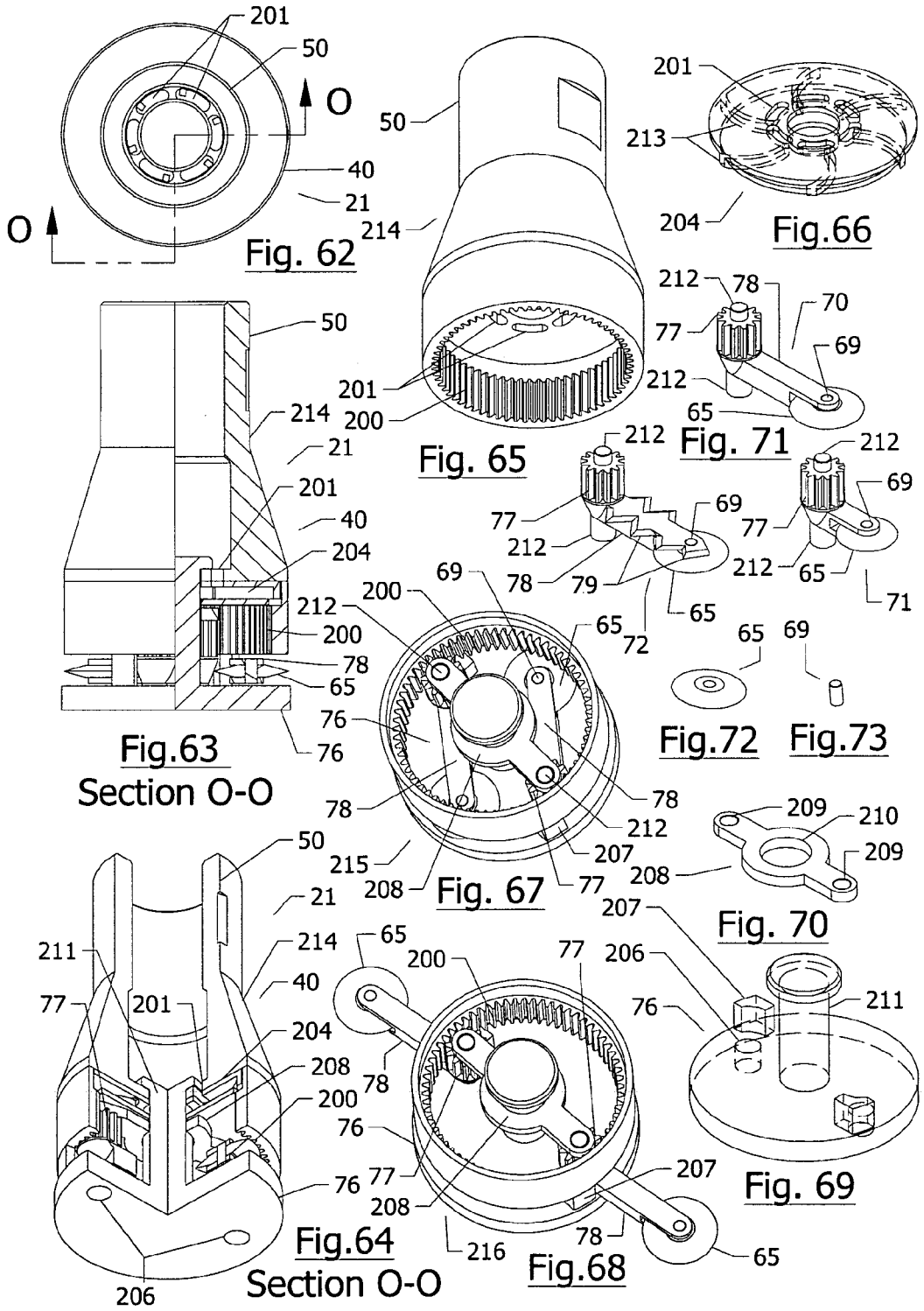
FIGS. 62 to 64 depict a conduit wheel cutter usable with embodiments of the present invention.
FIGS. 65 to 70 illustrate component parts of the conduit wheel cutter of FIGS. 62 to 64.
FIG. 71 depicts variations of cutting wheel component parts usable within the conduit wheel cutter of FIGS. 62 to 64.
FIGS. 72 and 73 show cutting wheel and axial parts of the cutting wheel subassemblies of FIG. 71.

Referring now to FIGS. 62 to 70 and FIGS. 71 to 73 a planetary geared arrangement (40) with associated component parts of a two arm conduit wheel cutter (21) are shown, as are various embodiments of wheel cutter subassemblies with associated component parts, showing one possible gearing and arm arrangement for deploying various embodiments of wheeled cutters of FIG. 71. A fluid motor assembly, such as an electric motor on electric wireline, can be used to deploy the embodied wheeled cutters to cut a conduit.

Referring now to FIGS. 62, 63 and 64, FIG. 62 depicts a plan view with section line O-O, FIG. 63 depicts a cross sectional elevation view taken along line O-O of FIG. 62, and FIG. 64 depicts an isometric view taken along line O-O of FIG. 62. A planetary geared arrangement (40) of a conduit wheel cutter (21), associated with FIGS. 65-70, is shown, having an upper end rotary connection (50) and an internal passageway leading to orifices (201) within a planetary gear housing (214). The planetary gear housing can be kept clean with flow from the orifices through a centrifugal impeller plate (204). Rotation about a drag plate (76) engaging the conduit in which the wheeled cutter is disposed provides resistance to planetary gearing (200) to extend the wheel cutter (65) arms (78) to cut the conduit from its inner diameter outward.

Figures 74, 75, 76, 77, 78, 79, 80, 81, 82, 83, 84, 85:
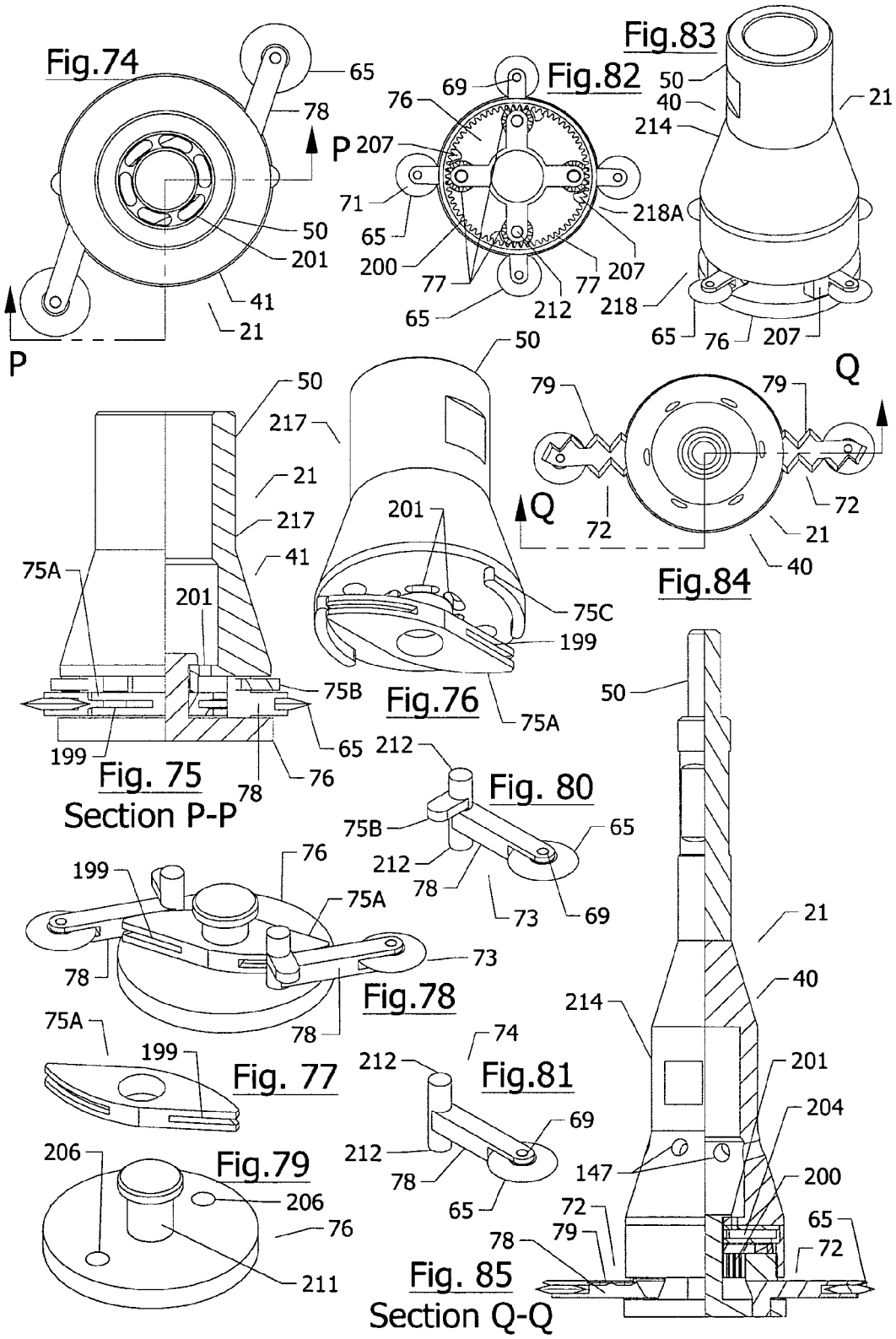
FIGS. 74 and 75 illustrate a conduit wheel cutter assembly usable with embodiments of the present invention.
FIGS. 76 to 79 show component parts of the conduit wheel cutter of FIGS. 74 and 75.
FIGS. 80 and 81 are various embodiments of cutting wheel subassemblies useble with the embodiments of FIGS. 74 and 75.
FIG. 82 shows a gearing arrangement for four-wheel cutter subassemblies usable with the wheel cutter of FIG. 83.
FIG. 83 depicts a four-wheeled cutter assembly usable with embodiments of the present invention.
FIGS. 84 and 85 illustrate an embodiment of a wheel cutter assembly with cutting wheel subassemblies arrangement having two control lines.

Any configuration of planetary gearing and drag plate, as shown in FIGS. 82-84 and FIGS. 83-84, or drag block arrangement, similar to that of FIGS. 45-46 for a rotary hanger, are usable within a geared wheel cutter (21).

A yoke (208) disposed about a shaft (211) engages an upper axle (212 of FIG. 71) of a wheel cutter subassembly (70 of FIG. 71), with a lower axle (212 of FIG. 71) engaged in an orifice (206) within the drag plate (76). The gear (77) of the wheel cutter subassembly engages a circumferential gear (200), allowing rotation of the planetary gear housing (214) to extend the wheel cutter subassembly against the inside diameter of the conduit in which it is disposed and against which the drag plate (76) is engaged to supply a radial force outward proportional to the frictional resistance to slippage of the drag plate.

If a rotary connector is secured to the bottom of the drag plate (76), additional rotary equipment can be engaged axially below, including additional conduit wheel cutters. If a bore is provided through the shaft (211) of the drag plate, a portion of circulation may be provided to additional rotary equipment below.

If cleaning, cooling and/or lubrication of the planetary gearing and wheel cutter subassemblies are not required, an electric motor engaged to an electric wire line can be used and the orifices (201) and/or centrifugal impeller, can be removed, or if a fluid motor is used, a bore through the shaft (211) of the drag plate (76) can carry fluid axially through the cutter. FIGS. 84-85 illustrate an embodiment of a wheel cutter usable with an electric motor where cleaning, cooling and/or lubrication are required.

FIG. 65 depicts an isometric view of a planetary gear housing (214), associated with FIGS. 62-64, showing orifices (201) for fluid passage through the internal passageway and gears (200) about the inside circumference of the housing.

FIG. 66 depicts an isometric view of a centrifugal flow impellor (204), associated with FIGS. 62-64, placeable below a wheel cutter housing (214 of FIGS. 65, 83 and 85 or 217 of FIGS. 74-76), showing orifices (201) and vanes (213) of a centrifugal arrangement for controlling fluid flow through a conduit wheel cutter embodiment.

Referring to FIGS. 67 and 68, isometric views of a planetary gearing arrangement in a retracted (215) and extended (216) position, respectively, are shown. The figures depict circumferential gears (200) engaged with gears (77) secured between axles (212) disposed at ends of a wheel cutter subassembly, with arms (78) extending from an axle (212) with an additional axle (69) engaging a cutting wheel (65). The drag plate (76) engages the lower end of the axle (212), and a yoke (208) engages the upper end of the axle (212).

Rotation of the circumferential gear (200) by an electric motor or flow of fluid to a pneumatic and/or fluid motor works against friction supplied by the drag plate (76) to extend the wheel cutter subassembly (70 of FIG. 71) to the position shown in FIG. 68, until the arm (78) engages a stop (207). Reverse rotation of an electric motor or from associated reverse circulation through a pneumatic and/or fluid motor retracts the wheel cutter subassembly to the position shown in FIG. 67, with the arms (78) stopping at the drag plate shaft (211 of FIG. 69).

FIG. 69 depicts an isometric view of a drag plate (76) associated with FIGS. 62-64, showing a shaft (211) engagable with a yoke (208 of FIG. 70), orifices (206) engagable with the lower end axle (212 of FIGS. 71, 80 and 81), and a stop (207) engagable with an arm (78 of FIG. 67) of a wheel cutter subassembly.

FIG. 70 depicts isometric views of a cutter wheel assembly yoke (208), associated with FIGS. 62-64, showing orifices (209) engagable with upper end axles (212 of FIGS. 71, 80 and 81) of a wheel cutter subassembly, and an orifice (210) engagable with a shaft (211 of FIG. 69).

FIG. 71 depicts an isometric view of various embodiments of geared wheel cutter subassemblies, usable with FIGS. 62-64 and associated with FIGS. 72-73, showing axle ends (212) with a secured intermediate gear (77) and arm (78) extending to an axle (69), about which a wheel cutter (65) revolves.

Wheel cutter subassemblies with a longer (72) and shorter (71) arms (78) usable to cut larger and smaller radiuses about the axis of a conduit wheel cutter are shown. A depicted embodiment of a wheel cutter includes blades (79) secured to its arm (78) for cutting control lines, metal tangs, debris and/or other objects debris disposed within its cutting radius.

FIGS. 72-73 depict isometric views of a wheel cutter (65) and wheel cutter axle (69), respectively, associated with wheel cutter subassemblies shown in FIGS. 71, 80 and 81. The figures show a circular cutter capable of rotating across an area to cut repeatedly, thereby encounter reduced torque compared to conventional knife type cutters. Additionally, conventional cutters cut conduits from the outside inward, while the depicted circular cutter cuts conduits or pipes from the inside outward.

If the conduit being cut is in sufficient tension, the radius of a wheel cutter can be less than thickness of the conduit wall being cut, as the conduit will separate as it is cut allowing the portion of the arm (78 of FIG. 71) about the axle (69 of FIG. 71) to extend within the separation. However, when insufficient tension exists within the conduit being cut, a knife (79 of FIG. 71 and FIGS. 85-86) or an abrasive cutting member can be added to the arm to remove material to allow the cutting wheel to sever the intended conduit.

Referring now to FIGS. 74 to 75 and FIGS. 76-80, isometric views of a two armed cam (41) and associated component parts, respectively, of a conduit wheel cutter (21), are shown. The assembled apparatus with its component parts are usable with electric motors or fluid, pneumatic and/or liquid motors.

FIGS. 74 and 75 depict a plan view and an associated elevation cross sectional view taken along line P-P of FIG. 74, respectively, showing a two armed cam (41) associated with FIGS. 76-80. An upper rotary connector (50) is shown having flow orifices (201) within the inner passageway of a cam cutter housing (217). A cam (75A) can deploy arms (78) with engaged wheel cutters (65) extending from a drag plate (76) to cut a conduit from the inside outward. A retraction cam (75B) is also shown in FIG. 75 for stopping motion of the wheel cutter, and a receptacle (199) is provided for housing a fully retracted wheel cutter.

FIG. 76 depicts an isometric view of a housing (217) and cam (75A) associated with FIGS. 62-64, showing the cam housing with a rotary connection (50) at its upper end, flow orifices (201) and a cam surface (75C) for stopping extension and retracting a wheel cutting subassembly through engagement with the associated retraction cam (75B of FIG. 80) of an arm (79 of FIG. 80) at lower end. The extension cam (75A) below the housing extends the arm with rotation in one direction, and the cam surface (75C) acting against the associated retraction cam (75B of FIG. 80) retracts the arm with rotation in the opposite direction.

FIG. 77 depicts an isometric view of a cam (75A) associated with FIGS. 62-64, showing a receptacle (199) within which a wheel cutter can be disposed when fully retracted. Retraction of the wheel cutter increases the usable size of a cutting wheel, enabling larger and more efficient wheel cutters to be used to cut thicker conduit walls and resist wear to their cutting edge.

FIG. 78 depicts an isometric view of a drag plate (76) with a wheel cutter subassembly (73 of FIG. 80) associated with FIGS. 62-64. FIG. 78 shows the wheel cutting assemblies in an extended position with a cam (75A), without the associated housing (217 of FIG. 76) urging the arm (78) into an outward position through friction of the drag plate's outside circumference and rotation of the cam (75A), secured to the lower end of a rotary housing (217 of FIG. 76). FIG. 7 omits depiction of the rotary housing for illustration purposes.

FIG. 79 depicts an isometric view of a drag plate (76) associated with FIGS. 62-64, showing orifices (206) within which the lower axle of a cutting wheel subassembly can be engaged, and a shaft (211) for engagement to the rotating housing (217 of FIG. 76).

FIG. 80 depicts an isometric view of a wheel cutter subassembly (73) associated with FIGS. 62-64, showing an axle (212) with a secured retraction cam (75B) engagable with an associated cam (75C of FIG. 76), and an arm (78) having a further axle (69) engagement with a wheel cutter (65).

The cam driven wheel cutter subassembly (73) can be urged into an extended position by rotation of the cam housing (217 of FIG. 76) engagement between a cam (75A of FIGS. 77-78) with the arm (78), and retracted using the cam (75C of FIG. 76) engagement with the retraction cam (75B), secured to the axle (212), by rotating the cam housing (217 of FIG. 76) in the opposite direction.

FIG. 81 depicts an isometric view of an alternative wheel cutter subassembly (74) to that of FIG. 80, usable within a cam conduit wheel cutter (41 of FIGS. 62-64). FIG. 80 shows the wheel cutter subassembly of FIG. 80 without a retraction cam, such that natural friction or engagement with the extension cam (75A of FIGS. 77-78) can be used to retract the alternative wheel cutter subassembly.

FIG. 82 depicts a plan view of the gearing arrangement (218A) of a four arm planetary gear (218 of FIG. 83), showing wheel cutter subassemblies (71) with cutting wheels (65) and gears (77) engaged with a circumferential gear (200) of a geared housing. A four arm yoke engages axles (212) of the wheel cutter subassemblies fully extended against stops (207) on the drag plate (76).

FIG. 83 depicts an isometric view of a four arm (218) planetary geared (40) conduit wheel cutter (21) embodiment associated with FIG. 82, showing an upper end rotary connector (50) on the geared housing (214) and cutting wheels (65) extending outward against stops (207) on a drag plate (76).

Referring now to FIGS. 84 and 85, a plan view and an associated cross sectional elevation view taken along line Q-Q of FIG. 84, respectively, are shown, depicting a geared (40) conduit cutting wheel (21), with a rotary connector (50) usable with electric motors or other types of motors without a flow passageway in their associated connector. Knife cutters (79) are shown incorporated into the arm of cutting wheel subassemblies (72) to cut objects, such as control lines, conduit insulation and/or debris within or missed by the cutting wheel (65).

Flow diverted by the diameter of the conduit cutting assembly (21) passes through orifices (147) to an internal chamber and through further orifices (201) to an fluid impeller (204) to control flow to the gears (200) and cutter wheel subassemblies (72), for the purposes of lubrication, cleaning and/or cooling.

As demonstrated in FIGS. 54-85, and in the preceding depicted and described embodiments, any combination and configuration of conduit wheel cutters (21) can be configured for use with an electric motor, pneumatic motor, fluid motor or any other motor to cut a conduit from the inside outward, using a cutting wheel to minimize required torque and/or extend wheel cutters to diameters larger than is currently the practice with wireline operations.

Referring now to FIGS. 86 to 95, a rotary packer (19) and associated component parts are depicted.

Figures 86, 87, 88, 89, 90, 91, 92, 93, 94, 95:
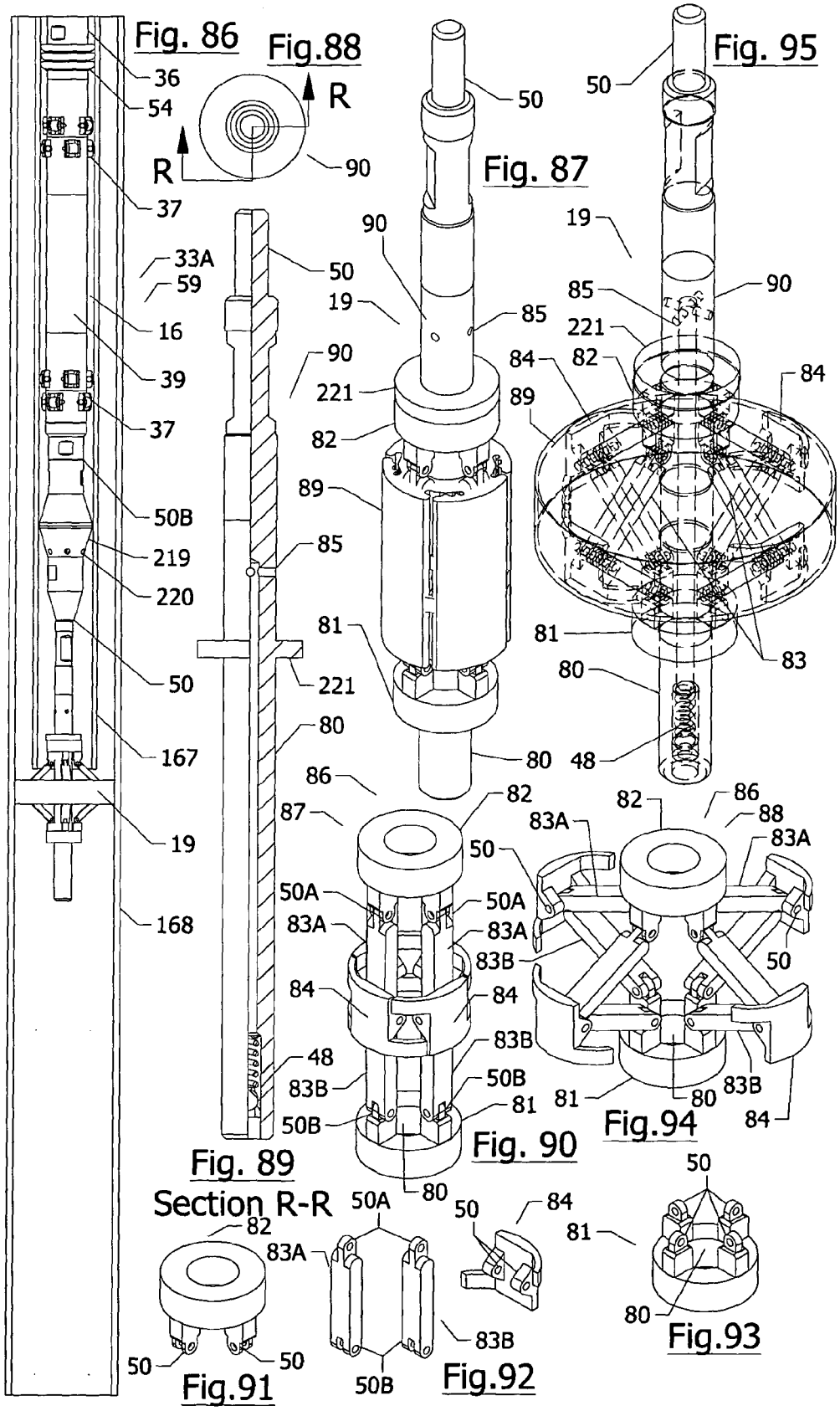
FIG. 86 depicts an embodiment of the present invention in which a screw packer is placed within a cut conduit section of a subterranean well.
FIG. 87 illustrates a collapsed screw packer usable with embodiments of the present invention.
FIGS. 88 to 93 depict component parts of the screw packer of FIGS. 87 and 95.
FIGS. 94 and 95 illustrate the internal parts of the screw packer of FIGS. 88 to 93 in an expanded position and an expanded screw packer, respectively.

FIG. 86 depicts a diagrammatic axial cross sectional view showing an embodiment (33A) of a dual conduit (59) rotary packer (19), which includes a flow diverter (36) with seals (54) diverting flow to a fluid motor (39) of a motor assembly (16) with anti-rotation apparatus (37). A lower rotary connector (50B) is shown engaged with a rotary connection crossover (219) having a diameter to resist axial upward flow within the inner conduit (167) and internal passageways extending from the lower rotary connector to fluid discharge orifices (220). The rotary connection crossover is disposed between the lower connector within the inner conduit and a rotary connector (50) of a rotary packer (19) expanded within an outer conduit (168).

Such embodiments (33A) are applicable to applications where a single inner conduit partially extends into a larger outer conduit. For example, it is common practice within subterranean wells is to extend a tail pipe below a production packer (113 of FIG. 4) with a recessed nipple (128 of FIG. 4) axially below for placement of a plug. It is often desirable to place a bridge plug across the lower liner (129 of FIG. 4) or casing, which will not pass through the production tubing (98 of FIG. 4). In such instances, the production tubing and associated production packer must be removed. However, through the use of a rotary packer having a bridging diameter expansion greater than conventional bridging plugs, it is possible to place the rotary packer without removing the production tubing (98 of FIG. 4) or production packer (113 of FIG. 4).

FIG. 87 depicts an isometric view of a rotary packer (19), associated with FIGS. 88-93, showing the rotary packer in a collapsed position for passage through a conduit, with a rotary connector (50) of a rotatable shaft (90), engagable with a motor. The rotary hanger has a movable engagement (80), such as threads or helical cam, engaged with a yoke (81), such that rotation of the shaft moves the yoke axially upward to expand a spider framework (86 of FIGS. 90 and 95), subsequently expanding a membrane (89) to create a packer or bridge plug.

In practice, graded granular particles and/or fluid within a containing membrane provide differential pressure bearing resistance to permeable fluid flow when the graded particles pack together as a result of fluid pressure attempting to pass through the graded particle mass. Placing finely graded particles, such as sand, within the membrane (89) of a rotary packer (19) allows the membrane to expand with expansion of a spider frame within, providing a differential pressure barrier when the rotary packer membrane seals to the inside diameter of a bore and pressure is applied across the bore within which it is expanded and sealed at its edges.

Preferred embodiments of a rotary packer will, generally, use a Kevlar membrane to prevent puncture by a sharp object within a conduit, covered with an elastomeric covering to seal the membrane to the inside diameter of the bore within which it is expanded, and finely graded sand particles within to create a differential pressure seal.

FIGS. 88 and 89 depict a plan view and an associated elevation cross sectional view taken along line R-R of FIG. 88, respectively, showing a rotary packer shaft (90) associated with FIGS. 87 and 95. A downhole removable replaceable rotary connection (50) is shown engagable with a motor at its upper end and a movable engagement (80), such as threads or a helical cam, to move a first yoke (81 of FIG. 93) axially upward while restraining a second yoke (82 of FIG. 91) with a restraining engagement (221) to expand (88 of FIG. 94) a collapsed (87 of FIG. 90) spider framework (86 of FIGS. 90 and 95) within a membrane (89 of FIG. 87), and consequently block the passageway within which the shaft is rotated.

Optional pressure relief orifices (85), an associated passageway and a one-way pressure relief valve (48) can also be present within the shaft to enable the rotary packer (19 of FIG. 95) to move axially downward or upward, depending on the orientation of the one-way valve, due to relief of pressure on a side of the rotary packer.

In abandonment situations where sealing cement has been placed below the rotary packer, and injection or circulation through the sealed conduit below is not possible, a pressure relief valve (48) can be added to the shaft to allow pressure above the rotary packer to force it downward by bleeding-off pressure below.

FIG. 90 depicts an isometric view of a spider framework (86) in a collapsed position (87), associated with FIGS. 89 and 91-95, showing an upper yoke (82) engagable below a rotatable restraining surface (221 of FIG. 89), engaged with upper hinge connectors (50A) to upper arms (83A) and lower hinge connectors (50B) and lower arms (83B), with intermediate push pads (84) engaged with a lower yoke (81) and having a movable engagement, such as threads or other helical surface engagable with the lower end of a shaft (80 of FIG. 89). The spider framework is disposed within a membrane (90 of FIG. 89) having sufficient surface to expand across the inner diameter of a conduit.

FIG. 91 depicts an isometric view of a four armed yoke (82), associated with FIGS. 90 and 95, showing an internal passageway for a shaft (90 of FIG. 89) and hinge connectors (50) associated with the upper end hinge connectors (50A of FIG. 90) of an arm (83A of FIG. 92).

FIG. 92 depicts an isometric view of an upper arm (83A), lower arm (83B) and a push pad (84), associated with FIGS. 90 and 95, showing upper hinge connector (50A) and lower hinge connector (50B) of the arms with the push pad hinge connection (50). The upper hinge connector (50A) of the upper arm (38A) engages the upper yoke (82 of FIG. 91), and the lower hinge connector (50B) of the upper arm (83A) engages the lower yoke (81 of FIG. 93) with the lower and upper end arm connections (50B and 50A respectively) engaging the push arm connector (50), as shown in FIG. 95.

FIG. 93 depicts an isometric view of a four armed yoke (81), associated with FIGS. 90 and 94, showing an internal passageway for a shaft (90 of FIG. 89), and hinge connectors (50) associated with lower end hinge connectors (50B of FIG.

92) of a lower arm (83B of FIG. 92). A movable engagement (80) is shown for engaging the lower end of the shaft (90 of FIG. 89).

FIG. 94 depicts an isometric view of a spider framework (86) in an expanded position (88), showing upper arms (83A) and upper end hinge connections (50A) engaged to an upper yoke (82), with lower arms (83B) and lower end connections (50B) engaged to a lower yoke (81). Lower end hinge connectors (50B) of the lower arms and upper end connectors (50A) of the upper arms engage push pads (84).

FIG. 95 depicts an isometric view of a rotary packer (19) with dashed lines showing hidden surfaces. FIG. 95 shows the rotary hanger in an expanded position for blocking the inside diameter of a conduit, such that a spider framework (86 of FIG. 94) is disposed in an expanded state (88 of FIG. 94) within a membrane (89) with an upper yoke (82) between a restraining surface (221) and a lower yoke (81) engaging a shaft (90) at a movable engagement (80), such as a thread or helical cam, with an optional one-way valve (48) and pressure relief orifice (85).

The rotary packer (19) can have a removable rotary connection (50) or alternatively, a different removable connection at the lower end of the rotary crossover (219 of FIG. 86) axially above, and optionally a rotary connection at the lower end of the rotary packer to engage other apparatus as shown in FIGS. 34-35, which allows the rotary packer to function as a secured bridge plug if engaged to an adjacent fixed conduit, or as a piston when placed within a conduit but not secured to a fixed conduit between a higher pressure region and lower differential pressure region. When used as a piston above a collapsible conduit, pressure may be applied axially above to crush conduits axially below and within the diameter of the rotary packer's seal, as shown in FIG. 34.

If the rotary packer includes a solid shaft, with an optional one-way valve, it can function as a bridge plug, and when an inner passageway is provided within the shaft, it can function as a packer, such as a production packer, if secured to a conduit by a connection at its ends, such as a rotary hanger described above.

Conventional packers are generally unacceptable for use as a piston since inflatable membranes are susceptible to puncture by sharp metal edges created during cutting, milling and/or boring of metal.

Preferred embodiments of a rotary packer use membrane material resistant to puncture, such as bullet-proof Kevlar material filled with graded particles, such as sand, to create a differential pressure barrier when expanded. Sufficient membrane material and packer axial depth can be provided to reach the inside diameter of the conduit in which the rotary packer is disposed to provide a seal.

Conventional packers and bridge plugs are generally limited in the extent of expansion for which they are capable, which can prevent placing a packer through a tubing to expand in a larger conduit axially below, as shown in FIG. 86. Thus, conventional packers are generally unacceptable for production needs, such as water shut-off, without removing the production tubing and production packer (98 and 113 of FIG. 4 respectively). Conversely, embodiments of the rotary packer of the present invention can be used to seal in a bore significantly larger than the bore through which it was placed.

When not used to perform work as a piston or production packer, the rotary packer (19) can be used to support fluids, such as cement, from falling downward after placement, in the manner of a bridge plug. For example, during an abandonment operation the rotary packer can be used to seal within in a bore significantly larger than the bore through which it was placed, such as by placing the packer below the nipple (128 of FIG. 4) and tailpipe, or in the open hole section (131 of FIG. 4) below the liner (129 of FIG. 4).

In thru-production tubing (98 of FIG. 4) sidetrack situations, a whipstock (133 of FIG. 6) can be placed at the upper end of a rotary packer expanded below the nipple (128 of FIG. 6) and tailpipe to prevent the need to remove production tubing (98 of FIG. 6) and production packer (113 of FIG. 6) to perform the lower side track (134B of FIG. 6).

In conventional practice, it is generally not practicable to place a conduit or pipeline pig, or plug pumped through the pipeline to clean it of water or other substances resting in low spots, through a conduit of smaller diameter than the diameter of the conduit or pipeline to be cleaned. The rotary packer of the present invention can be expanded after placement within the conduit or pipeline via a cable, and rollers (149 of FIGS. 13 and 14) can be placed on a spider framework (86 of FIGS. 90 and 94) replacing the push pads (84 of FIGS. 90, 92 and 94) and also subsequently expanded to provide an anti rotation device for a fluid motor, thus providing the ability to place a pig through a diameter smaller than the conduit or pipeline to be pigged, and still pig or clean the pipeline.

As demonstrated in FIGS. 4-8, 31-36, 44, 54-59 and 86, and in the preceding and following depicted and described embodiments for side-tracking, storage wells, abandonment and pipelines, it is shown that any combination and configuration of cable conveyed downhole assemblies can be used with fixed axial motor assemblies (16), axially variable motor assemblies (43), fluid motors, extendable conduits, rotary brushes, rotary bits, rotary operable expandable casing, anti-rotation devices (38 of FIGS. 97, 102-104), swivels (175 of FIGS. 113-114), disconnects (231 of FIGS. 120-122), rope sockets (241 of FIG. 129), stems, jars, running tools, pulling tools, knuckle joints and/or quick connections to maintain or intervene in a conduit.

Referring now to FIGS. 96-135, various embodiments of axially variable motor assemblies (43) and associated detail views and component parts are shown, illustrating motor assemblies (16) with fluid motors (39) axially held by a rotary hanger (18) and rotationally held by motor anti-rotation (37) devices.

Figure 96:
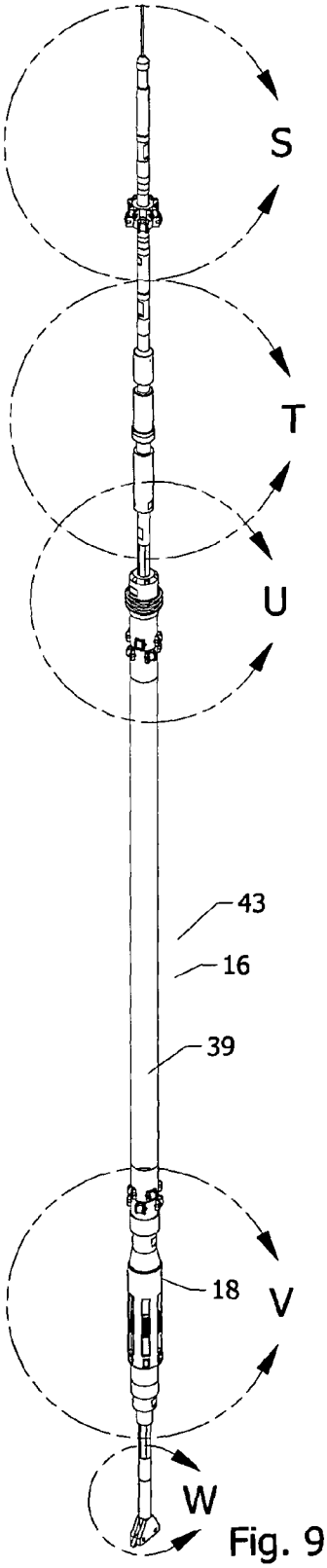
FIG. 96 illustrates a motor assembly usable with embodiments of the present invention, in which the axial shaft can be moved independently of the fluid driven motor.
Figure 97:
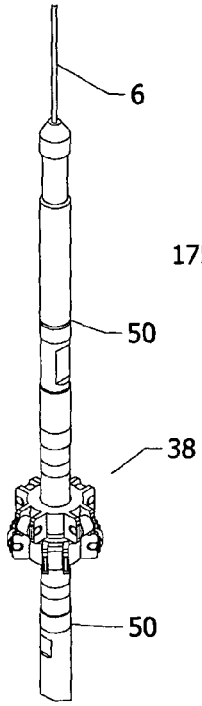
FIGS. 97 to 101 are detail views of the motor assembly of FIG. 96.
Figure 98:
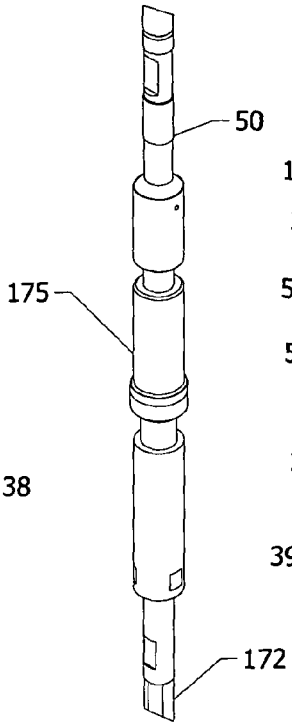
Figure 99:
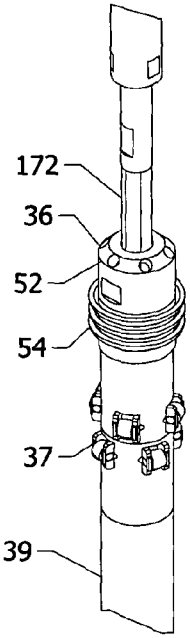
Figure 101:
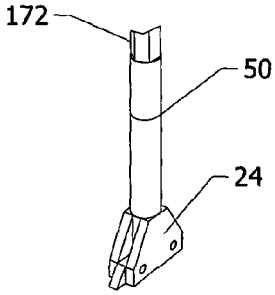

Referring now to FIGS. 96-101, isometric views are shown, with FIG. 96 having detail lines S, T, U V and W, which are shown in associated magnified views in FIGS. 97, 98, 99, 100 and 101 respectively. The figures depict an axial variable motor assembly (43) having a concentric hexagonal kelly (172 of FIGS. 98-101 and FIG. 123) that can be varied axially relative to a kelly bushing (173 of FIG. 100 and FIGS. 117-118) secured to a drive coupling (174 of FIGS. 60-61) and rotor (56 of FIGS. 18, 57-58, 126-127, and 133-134), similar to the arrangement shown in FIG. 126, in which the fluid motor (39) is secured to the conduit in which it is disposed with motor anti-rotation subassemblies (37) and a rotary hanger (18) at its lower end.

Figure 100:
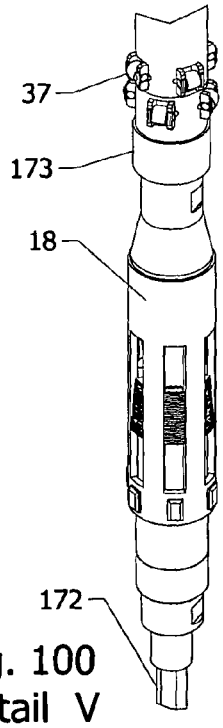

Once placed, the fluid diverter (36) diverts fluid to drive the motor (39), which in turn drives the kelly bushing (173 of FIG. 100). The kelly bushing engages the hexagonal kelly (172 of FIG. 98) and axially passes through rollers within the kelly bushing while being rotated around its axis at the lower end of the kelly. While a hexagonal kelly is shown, any shape of Kelly, such as a square kelly, is also usable.

The upper end of the kelly (172) is shown engaged to a swivel (175) to prevent rotating or twisting of the cable (6). A wireline anti-rotation device (38) is shown disposed between the cable and the swivel to further reduce the probability of twisting the cable and creating a failure point.

In use, the axial variable motor assembly (43) can be placed within a conduit, circulation is begun and fluid is diverted through the kelly, passing through a fluid diverter housing (52) to the fluid motor (39) which drives the rotor, associated kelly bushing, kelly and a rotary hanger (18) engaged to the lower end of the motor assembly (16), thereby engaging the rotary hanger to the conduit within which it is disposed.

After securing the rotary hanger to the conduit, shear pins within the rotary hanger can be sheared, allowing continued rotation of the kelly (172) by the kelly bushing (173) while the distance of the kelly above and below the securing point of the rotary hanger is controllable by tension applied to the cable (6).

With a rotary tool, shown as a mill (24), is engaged to the lower end of the Kelly (172), rotation can begin from a lower point and progress upward, in contrast to previously described embodiments which generally move downward. The depicted embodiment facilitates moving a rotating device upward to permit debris formed during an operation, such as milling, to fall below the point at which rotary work is being performed, thus removing unwanted friction and binding.

Once the desired rotary work has been performed, the axial variable motor assembly (43) can be jarred upward to release the rotary hanger and remove the tool string.

In through tubing work in a well that has been packed-off with debris in its production tubing (98 of FIG. 4), its lower side tracks (134B) through a liner (129 of FIG. 6), its upper side tracks (134A) through production tubing (98 of FIG. 6), its production casing (101 of FIG. 6) and intermediate casing (103 of FIG. 6) where a plurality of metal tubing and casings may bind a drilling assembly, or within a storage well where insolubles have filled the inner leaching string (144 of FIG. 7), the mill (24 of FIG. 101) can be replaced with a drilling or cleanout bit (161 of FIG. 22) at the lower end of extendable conduits (44 of FIGS. 23-25 and 27-18) with a lower end swivel between the extendable conduit and the bit. The upper end of the extendable conduits can be engaged to the lower end of a rotary hanger (18 of FIG. 100), such that the kelly can rotate within the extendable conduits, and flow from the lower end of the motor assembly through the extendable conduit to the lower end of the drilling or cleanup bit can occur with return circulation through a sliding side door (127) axially above the lower side track, any of the annuli above the upper side track, through the crossover (139 of FIG. 7) for the storage, or through perforations at a desired location. In this manner, a differential pressure circulation pathway between the upper end of the motor assembly and a bit can be formed, whereby the axially variable nature of the kelly turning within can rotate and control the axial movement of the bit to perform a boring function, discharging fluid through the bit on the outside of the extendable conduit to an annulus space prior to reaching the upper motor assembly flow diverter.

Referring now to FIGS. 102-112, a wireline anti-rotation device (38) usable with fixed and axially variable motor assemblies is illustrated, to prevent rotation of the deployment cable used to place and retrieve tools. In addition to providing anti-rotation resistance, the anti-rotation device can be capable of passing through reduced internal diameters within a conduit, such as a nipple (128 of FIG. 4) within a subterranean well.

In this example of an anti-rotation device, a spring (159) is provided within a recess of the housing (148A) to push a rod (160) which acts against the axle (149C) of a roller (149B) to allow the roller to be urged inward during passage through a reduced internal diameter, then to expand outward after passing the reduced diameter. The expanded roller provides resistance to rotation about the axis through contact between the curvature of the roller and the internal diameter of the conduit in which it is disposed.

FIG. 102 depicts an isometric view of a wireline anti-rotation device (38), associated with FIGS. 103-111, with an upper rotary connection (50A) and lower rotary connection (50B) showing anti-rotation rollers (149B) having axles (149C of FIG. 111) and a convex surface (222 of FIG. 111) matched to the associated curvature of the conduit in which the wireline anti-rotation device is disposed. The depicted device is shown, engaged with an upper (148A) and lower (148B) roller housing similar in construction to a motor anti-rotation housing (148 of FIG. 13) in which the upper roller housing can be secured to the lower roller housing or can rotate independently, as illustrated in FIG. 105, dependent upon the situation.

FIGS. 103 and 104 depict a plan view and an associated sectional elevation view taken along line X-X of FIG. 103, respectively, depicting the wireline anti-rotation device (38) of FIG. 102.

FIG. 105 depicts a magnified view of a wireline anti-rotation device (38 of FIG. 104), associated with FIGS. 106-108, taken along detail line Y of FIG. 104, showing bearings (203C) for axial rotation, bearings (203A) for axially eccentric rotation and bearings (203B) for axially compressive rotation. The bearings allow axial rotation below the anti-rotation device to be isolated from the connector above the device.

Rotation of the lower shaft (224) is supported axially by bearings (203A) in the lower roller housing (148B), with lateral rotational friction reduced by lateral bearings (203C) in the lower roller housing, and any compression frictional torque reduced by bearings (203B). The lower shaft can rotate within the lower roller housing with a roller (149B) engagement to the circumference of the conduit in which it is displaced. Any tension load is removed by bearings (203A) in the upper roller housing (148A), held by rollers (149B) to the circumference of the conduit in which it is disposed, so that any slippage of the upper roller housing is reduced by lateral bearings (203C), thereby minimizing any induced rotation of the upper shaft from rotation of said lower shaft. Seals (223) are usable to protect lubricating compounds of the bearings contained within.

FIGS. 106, 107 and 108 depict isometric views of bearings (203) usable in embodiments of the present invention, generally associated with FIGS. 102-105. The figures show a tapered bearing (203A), a spherical bearing (203B) and a cylindrical bearing (203C). While preferred embodiments are shown, any form of bearings and bearing arrangements are usable within embodiments of the present invention.

To further improve anti-rotation capabilities, optional springs (160) and associated push rods (159) acting against axles (149C) of rollers (149B) can be used within devices where increased frictional force resisting rotation about an axis can be achieved when the spring and rod force against the axles, applying force to the roller curvature (222 of FIG. 14) and/or to the circumferential curvature (222A of FIG. 14).

FIG. 109 depicts an isometric view and an elevation view of a push rod (159), associated with FIG. 105, showing the curvature of the push rod (160) matching the curvature of a roller axle (149A of FIG. 14, 149C of FIG. 111 or 149E of FIG. 112). Force from a spring (158) can be applied at the lower end to push the axle and associated roller curvature against the inside diameter of a conduit to reduce the propensity to rotate about the axis of the conduit while allowing axial movement.

FIG. 110 depicts an isometric view of a spring (158) associated with FIG. 105, showing one possible method for applying force to a push rod (159 of FIG. 109).

FIG. 111 depicts an isometric view of a roller (149B) and axle (149C) arrangement associated with FIGS. 102-105, showing a smooth curvature (222) usable to reduce the potential for damage to the inside diameter of a conduit within which the roller is disposed and used.

FIG. 112 depicts an isometric view of an alternate wheel (149D) and axle (149E) arrangement, replaceable with the wheel and axle arrangements of FIGS. 102-105, showing a serrated curvature (222B) to further improve the anti-rotation capabilities about an axis while allowing axial rolling along the circumference, during circumstances in which damage to the internal circumference is of lesser importance, such as during well abandonment.

Figures 113, 114, 115, 116, 117, 118, 119, 120, 121, 122, 123, 124, 125, 126, 127:
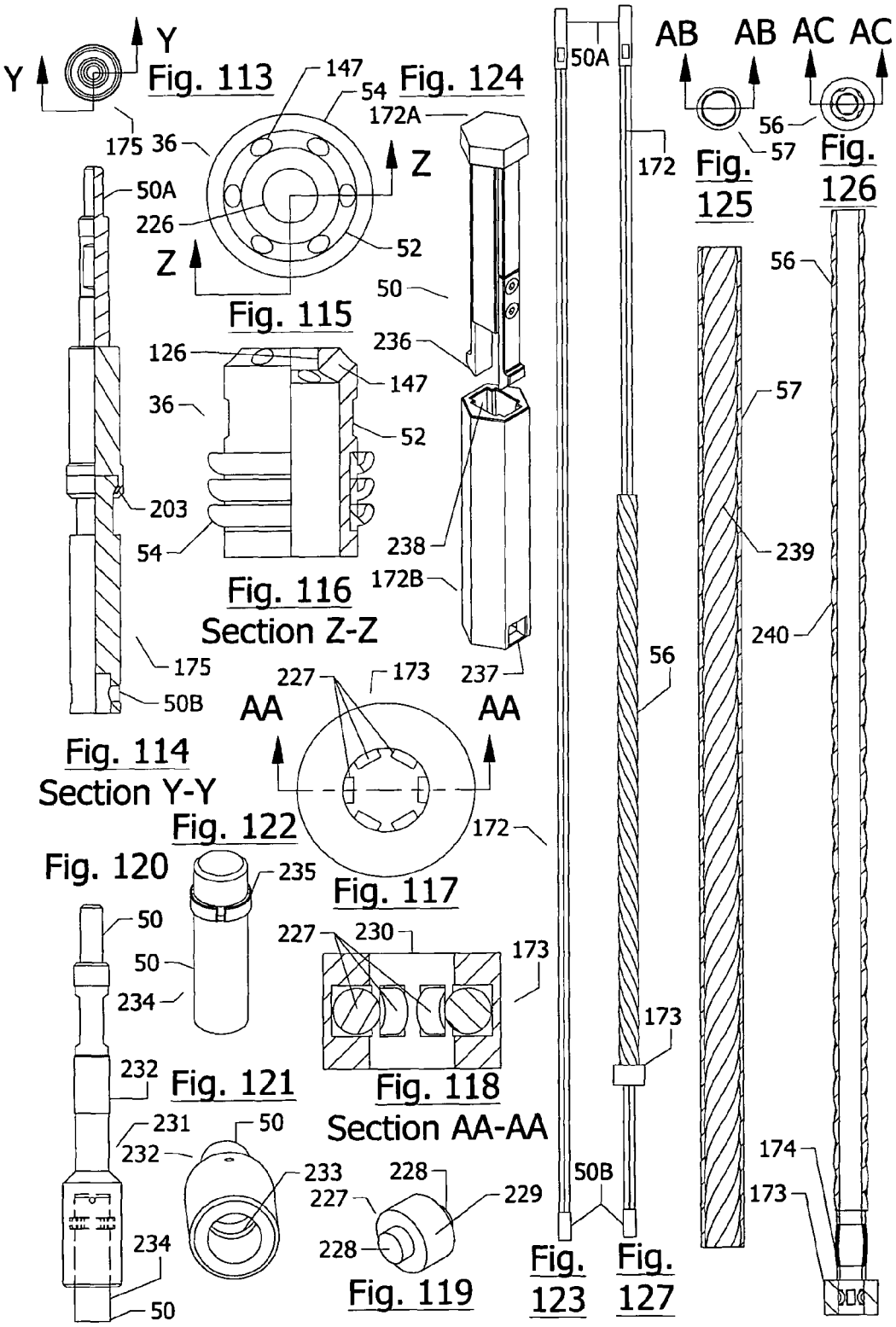
FIGS. 113 and 114 depict a swivel subassembly usable with the motor assemblies of FIGS. 96 and 128.
FIGS. 115 and 116 illustrate a flow diverter usable with the motor assemblies of FIGS. 96 and 128.
FIGS. 117 and 118 depict a kelly bushing usable with the kelly shaft of FIGS. 123 and 126 and motor assemblies of FIGS. 96 and 128.
FIG. 119 shows a kelly wheel usable with the kelly bushing of FIGS. 117 and 118.
FIG. 120 illustrates a release device usable with the motor assemblies of FIGS. 96 and 128.
FIGS. 121 and 122 show the component parts of the release device of FIG. 120.
FIG. 123 shows a kelly shaft.
FIG. 124 shows a connector for a kelly shaft.
FIGS. 125 and 126 depict a stator and rotor, respectively.
FIG. 127 illustrates a kelly shaft within a rotor usable with embodiments of the present invention.

Referring now to FIGS. 113 and 114, a plan view and an associated sectional elevation view taken along line Y-Y of FIG. 113, respectively, are shown, depicting a swivel (175) device associated with FIG. 132. The figures show a further method to that shown in FIGS. 102-110 by which a shaft having a lower rotary connection (50B) below a bearing (203) can rotate independently of a shaft having an upper connection (50A) above the bearing.

Referring now to FIGS. 115-119 and FIGS. 123-126, various components of an axially variable motor assembly usable with embodiments of the present invention are illustrated, to allow axial movement and rotation of a kelly (172 of FIG. 123).

Figure 133:
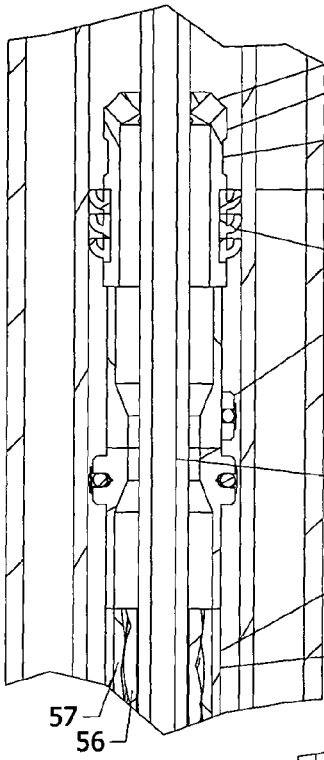

FIGS. 115 and 116 depict a plan view and an associated cross sectional elevation view taken along line Z-Z of FIG. 115. The Figures show an axially variable flow diverter (36), having a housing (52) with seals (54) engagable with the inside diameter of a conduit to divert flow through orifices (147) to an internal passageway and kelly passageway (226), through which a kelly (172) passes. The flow diverter is shown disposed at the upper end of an axially variable motor assembly, as shown in FIG. 133.

FIGS. 117 and 118 depict a plan view and an associated cross sectional elevation view taken along line AA-AA of FIG. 117, respectively, showing a kelly bushing (173) with kelly bushing wheels (227) engagable with the surfaces of a kelly (172 of FIG. 123) to facilitate rotation about the axis of the kelly while allowing the kelly to move axially through the kelly bushing.

The upper end (230) is secured to a rotor (56 of FIG. 126) so that rotation of the rotor rotates the kelly busing (173), which in turn rotates a kelly (172 of FIG. 123), as shown in FIG. 127.

FIG. 119 depicts an isometric view of a kelly bushing roller (227), associated with FIGS. 117-118, showing a surface (229) engagable with a surface of a kelly (172 of FIG. 123) about an axle (228).

FIGS. 120, 121 and 122 depict an elevation view of a wireline disconnect (231) device, an upper receptacle (232) of the device and a lower mandrel receptacle (234), respectively, associated with FIG. 131. The figures show dogs (235) of the lower end mandrel (234) engagable with a recess (233) of the upper end receptacle (232) to form a removable connection leaving apparatus engaged to the lower mandrel within a conduit for subsequent reconnection at a later time.

FIG. 123 depicts an elevation view of a hexagonal kelly (172), associated with FIGS. 98-101 and 125-135, showing upper (50A) and lower (50B) rotary connections. Described preferred embodiments of the present invention include a hexagonal kelly, but other shapes, such as a square kelly, are also usable.

FIG. 124 depicts an isometric view of a snap together hexagonal kelly rotary connector (50), showing an upper kelly end (172A) engagable with a lower kelly end (172B), with snap prongs (236) placed through a bore (238) and engaged in receptacles (237).

As lubricator arrangements (2 of FIG. 2) may limit lengths associated with an axially variable motor assembly or other embodiments of the present invention, such assemblies can, for example, be engaged within a conduit with rotary hangers with additional apparatus, such as a kelly connected with rotary connections (50 of FIG. 124), to extend the assembly length and overcoming the limited length associated with the lubricator arrangement.

Figure 134:
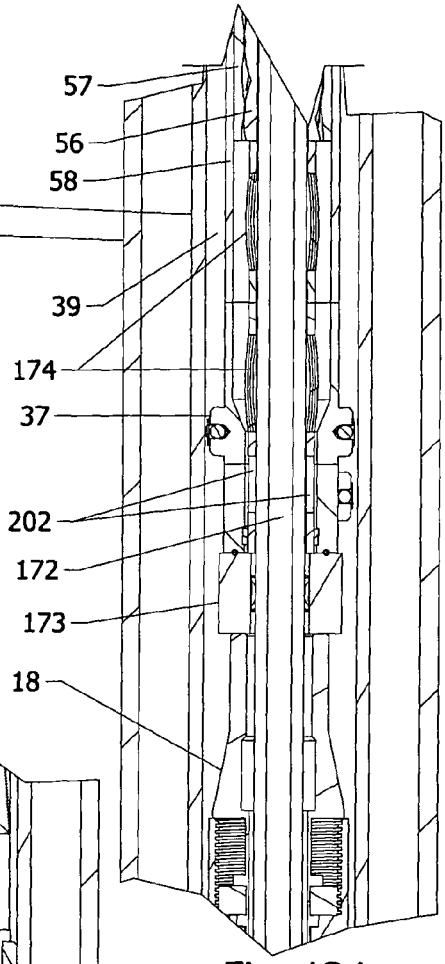

FIG. 125 depicts an upper plan view with section line AB-AB and an associated cross sectional elevation view taken along line AB-AB, showing a stator (57), associated with FIGS. 133-134. The stator is shown having nodal helical surfaces (239) used to urge nodal helical surfaces (240 of FIG. 126) of a rotor to rotate when placed within and fluid is positively displaced between the rotor and stator.

FIG. 126 depicts an upper plan view with section line AC-AC and a cross sectional elevation view taken along line AC-AC, showing a rotor (56) with a drive coupling (174) and kelly bushing (173) engaged to its lower end.

FIG. 127 depicts an elevation view of a kelly embodiment, showing a kelly (172) within a rotor (56) and kelly bushing (173).

Rotary apparatus, such as kelly bushings, can be engaged to the lower end of a rotor, as shown in FIG. 127, or can have a drive coupling (174 of FIG. 126) between the rotor and rotary apparatus, such as a kelly bushing (173) a rotary apparatus can also have a plurality of drive couplings between the rotor and a rotary apparatus, as shown in FIG. 134.

Referring now to FIGS. 128-135, a plan view with section line V-V and an associated cross sectional elevation view along line V-V is shown, with detail lines AD, AE, AF, AG, AH, AI and AJ associated with the views shown FIGS. 129, 130, 131, 132, 133, 134 and 135, respectively. The figures show a rope socket, wireline anti-rotation device, removable connection, swivel, flow diverter, motor anti-rotation, drive coupling, rotary hanger and rotary tool apparatuses within an inner conduit (167) disposed within an outer conduit (168).

Figure 128:
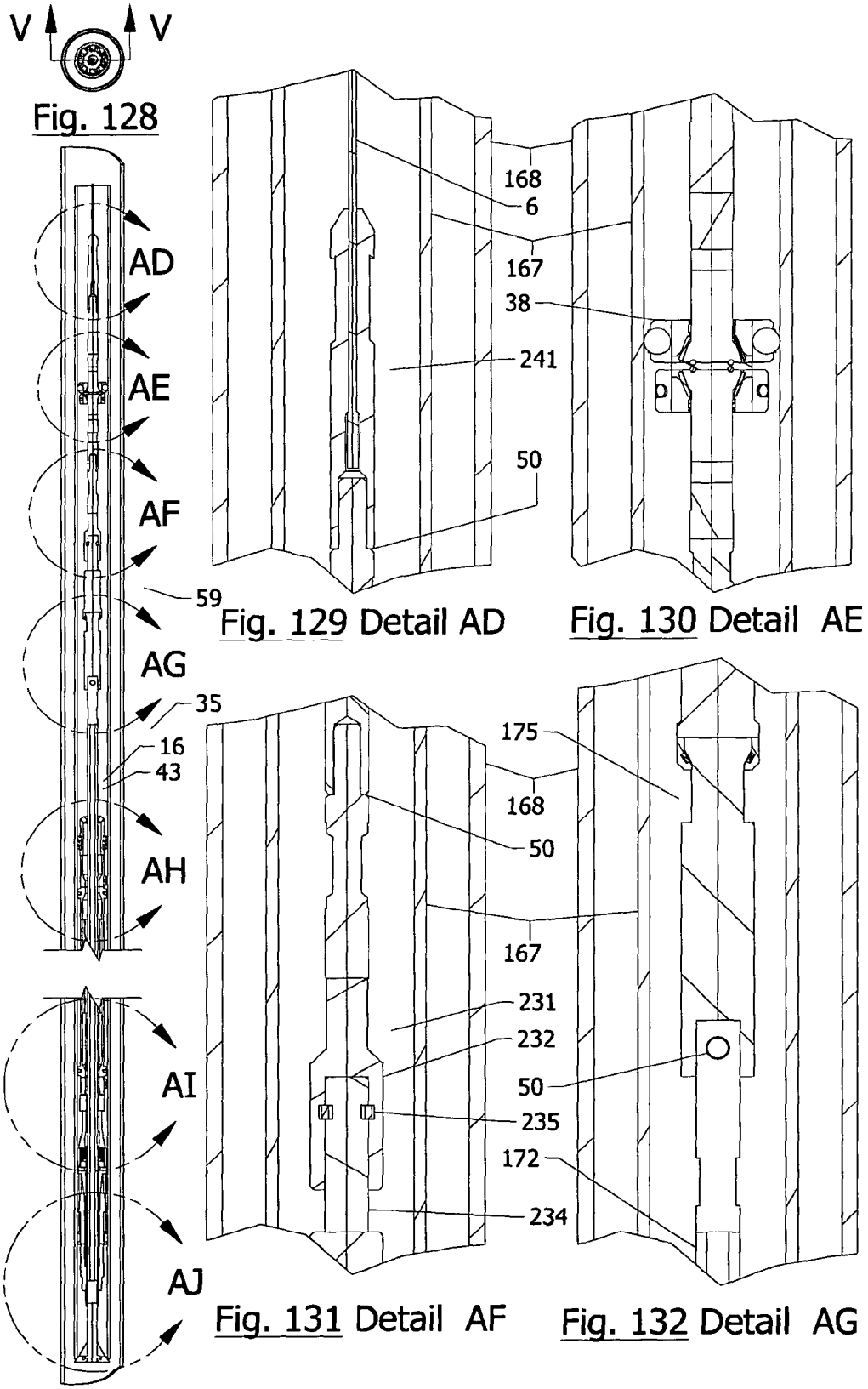
FIG. 128 is an embodiment of a motor assembly for milling a conduit within a subterranean well.

FIG. 129 depicts a magnified detail view associated with FIG. 128, taken along lien AD, showing a rope socket engagement between a cable and connector (50) at the upper end of an axially variable motor assembly.

FIG. 130 depicts a magnified detail view associated with FIG. 128, taken along line AE, showing a wireline anti-rotation (38) apparatus reducing the propensity of rotation below the anti-rotation apparatus transferred to the rope socket (241 of FIG. 129) and associated cable above.

FIG. 131 depicts a magnified detail view associated with FIG. 128, taken along line AF, showing a removable connection (231) with upper an receptacle (232) having a recess for engagement dogs (235) of an associated mandrel (234). The removable connection can be disconnected if the apparatus below the connection is left within the conduit and later reconnected.

Generally, the removal connection (231) is usable above a desired level of tension with the apparatus below the connection engaged with other apparatus or stuck to provide the necessary resistance for the tension necessary to disconnect the connection. After disconnection, a higher tension level connector can be engaged to remove the engaged or stuck assembly below the connection.

FIG. 132 depicts a magnified detail view associated with FIG. 128, taken along line AG, showing a swivel (175) with a rotary connection (50) to a kelly (172). Rotation of the kelly is reduced by the swivel and by a wireline anti-rotation device (38 of FIG. 130). Disconnect dogs (235 of FIG. 131) can be provided, and can be of either a rotary drive type or a rotatable type to further reduce the propensity of the kelly to rotate the cable (6 of FIG. 129).

FIG. 133 depicts a magnified detail view associated with FIG. 129, taken along line AH, showing a kelly flow diverter housing (52) and seals (54), forming a flow diverter (36) within a conduit (167), which diverts fluid flow through orifices (147) to an internal passageway leading to a fluid motor (39,) with the upper end of a rotor (56) within a stator (57) and associated housing (58) engaged to a motor anti-rotation device (37). A kelly (172) passes through the components and is axially movable.

FIG. 134 depicts a magnified detail view associated with FIG. 129, taken along line AI, showing the lower end of a rotor (56) within a stator (57) and associated stator housing (58) engaged to a motor anti-rotation device (37), engaged to the inner conduit (167) to anchor the stator and stator housing. Positive displacement of fluid between the rotor and stator rotates dual drive couplings (174) engaged to the lower end of the rotor, driving a kelly bushing (173) with a lower end engaged to the upper end of a rotary hanger (18). The kelly (172) passes through the components and is axially movable.

Positive displacement of fluid between the rotor (56) and stator (57) drives the rotary couplings (174) and associated kelly and rotary hanger, engaging grippers (191 of FIG. 135) of the hanger to the inner conduit (167) until pins shear and rotation supported on the rotary hanger continues. The rotary hanger axially anchors the motor assembly, allowing the kelly (172) to move axially during rotation.

The positively displaced fluid exits the fluid motor between the rotor (56) and stator (57), between the drive couplings (174), stator housing (58) and motor anti-rotation device (37), crossing over to the annular space about the kelly (172) through slots (202) in the lower end of the lower drive coupling engaged to the kelly bushing (173) and passing within the kelly bushing to lubricate the rollers passing through the rotary hanger (18).

The fluid inlet of a flow diverter (36 of FIG. 133) and a fluid outlet between the kelly and internal passageway of the rotary hanger provide communication between the high pressure region of the fluid inlet and the low pressure region below the rotary hanger, whereby the fluid motor (39) can be operated by differential fluid pressure between the inlet and outlet.

Figure 135:
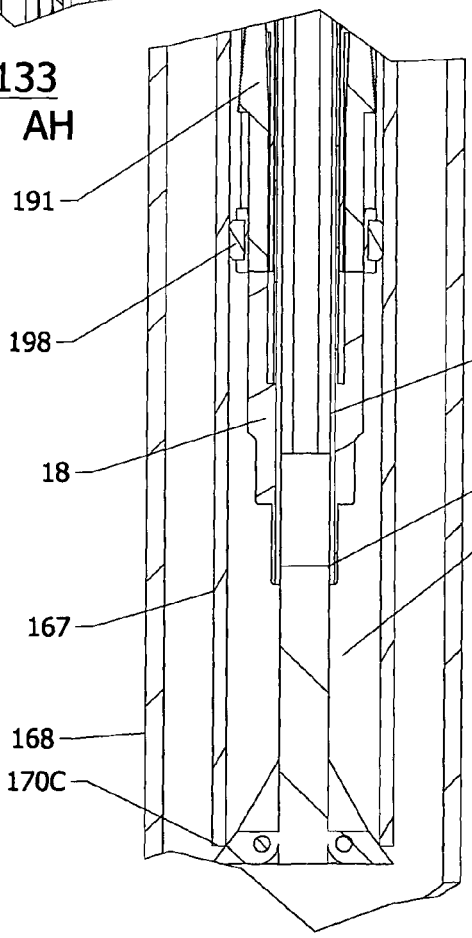

FIG. 135 depicts a magnified detail view associated with FIG. 129 of a tubing milling (35) embodiment, taken along line AJ, showing grippers (191) engagable with the inner conduit (167) through the engaging restraint of the drag blocks (198), with the inner conduit engaging the grippers as previously illustrated in FIGS. 44-52, to secure the motor assembly, allowing the kelly (172) to move axially during rotation. A mill (24) is shown engaged to the rotary connection (50) to mill (170C) the inner conduit (167) axially upward, allowing a reduction in tension of the cable (6 of FIG. 129) to disengage milling should the rotary mill become stuck or the fluid motor stall during upward movement. Alternatively, if the internal diameter of the mill (24) diameter engages the inside diameter of the conduit with a sharp or blunt surface and the kelly is moved axially, then a helical cutting or abrasive/polishing action can be carried out. Helical cutting of a conduit can weaken it for subsequent compressive crushing by a rotary packer, abrasion of the inside diameter can be performed to remove cement or scale from a conduit and polishing of a conduit is often performed to maintain polished bore receptacles.

Alternate embodiments using an axially variable motor assembly and associated kelly can be used in situations in which axial control is critical, such as when a motor assembly suspended from a cable is required to couple downhole apparatus with j-slots or threads, polish bore receptacles and/or to prevent damage to downhole equipment sensitive to rotation.

As demonstrated in FIGS. 96-135, and in the preceding depicted and described embodiments, any combination and configuration of wireline cable apparatuses, for example anti-rotation devices (38 of FIGS. 97, 102-104), swivels (175 of FIGS. 113-114), disconnects (231 of FIGS. 120-122), rope sockets (241 of FIG. 129), stems, jars, running tools, pulling tools, knuckle joints, quick connections, or other apparatus with an axially variable (43) motor assembly can be configured for use of an axially movable kelly to vary the axial force applied to avoid sticking, stalling, damage to sensitive downhole equipment and/or to provide greater axial control of rotating equipment to improve performance.

Embodiments of the present invention thereby provide systems and methods that enable any configuration or orientation of one or more motor assemblies to maintain or intervene with a conduit of a subterranean well, pipeline, riser, or other conduits where a cable is useable to place embodiments of the present invention and/or pressure control usable through a lubricator arrangement (2 of FIG. 5).

Additionally, rotary packers usable with embodiments of the present invention can be placed via a cable adjacent to sharp objects and through diameters significantly smaller than the diameter in which the placed packer must seal.

While various embodiments of the present invention have been described with emphasis, it should be understood that within the scope of the appended claims, the present invention might be practiced other than as specifically described herein.

What is claimed is:

1. A method of sealing a subterranean borehole or one or more conduits thereof, comprising:

lowering a cutting assembly driven by a downhole motor or actuator into said subterranean borehole or one or more conduits thereof;

forming one or more cuts with said cutting assembly in said one or more conduits in a downhole cutting zone in said subterranean borehole to sever or weaken by cutting for removing at least a portion of said one or more conduits thereof from or within said downhole cutting zone and leave a space; and injecting fluid into an annulus region of said subterranean borehole or one or more conduits thereof to form a higher pressure end thereof to act toward a lower pressure end thereof to, in use, operate said downhole motor or actuator and deposit a settable sealing material in said space for allowing said settable sealing material to set.

2. The method according to claim 1, wherein said cutting assembly comprises a cutting tool which is deployed in a radially outward direction from a transverse or peripheral axis about said cutting assembly axis to engage and cut said one or more conduits thereof.

3. The method according to claim 1, wherein forming one or more cuts comprises making said one or more cuts transverse to the axis of said one or more conduits thereof to sever said one or more conduits in a downhole region usable to engage said motor or actuator with said one or more conduits thereof to form said higher and lower pressure ends.

4. The method according to claim 2, wherein said cutting tool comprises a cutting wheel engagable with a peripheral or surrounding conduit, wherein said cutting wheel comprises a peripheral cutting edge.

5. The method according to claim 1, wherein said cutting assembly comprises a milling tool which is used to cut or mill a severed end of said one or more conduits thereof and is urged upwardly using an axially and transversely movable wheeled anti-rotation cable tool during cutting or milling to remove said at least a portion of said one or more conduits thereof.

6. The method according to claim 1, wherein forming one or more cuts comprises making said one or more cuts transverse to a radial plane of said one or more conduits thereof to weaken at least one of said one or more conduits thereof against axial compression of said one or more conduits thereof by said downhole motor or actuator operated between said higher and lower pressure ends.

7. The method according to claim 1, further comprising:

lowering a packer into said subterranean borehole;

sealing the packer within a conduit surrounding or surrounded by said one or more conduits thereof to form said do whole motor or actuator;

applying said fluid injected into said subterranean borehole to form said higher pressure end and force said packer to said lower pressure end and a weaken a portion of said one or more conduits thereof to axially compress said weakened portion and thereby displace an end thereof to form said space for said settable sealing material.

8. The method according to claim 7, wherein said packer is a radially expandable packer and is expanded against a conduit wall surrounding or surrounded by said one or more weakened conduits thereof to engage it therein and thereby form said downhole motor or actuator between said higher and lower pressure ends.

9. The method according to claim 7, wherein a conduit removal apparatus is used to engage said packer to the end of the at least a portion of said one or more conduits thereof to be weakened for forming a piston to compress and thus weaken said at least a portion, and thereby remove said end of said at least a portion from said higher to said lower pressure end to form said space for said settable sealing material.

10. The method according to claim 1, wherein a cable or said downhole motor or actuator is connected to axially and transversely movable wheels of a downhole anti-rotation apparatus which has a peripheral array of rollers that bear against a wall of said subterranean borehole or said one or more conduits thereof and allow axial movement but substantially prevent cutting said wall, rotating said cable, rotating said downhole motor or actuator, or combinations thereof.

11. The method according to claim 10, wherein said downhole motor or actuator is a motor suspended from said cable and having a stator which is secured against rotation by said downhole anti-rotation apparatus.

12. The method according to claim 11 wherein said downhole motor is coupled to a kelly coupling which allows axial movement of said cutting assembly during a cutting operation.

13. The method according to claim 1, wherein said downhole motor or actuator is operable by differential fluid pressure between a fluid inlet and outlet thereof, and wherein fluid is injected into said subterranean borehole to form said higher pressure end at said fluid inlet and to form said lower pressure end at said fluid outlet, usable to thereby drive said downhole motor or actuator.

14. The method according to claim 13, wherein said downhole motor or actuator is a motor having a stator and a rotor, said stator and rotor defining an axial flow path for working fluid between said stator and rotor, wherein the rotor, the stator, or combinations thereof, have a helical channel or projection which is acted on by fluid flow in said flow path to drive said rotor.

15. The method according to claim 14 wherein said stator and rotor both have helical nodal surfaces.

16. The method according to claim 1, wherein said downhole motor or actuator comprises a plurality of downhole motors axially connected by at least one universal joint.

17. The method according to claim 1, wherein said cutting assembly is lowered with an axially and transversely movable wheeled anti-rotation cable tool for substantially preventing rotation of an associated deployment cable.

18. The method according to claim 1, wherein a cutting tool of said cutting assembly, actuated by said downhole motor or actuator that is sealed to said one or more conduits thereof between said higher and lower pressure ends, is urged against said one or more conduits thereof by the weight of said cutting assembly, fluid pressure applied to the higher pressure end and said cutting assembly, tension applied to a cable from which the cutting assembly is solely suspended, or combinations thereof.

19. A method of sealing a subterranean borehole comprising:

lowering a cutting assembly driven by a downhole motor or actuator into said subterranean borehole;

forming one or more cuts with said cutting assembly in a conduit in a downhole cutting zone in said subterranean borehole to remove at least a portion of said conduit from said downhole cutting zone and leave a space;

engaging an extendable and retractable conduit for placing settable sealing material at a lower end thereof to the lower end of said conduit;

applying fluid pressure to said conduit to extend said extendable and retractable conduit;

pumping heavier settable sealing material and depositing the heavier settable sealing material into the space created by removal of said at least a portion;

displacing said heavier sealing material from said extendable and retractable conduit with a lighter displacement fluid;

releasing pumping pressure thereby retracting said extendable and retractable conduit from immersion in said heavier sealing material and isolating said lighter displacement fluid from said heavier sealing material within said extendable and retractable conduit using a wall thereof and a one-way valve, and allowing said heavier settable sealing material to set.

20. A method of sealing a subterranean borehole comprising:

lowering a crushing assembly driven by a downhole motor or actuator into said subterranean borehole;

injecting fluid into said subterranean borehole or one or more conduits thereof to form a higher pressure end thereof to act toward a lower pressure end thereof to in use, operate said downhole motor or actuator;

forming one or more crushing cuts to the wall of said one or more conduits thereof to weaken a severed end of said one or more conduits thereof;

applying force from said crushing assembly to the severed end of the one or more conduits thereof in said subterranean borehole to further axially weaken and then axially displace said severed end to form a space; and depositing settable sealing material in said space and allowing said settable sealing material to set.

21. A method of sealing a subterranean borehole comprising:

lowering a crushing assembly driven by a downhole motor or actuator into said subterranean borehole;

forming one or more cuts in a severed end of one or more conduits thereof prior to applying a force to said severed end;

applying said force from said crushing assembly to the severed end of the one or more conduits thereof in said subterranean borehole to axially displace said severed end to form a space; and depositing settable sealing material in said space and allowing said settable sealing material to set.

22. The method according to claim 21, wherein said crushing assembly comprises an axial movable packer sealed within a conduit surrounding or surrounded by said one or more conduits thereof, and wherein said force is applied from said movable packer to said severed end.

23. The method according to claim 21, wherein an axially movable packer is a radially expandable packer and is expanded against a conduit wall to engage the packer thereto and axially move the packer therethrough to, in use, form said crushing assembly, deposit said salable sealing material, or combinations thereof.

24. An apparatus for performing crushing or cutting operations in a subterranean borehole or conduit thereof, said apparatus comprising a cable operable downhole assembly placeable and suspendable within and retrievable from said subterranean borehole or said conduit thereof via said cable, said downhole assembly comprising:

a cutting tool coupled to a fluid motor or piston, a crushing tool coupled to a piston, or combinations thereof, wherein at least one axially and transversely movable wheeled anti-rotation tool operates said downhole assembly axially within said subterranean borehole or said conduit thereof while substantially preventing rotation of said cable, and wherein said fluid motor or said piston comprises a fluid inlet and a fluid outlet that communicate with high pressure and low pressure regions, respectively, of said subterranean borehole or said conduit thereof via an engagement of said downhole assembly to said subterranean borehole or said conduit thereof, whereby said fluid motor or said piston is operable by differential fluid pressure within said subterranean borehole or said conduit thereof to operate said cutting tool coupled to the motor or the piston or said crushing tool coupled to the piston.

25. The apparatus according to claim 24, further comprising a plurality of fluid motors axially connected in series by at least one universal joint.

26. The apparatus according to claim 24, further comprising a kelly coupling engaged with said cutting tool, wherein said kelly coupling allows axial movement of said.

27. The apparatus according to claim 24, wherein said downhole assembly comprises a rotary cutting tool which is deployable in a radially outward direction to engage and cut one or more of said conduits thereof in a circumferential direction using said differential fluid pressure engagement with said subterranean borehole or said conduit thereof to drive said motor relative to said at least one axially and transversely movable wheeled anti-rotation tool.

28. The apparatus according to claim 24, wherein said downhole assembly comprises a rotary cutting tool which is deployable in a radially outward direction to engage and cut one or more of said conduits thereof in an axial direction using a differential fluid pressure engagement of said piston with said subterranean borehole or said conduit thereof to drive said downhole assembly.

29. The apparatus according to claim 24, wherein said rotary cutting tool comprises a cutting wheel engagable with peripheral or surrounding conduit, wherein the cutting wheel comprises a peripheral cutting edge extendable from a transverse or peripheral axis about a central axis of said cutting wheel.

30. The apparatus according to claim 24, wherein said rotary cutting tool comprises a milling tool for cutting or milling a severed end of said one or more conduits thereof using said differential fluid pressure engagement of said piston with said subterranean borehole or said conduit thereof to drive said cutting or milling tool.

31. The apparatus according to claim 24, further comprising a packer which is radially expandable against a conduit wall to seal the packer within said subterranean borehole or said conduit thereof to provide said differential fluid pressure operation of said downhole assembly.

32. The apparatus according to claim 31, wherein said packer comprises an expandable frame within a membrane containing graded particles resistant to fluid passage therein, wherein said expandable frame, membrane and graded particles are placed through a conduit to expand within said subterranean borehole or said conduit thereof or a space adjacent to an end of said subterranean borehole or said conduit thereof to seal said subterranean borehole or conduit or said space.

33. The apparatus according to claim 32, wherein said packer further comprises a one-way valve and an associated passageway extending through said packer, allowing controlled release of fluid below said packer with pressure applied above said packer to move said packer axially within said subterranean borehole or said conduit thereof or said space adjacent to the end of said subterranean borehole or conduit.

34. The apparatus according to claim 24, further comprising a cable operable rotary hanger which is rotatably securable to and releasable from a wall of said subterranean borehole or said conduit thereof.

35. A method of using cutting or crushing operations for performing maintenance or intervention functions within one or more subterranean boreholes, or conduits thereof, comprising:

positioning a downhole assembly with at least one axially and transversely movable wheeled anti-rotation tool within said one or more subterranean boreholes or conduits thereof using a cable, wherein the downhole assembly comprises: a cutting tool coupled to a motor or a piston, a crushing tool coupled to a piston, or combinations thereof;

using higher and lower pressure regions of said one or more subterranean boreholes or conduits thereof to actuate said motor or said piston to, in use, operate said cutting tool or said crushing tool between said regions or to use the engagement of said at least one axially and transversely movable wheeled anti-rotation tool with said one or more subterranean boreholes or conduits thereof, wherein said higher and lower pressure regions of said one or more subterranean boreholes or conduits thereof is used to actuate said motor or said piston to extend thereto: said cutting tool coupled to the motor or the piston or said crushing tool coupled to the piston; and actuating said cutting tool, said crushing tool, or combinations thereof, to perform said maintenance or intervention functions within said one or more subterranean boreholes or conduits thereof.

36. The method according to claim 35, further comprising injecting fluid into said one or more subterranean boreholes or conduits thereof to form said higher pressure and lower pressure regions therein, and wherein said motor comprises a fluid inlet and a fluid outlet which communicate with said higher pressure and lower pressure regions, respectively, to actuate said motor r said piston.

37. The method according to claim 35, wherein said downhole assembly is placed into said one or more subterranean boreholes or conduits thereof with a cable, and wherein said maintenance or intervention function comprises side-tracking a well to axially and radially extend a bore projection, as conduit, a settable sealing material, or combinations thereof, from said one or more subterranean boreholes or conduits thereof.

38. The method according to claim 35, further comprising placing a downhole assembly with a cable to form a piston or pig, brushing apparatus, fluid jetting apparatus, or combinations thereof, into said one or more subterranean boreholes or conduits thereof for cleaning said one or more subterranean boreholes or conduits thereof.

39. The method according to claim 35, wherein said downhole assembly is placed into a conduit with a cable to couple or decouple said cutting tool coupled to the motor, or the piston, said crushing tool coupled to the piston, or combinations thereof, from said downhole assembly, said one or more subterranean boreholes or conduits thereof, or combinations thereof.

40. The method according to claim 35, wherein said downhole assembly is placed into a conduit with a cable and said at least one axially and transversely movable wheeled anti-rotation tool cuts said conduit or an apparatus in or about said conduit, wherein actuating said cutting tool, said crushing tool, or combinations thereof, comprises forming one or more cuts transverse to a radial plane of said conduit or said apparatus, transverse to the axis of said conduit or said apparatus, or helically along the circumference of said conduit or said apparatus.

41. The method according to claim 35, wherein said downhole assembly is placed into a conduit with a cable and said at least one axially and transversely movable wheeled anti-rotation tool cuts said conduit or an apparatus in or about said conduit, wherein actuating said cutting tool, said crushing tool, or combinations thereof, comprises abrading or polishing said conduit or said apparatus transverse to a radial plane, transverse to the axis of said conduit or said apparatus, or helically along the circumference of said conduit or said apparatus.

42. The method according to claim 35, wherein actuating said cutting tool, said crushing tool, or combinations thereof, seals said one or more subterranean boreholes or conduits thereof by rotary engagement of apparatus.

* * * * *